US005959532A

United States Patent [19]

Fujiuchi et al.

[11] Patent Number: 5,959,532

[45] Date of Patent: Sep. 28, 1999

[54] THEFT PREVENTIVE APPARATUS AND RADIO WAVE RECEIVING SIGNALING DEVICE

[75] Inventors: Hiroyuki Fujiuchi; Akira Saito; Kenji Uchida; Masayuki Yao, all of Osaka; Mitsuhiko Nakajima, Kamiina-Gun; Shigeyoshi Takatori; Yasuhiro Noma, both of Tokyo; Hisakazu Okumura; Tatuji Matukawa, both of Kanra-Gun, all of Japan

[73] Assignee: Kubota Corporation, Osaka, Japan

[21] Appl. No.: 08/776,500

[22] PCT Filed: Jul. 27, 1995

[86] PCT No.: PCT/JP95/01505

§ 371 Date: Apr. 18, 1997

§ 102(e) Date: Apr. 18, 1997

[87] PCT Pub. No.: WO96/04621

PCT Pub. Date: Feb. 15, 1996

[30] Foreign Application Priority Data

| | | | |
|---|---|---|---|
| Jul. 29, 1994 | [JP] | Japan | 6-178579 |
| Aug. 4, 1994 | [JP] | Japan | 6-183454 |
| Aug. 4, 1994 | [JP] | Japan | 6-183455 |
| Aug. 4, 1994 | [JP] | Japan | 6-183456 |
| Aug. 4, 1994 | [JP] | Japan | 6-183458 |
| Aug. 5, 1994 | [JP] | Japan | 6-184316 |
| Aug. 5, 1994 | [JP] | Japan | 6-184317 |
| Mar. 3, 1995 | [JP] | Japan | 7-43689 |

[51] Int. Cl.[6] ..... G08B 13/181

[52] U.S. Cl. ..... 340/572.3; 340/572.1; 340/572.5; 340/572.8; 340/572.9

[58] Field of Search ..... 340/571, 572.1, 340/572.3, 572.5, 572.7, 572.8, 572.9

[56] References Cited

U.S. PATENT DOCUMENTS

| | | | |
|---|---|---|---|
| 3,253,271 | 5/1966 | Trupiano et al. | 375/295 |
| 3,755,803 | 8/1973 | Cole et al. | 340/572.1 |
| 3,995,900 | 12/1976 | Humble et al. | 292/316 |
| 4,000,543 | 1/1977 | Paskert | 340/572.8 |
| 4,274,088 | 6/1981 | Pierson et al. | 340/568.8 |
| 4,987,754 | 1/1991 | Minasy et al. | 70/57.1 |
| 4,992,776 | 2/1991 | Crossfield | 340/551 |
| 5,191,314 | 3/1993 | Ackerman et al. | 340/542 |
| 5,610,587 | 3/1997 | Fujiuchi et al. | 340/568.2 |
| 5,656,998 | 8/1997 | Fujiuchi et al. | 340/571 |

FOREIGN PATENT DOCUMENTS

| | | |
|---|---|---|
| 0 385 800 | 9/1990 | European Pat. Off. . |
| 52-82094 | 7/1977 | Japan . |
| 55-89192 | 12/1980 | Japan . |
| 61-160583 | 10/1986 | Japan . |
| 62-285328 | 12/1987 | Japan . |
| 63-195493 | 12/1988 | Japan . |
| 2-260098 | 10/1990 | Japan . |
| 4-20192 | 2/1992 | Japan . |
| 4-211897 | 8/1992 | Japan . |
| 4-108286 | 9/1992 | Japan . |
| 1015700 | 1/1966 | United Kingdom . |
| 2137391 | 10/1984 | United Kingdom . |
| 2205426 | 12/1988 | United Kingdom . |
| 90/09648 | 8/1990 | WIPO . |
| 91/13416 | 9/1991 | WIPO . |
| 95/06924 | 3/1995 | WIPO . |

OTHER PUBLICATIONS

Patent Abstracts of Japan, vol. 105, No. 246 (E–1081), Jun. 24, 1991; JP–A–03 077219 (Omron Corp.), Apr. 2, 1991.

*Primary Examiner*—Glen Swann

*Attorney, Agent, or Firm*—Townsend and Townsend and Crew LLP

[57] ABSTRACT

A theft preventative apparatus is used to detect an attempted theft of an object and produce an audible alarm when an antenna (22) in the apparatus receives a radio wave signal from a transmitter (0). The apparatus can be deactivated using a bar-like releasing tool (K) inserted into the housing. Attempted theft can also be detected using a length of electrically conductive wire (3) securable to the object to be protected. The ends (30) of the wire are mounted to the housing. Disruption of the electrical path, such as by cutting the wire or removing one of the ends (30) from the housing, causes the audible alarm to be produced.

40 Claims, 25 Drawing Sheets

THEFT PREVENTIVE APPARATUS AND RADIO WAVE RECEIVING SIGNALING DEVICE

BACKGROUND OF THE INVENTION

The present invention relates to a theft preventive apparatus and a radio wave receiving signaling device, and more particularly to a theft preventive apparatus apparatus including a box to be attached to an object of theft prevention, preliminary act detecting means provided in the box for detecting a preliminary theft act, alarm output means disposed inside the box for outputting alarm information based on detection information of the preliminary act detecting means, retaining means for retaining the alarm output means at an operative state, alarm release means for stopping an operation of the alarm output means, an insertion hole being defined in an outer periphery of the box extending into the box, the alarm release means being operable to an alarm releasing state by a bar-like releasing tool inserted into the insertion hole. The invention relates also to a radio wave receiving signaling device used with the theft preventive apparatus.

Such theft preventive apparatus is used as being attached to an object of theft prevention such as a commodity displayed at a shop. When a preliminary stealing act is committed, i.e. when the box of the theft preventive apparatus is unlawfully removed from the object of theft prevention or when the object of theft prevention together with the box of the theft preventive apparatus being attached thereto is unlawfully taken out of the shop, this is detected and the alarm output means outputs alarm information, such that a shop attendant or the like is notified of the commitment of such preliminary stealing act as described above, whereby loss due to theft may be prevented.

On the other hand, when the object of theft prevention is lawfully provided to its purchaser, it is necessary to remove the theft preventive apparatus from the object of theft prevention. And, in this removing operation, the alarm output means needs to be rendered inoperative.

For rendering the alarm output means inoperative, the alarm release means is provided. By inserting the bar-like releasing tool into the insertion hole defined in the box of the theft preventive apparatus, the alarm releasing means is operated into the alarm releasing state to render the alarm output means inoperative. Then, the theft preventive apparatus may be removed from the object of theft prevention.

Further, when the theft preventive apparatus is used as being attached to the object of theft prevention, based on an activation instruction, the retaining means retains the alarm output means at the operative state. Namely, the alarm output means is maintained at the inoperative state before use to save electric power consumption, and the alarm output means is reliably retained at the operative state under the in-use condition.

As the retaining means, the convention has provided the followings.

For instance, as disclosed in a Japanese patent application Hei. 5-215886 by the present applicant, there is provided a switch for allowing or inhibiting electric power supply to the alarm output means. This switch is turned ON by means of an operated tool which slides in association with attachment of an attachment member to the object of theft prevention. Also, in association with the sliding movement, a retaining element comprised of a spring wire element automatically comes into engagement of a retaining piece of the operated tool, thereby to retain the operated tool at the switched-on position against the urging force of the spring. This retaining mechanism constitutes the retaining means described above.

However, with the conventional art described above, the alarm output means is retained at the operative state by means of the retaining mechanism described above. Then, with application of vibration for instance, the retained state may be released. Or, after the retaining action and the releasing action are repeated for a number of times, there occurs such inconvenience as frictional wear which renders the retaining mechanism unreliable.

Then, in order to improve retaining function, it is conceivable to improve the construction of the retaining mechanism so that the mechanism may provide more reliable retaining function. However, such improvement renders the construction complicated and enlarges the entire apparatus.

Moreover, with the above-described conventional art, when a bar-like fake operating tool similar to the releasing tool is unlawfully inserted into the insertion hole for the release operation, the retaining state of the retaining mechanism may be relatively easily released to render the alarm output means inoperative. Thus, in this respect too, there has been room for improvement.

The present invention has been made in consideration to the above-described state of the art. Its first object is to provide a theft preventive apparatus which can reliably maintain the alarm output means under the operative state without inviting enlargement of the apparatus.

A further object is to inhibit the alarm output means from being readily rendered into the inoperative state unlawfully by e.g. a fake operating tool other than the authorized releasing tool.

A still further object is to provide a theft preventive apparatus which is easy to handle and practical such as being resistant against erroneous operation.

A still further object is to provide a radio wave receiving signaling device to be used with the theft preventive apparatus described above.

SUMMARY OF THE INVENTION

According to the characterizing features of a theft preventive apparatus relating to the present invention, in a theft preventive apparatus in which preliminary act detecting means for detecting a preliminary theft act is provided inside a box to be attached to an object of theft prevention;

the box accommodates therein alarm output means for outputting alarm information based on detection information of the preliminary act detecting means, retaining means for retaining the alarm output means at an operative state thereof, and alarm releasing means for stopping the operation of the alarm output means;

an insertion hole for a releasing operation is defined in the box extending from an outer periphery thereof to the inside of the box; and the alarm releasing means is adapted to be rendered into an alarm releasing state by means of a bar-like releasing tool to be inserted into the insertion hole;

the retaining means is comprised of an electric retaining circuit to be set to the retaining state; and the alarm releasing means is comprised of a retention releasing instructing switch for instructing a retention release to the electric retaining circuit in the form of an electric signal, the preliminary act detecting means includes an antenna disposed inside the box for receiving a radio wave transmitted from a transitter installed at a predetermined site; and the alarm output means outputs the alarm information based on a reception signal from the antenna.

According to this construction, when the electric retaining circuit is set to the retaining state based on an activation instruction, the alarm output means is retained at an operative state.

Then, for releasing the alarm activation, in association with insertion of an authorized releasing tool into the insertion hole, the retention releasing instructing switch instructs retention release to the electric retaining circuit in the form of an electric signal, so that the electric retaining circuit is rendered into the retention releasing state and the operation of the alarm output means is stopped.

Since the retaining means for retaining the alarm output means under the operative state is comprised of the electric retaining circuit as described above, there is required only a small space and the entire apparatus may be formed compact. Also, there occur no such inconveniences as the release state being readily released by e.g. vibration or the retaining function deteriorating with the releasing operations being repeated for a number of times. Moreover, if the object of theft prevention with the theft preventing apparatus being attached thereto is unlawfully carried to the vicinity of the predetermined site such as an entrance/exit of a shop, the radio wave transmitted from the transmitter installed at the predetermined site is received by the antenna disposed inside the box, so that the alarm output means outputs the alarm information based on the reception signal from the antenna.

As a result, there has been achieved a theft preventive apparatus in which the retaining means for retaining the alarm output means at the operative state can provide the retaining function reliably while the entire apparatus being formed compact.

As further construction of the present invention, the releasing tool includes a conductive portion and the retention releasing instructing switch is comprised of a pair of electric contact portions to be operated into a conductive state in association with contact with the conductive portion of the releasing tool.

According to this construction, with insertion of the releasing tool into the insertion hole, the conductive portion provided to the releasing tool comes into contact with the pair of electric contacts constituting the retention releasing instructing switch to release the retained state of the alarm operation.

As a result, since the retention released state, i.e. the inoperative state of the alarm output means is realized by being rendered electrically conductive via the conductive portion of the releasing tool, there has been achieved the effect of retention release being disabled when a non-conductive element such as a resin or wooden element that can be readily molded is used as a fake operating tool and of the alarm operation being inhibited from being released by such unlawful operation.

According to still further construction of the present invention, a non-conductive partitioning portion is provided between the respective electric contact portions with the partitioning portion projecting from a contact face of the respective electric contact portions; and the releasing tool defines a concave portion which comes into engagement with the partitioning portion while allowing contact of the conductive portion with the respective electric contact portion.

With this construction, with the insertion of the authorized releasing tool into the insertion hole, the concave portion defined in the releasing tool comes into engagement with the partitioning portion provided between the respective electric contact portions with the partitioning portion projecting therefrom, the conductive portion is allowed to be inserted to contact the respective electric contact portion.

And, as the partitioning portion is provided in the projecting state between the respective electric contact portions, the respective electric contact portion cannot be readily rendered into the conductive state when a flat metal element or the like is inserted.

As a result, when the authorized releasing tool is inserted, the retention released state may be readily realized. Whereas, when an attempt is made to unlawfully realize the retention released state by inserting a metal plate or the like, the released state cannot be realized, and theft by such unlawful act may be prevented.

According to still further construction of the present invention, the preliminary act detecting means includes an attachment tool to be connected with the box for attaching the box to the object of theft prevention and an attachment/detachment detecting switch for electrically detecting attachment and detachment of this attachment tool to and from the box; and the alarm output means outputs the alarm information based on a detachment detection signal from the attachment/detachment detecting switch.

With this construction, when the attachment tool is attached to the box for attaching the box to the object of theft prevention, this attachment is electrically detected by the attachment/detachment detecting switch and the attachment/detachment detecting switch outputs an attachment detection signal. And, the electric retaining circuit is set to the retaining state based on the attachment detection signal.

Whereas, when the attachment tool is unlawfully detached from the box, the alarm output means outputs the alarm information based on a detachment detection signal from the attachment/detachment detecting switch.

As a result, the attachment/detachment detecting switch constituting the preliminary act detecting means is used also as the instructing means for instructing the retaining means to be activated into the retaining state. Then, there has been achieved the effect of eliminating any special instructing means for instructing the activation into the retaining state and eliminating also any special operation for the activation.

According to still further construction of the present invention, there is provided lock means for locking the attachment tool under its attached state to the box; and the lock means is operated into a lock-releasing state by the releasing tool inserted into the insertion hole.

With this construction, since the attachment tool is locked by the lock means under its state attached to the box, there occurs no such inconvenience of the attached state being inadvertently released by vibration or the like to allow the alarm output means to output the alarm information. Also, when the attachment tool is to be lawfully detached, by inserting the releasing tool into the insertion hole, the alarm releasing means is operated into the alarm releasing state, and under this condition the locked state of the attachment tool may be released.

As a result, there occurs no such inconvenience as the theft preventive apparatus being readily detached from the object of theft prevention. And, as the releasing tool for operating the alarm releasing means into the alarm releasing state acts also as the lock releasing tool, no special lock releasing means is needed.

Still alternatively, the theft preventive apparatus according to the present invention may be constructed as follows.

Namely, there is provided a wire unit for attaching the box to the object of theft prevention;

this wire unit includes a pair of connecting portions to be connected by being inserted into an insertion hole of the box for wire unit connection and an intermediate connecting portion for interconnecting these connecting portions;

inside the box there are provided;

a pair of lock means for locking the connecting portions under inserted state inserted into the insertion hole for the wire unit connection, lock releasing means switchable between a first releasing state for releasing one of the pair of lock means and a second releasing state for releasing both of the lock means;

the bar-like releasing tool which can be inserted into the insertion hole for the releasing operation for operating the lock means in association with the insertion thereof to the inside of the box operates to provide the first releasing state in association with insertion by a first insertion amount and to provide the second releasing state in association with insertion by a second insertion amount.

Still further, the releasing tool may include a contact portion for contacting the outer face of the box, an insertion portion projecting from the contact portion to be inserted into the insertion hole for the releasing operation, and a projection amount adjusting portion for variably adjusting the amount of projection of the insertion portion from the contact portion.

With the adjustment of the projection amount adjusting portion, the projection amount of the insertion portion from the contact portion may be adjusted, whereby the insertion amount to the inside of the box may be set to the first insertion amount or the second insertion amount. Then, selection is possible between detachment of only one of the pair of contact portions of the wire unit and the detachment of both of the pair of contact portions at one time.

Incidentally, if the frequency of detaching only one of the pair of contact portions of the wire unit is compared with the frequency of detaching both of the pair of contact portions at one time, the frequency of detaching only one of the pair of contact portions is higher.

That is to say, in general, for the attachment and detachment to and from the object of theft prevention, only one of the pair of contact portions is detached.

Accordingly, normally, the projection amount of the insertion portion from the contact portion is adjusted to the first insertion amount suitable for detection of only one of the pair of contact portions of the wire unit, and the releasing tool is kept used under this condition. With this, the pair of contact portions are not detached at one time erroneously.

And, for detaching the pair of connecting portions of the wire unit at one time, the projection amount of the insertion portion of the contact portion is adjusted to value corresponding to the second insertion amount, and then the releasing tool is used.

In short, the setting of the releasing tool to the first insertion amount and the second insertion amount can be effected by variably adjusting the projection amount of the insertion portion from the contact portion. And, normally, as the releasing tool may be kept used under the condition where the projection amount of the insertion portion from the contact portion is adjusted to a value corresponding to the first insertion amount, the pair of contact portions will not be detached at one time by mistake.

That is, in comparison between the frequency of detaching only one of the pair of contact portions of the wire unit and the frequency of detaching the pair of contact portions at one time, the frequency of detaching only one of the pair of contact portions is higher. Then, in consideration of this fact, by allowing the setting of the releasing tool to the first insertion amount and the second insertion amount to be effected by the variable adjustment of the projection amount of the insertion portion from the contact portion, so that the pair of contact portions will not be detached at one time under the normal condition. As a result, the inconvenience of the conventional construction using simply a pair of insertion portions differing in length, i.e. the inconvenience that with erroneous selection of the insertion portion the longer insertion portion is inserted to the inside of the box to inadvertently detach both contact portions of the wire unit at one time in spite of real intention of detaching one of the pair of contact portions, has been eliminated, and the apparatus may be used more conveniently.

According to still further construction of the present invention, the releasing tool includes a hand-held body portion co-extensively forming the insertion portion, a cylindrical portion supported to be movable in the longitudinal direction of the insertion portion relative to the body portion while covering the insertion portion and having a leading end which constitutes the contact portion, an urging tool for urging the cylindrical portion towards the leading end of the insertion portion, and a restricting tool for restricting a limit of retraction of the cylindrical portion towards the body portion. And, the projection amount adjusting portion variably adjusts a restricting position of the restricting tool in the moving direction of the cylindrical portion.

With this construction, by moving the body portion into the box while hand-holding the body portion of the releasing tool to bring the leading end of the cylindrical portion whose leading end constitutes the contact portion into contact with the outer face of the box, the insertion portion is inserted into the box, and also the projection amount of this insertion portion from the contact portion, i.e. the insertion amount of the insertion portion into the box is set by restricting the retraction limit of the cylindrical portion towards the body portion by means of the restricting too.

And, by variably adjusting the restricting position of the restricting tool in the moving direction of the cylindrical portion, the insertion amount of the insertion portion into the box is set to the first insertion amount or second insertion amount.

With the releasing tool having such construction, the insertion portion may normally be covered by the cylindrical portion. Then, by this covering function of the cylindrical portion, it is possible to avoid such trouble as breakage of the insertion portion.

As a result, by covering the insertion portion by the cylindrical portion when the releasing tool is not in use, the covering function of the cylindrical portion serves to avoid the trouble such as breakage of the insertion portion. Hence, it may be used conveniently for an extended period of time.

Still further, the construction of the present invention may be as follows.

Namely, a rotary operating portion is threadably movable relative to the body portion in the longitudinal direction of the insertion portion;

the restricting tool is provided to be movable relative to the body portion in the longitudinal direction of the insertion portion and also to be urged in a direction away from the insertion portion;

the rotary operating portion includes a restricting portion for restricting limit of movement relative to the body portion in the direction toward the leading end of the insertion portion in association with contact with the body portion;

the rotary operating portion includes a first receiving portion for receiving the restricting tool at the restriction position for the first releasing state when the restricting portion is in contact with the body portion;

the rotary operating portion includes a second receiving portion for receiving the restricting tool at the restricting position for the second releasing state when the restricting portion is moved away from the body portion by an amount greater than a predetermined amount; and the projection amount adjusting portion effects the variable adjustment of the restricting position of the restricting tool in association with a forward or reverse rotary operation of the rotary operating portion relative to the body portion.

With this construction, as for the inserting operation of the insertion portion into the box, this may be done in the same manner as the construction of the present invention described hereinbefore. Also, the adjustment of the projection amount adjusting portion, i.e. the adjustment of the insertion amount of the inserting portion into the box may be effected by forwardly or reversely rotating the rotary operating portion relative to the body portion.

To describe further, by rotationally operating and threadably moving the rotary operating portion relative to the body portion so as to bring the restriction portion of the rotary operating portion into contact with the body portion, then, the first receiving portion provided to the rotary operating portion receives the restricting tool urged in the direction away from the insertion portion at the restricting position for the first releasing state. As a result, the insertion amount of the insertion portion into the box is adjusted to the first insertion amount.

Conversely, by rotationally operating and threadably moving the rotary operating portion relative to the body portion so as to move the restriction portion of the rotary operating portion away from the body portion by an amount exceeding the predetermined amount, then, the second receiving portion provided to the rotary operating portion receives the restricting tool urged in the direction away from the insertion portion at the restricting position for the second releasing state. As a result, the insertion amount of the insertion portion into the box is adjusted to the second insertion amount.

In short, the adjustment of the insertion amount of the insertion portion can be effected readily by the easy operation of forwardly or reversely rotationally operating the rotary operating portion relative to the body portion. Moreover, the adjustment condition of the insertion amount of the inserting portion can be readily recognized by whether the restricting portion provided to the rotary operating portion is in contact with the body portion or not.

As a result, the adjustment of the insertion amount of the insertion portion may be effected by the easy operation of forwardly or reversely rotationally operating the rotary operating portion relative to the body portion. In addition, the adjustment condition of the insertion amount of the inserting portion can be readily recognized by whether the restricting portion provided to the rotary operating portion is in contact with the body portion or not. Hence, it becomes possible to minimize the erroneous operation of operating the lock releasing means into the first releasing condition when the insertion amount of the inserting portion to the second insertion amount.

According to still further construction of the present invention, the restricting portion provided to the body portion for restricting the limit of movement of the cylindrical portion toward the leading end of the insertion portion restricts the leading end of the insertion portion to a position exposed from the cylindrical portion.

That is to say, if the entire insertion portion were covered by the cylindrical portion, i.e. if the leading end of the insertion portion too were covered by the cylindrical portion, it would become difficult to fix the insertion portion in position relative to the insertion hole when the insertion portion is to be inserted into the insertion hole. Yet, according to the fourth characterizing feature of the invention, by utilizing the exposed insertion portion leading end, it becomes possible to appropriately fix the insertion portion in position relative to the insertion hole. Then, the inserting operation of the insertion portion into the insertion hole can be effected easily.

According to still further construction of the present invention, inside the box, there is provided alarm releasing means for stopping the operation of the alarm output means; and the alarm releasing means is operated into an alarm releasing state by means of the releasing tool inserted into the insertion hole for the release operation.

With this construction, in association with insertion of the releasing tool into the insertion hole for the releasing operation, the alarm releasing means provided inside the box is operated into the alarm releasing state to stop the operation of the alarm output means.

That is to say, when the wire unit is to be detached from the box by using the releasing tool, it is necessary to stop the operation of the alarm output means in order to stop unnecessary alarm. Then, according to this fourth characterizing feature, when the wire unit is detached from the box by using the releasing tool, the operation of the alarm output means too is stopped by the releasing tool.

As a result, since the operation of the alarm output means too may be stopped by the releasing tool when the wire unit is detached from the box by using the releasing tool, the detachment of the wire unit from the box and the stop of the operation of the alarm output means which becomes necessary at that time may be effected at one time. Hence, with the improvement of the operability, the apparatus may be used even more conveniently.

According to still further construction of the present invention, the pair of connecting portions and the intermediate connecting portion have electric conductivity; and the preliminary act detecting means detects the preliminary stealing act based on change of a conductive path formed when the connecting portions are connected to the box into a non-conductive state.

With this construction, the pair of connecting portion and the intermediate connecting portion constituting the wire unit have electric conductivity, and the preliminary act detecting means detects the preliminary stealing act based on change of a conductive path formed when the pair of connecting portions are connected with the box into a non-conductive state.

That is to say, the preliminary stealing act may be detected by utilizing the wire unit. Moreover, detachment of the connecting portions from the box and cutting of the intermediate connecting portion too are detected as a preliminary stealing act. As a result, since the preliminary stealing act can be detected by utilizing the wire unit and also detachment of the connecting portions from the box and cutting of the intermediate portion can be detected as a preliminary stealing act. Then, the preliminary stealing act can be detected while simplifying the construction by using a single component for multiple of purposes.

According to still further construction of the present invention, the preliminary act detecting means includes an antenna disposed inside the box for receiving radio wave from a transmitter installed at a predetermined site, and the detecting means detects a preliminary stealing act as the antenna receives the radio wave from the transmitter.

With the above construction, if the transmitter is installed at a predetermined site such as an entrance/exit of a shop, if an attempt is made to take out the object of theft prevention with the box attached thereto past the predetermined site, the radio wave from the transmitter is received by the antenna, and in association therewith the preliminary act detecting means detects this as a preliminary stealing act.

That is to say, the preliminary stealing act includes also an unlawful take-out in addition to the unlawful detachment of the wire unit described in connection with the fifth characterizing feature. And, such unlawful take-out too can be appropriately detected.

As a result, as a preliminary stealing act, in addition to unlawful detachment of the wire unit, unlawful take-out too can be detected appropriately. Hence, the detection of the preliminary stealing act too has been improved.

Still further, according to the present invention, the releasing tool may be formed in a predetermined shape, and inside the insertion hole, there may be provided insertion preventing means for preventing insertion into the insertion hole of a fake operating tool having a shape other than the predetermined shape while allowing insertion into the insertion hole of the releasing tool having this predetermined shape.

With this construction, if an attempt is made to insert a fake operating tool having a shape other than the predetermined shape into the insertion hole defined in the box of the theft preventive apparatus, the insertion preventing means provided inside the insertion hole prevents the insertion of this fake operating tool, giving no effect on the operation of the alarm releasing means.

On the other hand, when the releasing tool is inserted into the insertion hole, the insertion preventing means allows the insertion of the releasing tool, and the alarm releasing means is operated into the alarm releasing state to render the alarm output means inoperative.

As a result, if an attempt is made to insert a fake operating tool having a shape other than the predetermined shape into the insertion hole defined in the box of the theft preventive apparatus, the insertion preventing means provided inside the insertion hole prevents the insertion of this fake operating tool. Then, it is possible to quickly prevent the alarm preventive apparatus from being unlawfully rendered inoperative.

Still further, the insertion preventing means may be comprised of a projection which projects from an inner wall portion of the insertion hole into the inner space thereof as viewed in a longitudinal direction of the insertion hole, and the releasing tool may define, in an outer face portion thereof, a concave groove into which the projection fits when the tool is inserted into the insertion hole.

With this construction, because of the projection projecting from the inner wall portion of the insertion hole into the inner space of the hole, if an attempt is made to insert into the insertion hole any fake operating tool having a shape other than the predetermined shape, the insertion is prevented by the projection, giving no effect on the operation of the alarm releasing means.

On the other hand, in the case of inserting the releasing tool into the insertion hole, since the releasing tool defines in the outer face thereof the concave groove in which the projection can fit, the projection fits into the concave groove thereby to allow the releasing tool to be inserted into the insertion hole. Then, the alarm releasing means is operated into the alarm releasing state to render the alarm output means inoperative.

That is to say, by simply providing the projection in the inner wall of the insertion hole and forming, in the outer face of the releasing tool, the concave groove in which the projection can fit, insertion of a fake operating tool into the insertion hole may be prevented.

As a result, by the simple construction of providing the projection in the inner wall of the insertion hole and forming, in the outer face of the releasing tool, the concave groove in which the projection can fit, the effect by the first characterizing feature described hereinbefore can be achieved.

Still alternatively, the projection may be formed at a further inside portion than the entrance opening of the insertion hole.

With this construction, since the projection is formed at a further inside portion than the entrance opening of the insertion hole, it is not easy to observe the shape of the projection from the entrance opening of the insertion hole, thus making it difficult to fabricate unlawfully a copy of the releasing tool.

As a result, since it becomes possible to make it difficult to fabricate unlawfully a copy of the releasing tool, it is possible to prevent more effectively the theft preventive apparatus from being rendered inoperative unlawfully.

Still alternatively, a plurality of the projections may be formed at different phases as viewed in the longitudinal direction of the insertion hole.

With this construction, the projections at the insertion hole are provided in a plurality and these projections are formed at different phases as viewed in the longitudinal direction of the insertion hole, that is, they are formed at different phases relative to a virtual circle, provided various positions along the inner wall of the insertion hole as viewed in the longitudinal direction thereof are expressed with reference to the virtual circle centering about the center of the insertion hole as viewed in the longitudinal direction of the insertion hole. Then, this prevents one projection from being concealed by another projection when viewed in the longitudinal direction of the insertion hole. Then, each of the plurality of projections can serve to effectively prevent insertion of a fake operating tool.

As a result, since each of the plurality of projections formed at the insertion hole of the box of the theft preventive apparatus can serve to effectively prevent insertion of a fake operating tool, it is possible to more effectively prevent the theft preventive apparatus from being rendered inoperative unlawfully.

Still alternatively, the plurality of projections may be formed at different longitudinal positions of the insertion hole.

With this construction, since the plurality of projections are formed at different longitudinal positions, there are formed differences in the lengths of the concave grooves formed in the outer face of the releasing tool for allowing engagement of the plurality of projections. As a result, there exist also thick portions and thin portions in the thickness of the releasing tool.

As a result, since thick portions and thin portions exist in the thickness of the releasing tool, then, in comparison with a case in which the plurality of projections are aligned at a same longitudinal position and the thickness of the releasing tool becomes uniformly thin because of forming the concave grooves for allowing engagement of these projections, the strength of the releasing tool may be increased.

Still alternatively, the projection may be provided in the form of a projecting ridge extending along the longitudinal direction of the insertion hole.

With this construction, since the projection of the insertion hole is provided in the form of a projecting ridge extending along the longitudinal direction of the insertion hole, this makes the length of engagement of the projection of the insertion hole into the concave groove of the releasing tool when the releasing tool is inserted into the insertion hole. Whereby the projection can maintain the posture of the releasing tool stably.

As a result, since the posture of the releasing tool may be maintained stably by the projection formed at the insertion hole of the box of the theft preventive apparatus, the releasing tool may be readily inserted into the insertion hole, and the theft preventive apparatus becomes easier to handle.

According to still further construction of the theft preventive apparatus of the present invention, inside the box, there are provided a battery for driving the preliminary act detecting means and the alarm output means; and auxiliary power supplying means charged by the battery and driving the preliminary act detecting means and the alarm output means when power supply from the battery is cut off.

The auxiliary power supplying means stores electric power by being charged by the battery. Then, the power supply to the preliminary act detecting means and the alarm output means from the battery should be cut off by the positive or negative terminal of the battery is instantaneously detached from the connecting terminals with application of physical impact or vibration to the box, the auxiliary power supplying means, instead of the battery, continuously supplies electric power to the preliminary act detecting means and the alarm output means. Hence, the power supply to the preliminary act detecting means and the alarm output means is not interrupted.

With this construction, even if physical impact or vibration is applied to the box, the electric power may be continuously supplied to the preliminary act detecting means and the alarm output means, thus preventing the alarm output means from becoming inoperative.

Still alternatively, the alarm output means may continuously output the alarm information even if the preliminary act detecting means makes no detection of preliminary stealing act, after the alarm output means has outputted the alarm information based on preliminary stealing act detection information of the preliminary act detecting means.

With output of the alarm information, even if the one who has committed the preliminary stealing act renders the preliminary act detecting means inoperative for detecting a preliminary stealing act, the alarm information is continuously outputted from the alarm output means. Needless to say, since the auxiliary power supplying means is provided, the alarm information will be outputted continuously even if the power supply from the battery is cut off instantaneously.

As a result, even if the one who has committed the preliminary stealing act disables detection of preliminary stealing act or if the power supply from the battery is cut off instantaneously, the alarm information is continuously outputted. Hence, the reliability has been further improved.

Still alternatively, the preliminary act detecting means may include an attachment tool to be connected with the box for attaching the box to the object of theft prevention, and an attachment/detachment detecting switch for electrically detecting attachment and detachment of the attachment tool to and from the box, and the alarm output means may output the alarm information based on an attachment/detachment signal from the attachment/detachment detecting switch as the preliminary act detection information.

If a preliminary stealing act is committed of detaching the attachment tool from the box in order to unlawfully detach the box from the object of theft prevention, the attachment/detachment detecting switch electrically detects this detachment of the attachment tool from the box. That is, based on the detection by the attachment/detachment detecting switch of detachment of the attachment tool from the box, the preliminary stealing act information is detected. And, based on the detachment detection information from the attachment/detachment detecting switch, the alarm means outputs the alarm information.

As a result, since the alarm information is outputted when a preliminary stealing act has been committed of unlawfully detaching the box of the theft preventive apparatus from the object of theft prevention, theft may be prevented.

Still further, the theft preventive apparatus of the present invention may further comprise checking means for allowing the alarm output means to output the alarm information only when the preliminary stealing act detection information outputted from the preliminary act detecting means continues to exist beyond a predetermined time period.

With this construction, when the preliminary stealing act detection information outputted from the preliminary act detecting means continues to exist beyond a predetermined time period, the alarm output means outputs the alarm information. Yet, in case the preliminary stealing act detection information continues shorter than the predetermined period of time when, for example, the preliminary act detecting means makes output due to various disturbances, the alarm information is not outputted.

As a result, it is possible to prevent a false alarm from being given when no preliminary stealing act has been actually committed due to various disturbances or the like. Then, the operational reliability of the theft preventive apparatus may be improved.

Still further, the preliminary act detecting means may include an attachment tool to be connected to the box for attaching the box to the object of theft prevention and an attachment/detachment detecting switch for electrically detecting attachment and detachment of the attachment tool to and from box, and the alarm output means may output the alarm information based on a detachment detection signal from the attachment/detachment detecting switch as the preliminary stealing act detection information.

With this construction, when the attachment tool such as a wire connected with the box for attaching the box to the object of theft prevention is detached from the box by being disconnected or cut off from the connecting portions, the attachment/detachment detecting switch detects this detachment of the attachment tool from the box as a preliminary stealing act. And, if this detachment detection signal continues beyond the predetermined time period, the alarm output means outputs the alarm information. Whereas, if the detachment detection signal continues shorter than the predetermined time period when, for example, the contact of the attachment/detachment detecting switch is disconnected for a short period of time due to e.g. application of slight shock or vibration to the box, no alarm information is outputted.

As a result, in the theft preventive apparatus with which the box is attached to the object of theft prevention by means of an attachment tool and a preliminary stealing act is detected as detachment of the attachment tool from the box, no erroneous alarm as a preliminary stealing act is given due to the disturbances.

According to still further construction of the present invention, the apparatus further comprises an attachment tool having, at opposed ends thereof conductive connecting portions to be connected by being inserted into the insertion hole of the box for connection with the attachment tool and having also a conductive intermediate connecting portion for electrically interconnecting the connecting portions at the opposed ends. Engaged portions are provided at the opposed connecting portions. And, inside the box, there are provided engaging members which can engage with the engaged portions at the connecting portions inserted into the insertion hole for connection with the attachment tool and which are urged toward the engaging side; and alarm output means electrically connected with the opposed connecting portions when the opposed connecting portions are connected with the box and outputting the alarm information based on a conductive path formed by the electrical connection becoming nonconductive. And, withdrawal of the connecting portions inserted into the insertion hole is prevented by means of engagement between the engaged portions and the engaging members.

Still alternatively, inside the box, there may be provided a conductive spring which is contacted with and pressed against an end of the connecting portions inserted into the insertion hole for connection of the attachment tool, with the spring being connected by means of a receiving member electrically connected with the alarm output means.

With this construction, there is provided the conductive spring which is retracted further inside in the longitudinal direction of the insertion hole with the pressed contact with the inserting end of the connecting portion. So that, via the spring and the inserting end of the connecting portion which are contacted with each other due to the pressed contact along the inserting direction of the connecting portion, the connecting portions and the alarm output means are electrically connected with each other. Then, even if the inserted connecting portion is moved along the inserting direction relative to the box, there hardly occurs sliding movement at the contact portion between the inserting end of the connecting portion and the spring. Thus, the contact condition between the spring and the inserting end of the connecting portion is stable.

As a result, since the contact condition between the spring and the inserting end of the connecting portion is stable, the alarm output means will hardly be operated erroneously.

Still preferably, the spring comprise a coil spring.

With this, a large elastic displacement amount can be set while fitting the spring along the insertion hole in a compact manner. Even when the inserted connecting portion tends to move along the inserting direction relative to the box, it is easy to maintain the contact between the spring and the inserting end of the connecting portion for an extended period of time.

As a result, since it is easy to maintain the contact between the spring and the inserting end of the connecting portion for an extended period of time even when the inserted connecting portion tends to move along the inserting direction relative to the box, it is possible to prevent erroneous activation of the alarm output means still more reliably.

Still further, inside the box, there are provided alarm releasing means for rendering the alarm output means inoperative and engagement releasing means for operating the engaging member into an engagement-released state. An insertion hole for releasing operation is defined to extend from the outer face of the box toward the inside of the box. The alarm releasing means is operated into the alarm releasing state and the engagement releasing means is operated into an engagement releasing state by means of a releasing tool to be inserted into the insertion hole for releasing operation.

With the above construction, by inserting the releasing tool into the insertion hole for releasing operation, the alarm releasing means is operated into the alarm releasing state and also the engagement releasing means is operated into the engagement releasing state. Thus, lawful detachment of the theft preventive apparatus from the object of theft prevention may be effected easily.

As a result, since the lawful detachment of the theft preventive apparatus from the object of theft prevention can be effected easily, it is possible to facilitate the handling of the theft preventive apparatus having alarm output means highly resistant against erroneous activation.

Still further, the spring may be provided with an urging force which moves the connecting portion to the outside of the box in association with an operation of the engaging member toward the engagement releasing side.

With this construction, when the engagement between the engaged portion and the engaging member is released, the connecting portion inserted into the insertion hole is pushed to the outside of the box by means of the urging force of the spring. Hence, the connecting portion may be readily withdrawn from the insertion hole.

As a result, since the withdrawal of the connecting portion from the insertion hole is facilitated, it is possible to facilitate the handling of the theft preventive apparatus having alarm output means highly resistant against erroneous activation.

Still further, inside the box, there may be provided an antenna for receiving radio wave from a transmitter installed at a predetermined site, and the alarm output means may output the alarm information, based on a reception signal of the antenna.

With this construction, when an attempt is made to unlawfully take out the object of theft prevention with the theft preventive apparatus attached thereto, the alarm output means disposed inside the box outputs the alarm information, thereby alarming the unlawful take-out of the object of theft prevention. And, there is no need of separately providing alarm output means for this purpose.

As a result, since it is possible to alarm an unlawful take-out of the object of theft prevention with the theft preventive apparatus attached thereto without providing separate alarm output means, it is possible to simplify the construction of the theft preventive apparatus having alarm output means highly resistant against erroneous activation.

According to still further construction of the present invention, inside the box, there are provided a radio-wave receiving antenna having a coil, a buzzer having electric capacity, alarm output means for causing the buzzer to generate a sound when the receiving antenna receives a sound generation instructing radio wave, and radio-wave receiving signaling device forming a resonance circuit by being connected with the entire or part of the coil of the receiving antenna; and a transmitter for transmitting the sound generation instructing radio wave to the receiving antenna is installed at a predetermined site.

With this construction, by providing the radio wave receiving signaling device having the above-described characterizing construction inside the box, the sound volume of the buzzer may be increased and also it is possible to inhibit the circuit construction from becoming complicated.

As a result, since it is possible to increase the sound volume of the buzzer and also to inhibit the circuit construction from becoming complicated, the reception of the sound generation instructing radio wave from the transmitter may be reliably signaled by increasing the sound volume of the buzzer while inhibiting the construction of the theft preventive apparatus from becoming complicated and the box from being enlarged.

Still further, the alarm output means according to the present invention may be constructed so as to cause the buzzer to generate a sound in association with detection of preliminary act by the preliminary act detecting means.

With this construction, the buzzer is activated to generate the sound also when the preliminary act detecting means detects detachment of the box of the theft preventive apparatus from the object of theft prevention.

As a result, although theft cannot be prevented merely by activating the buzzer for generating a sound with reception of the sound generation instructing radio wave from the transmitter, if e.g. the box of the theft preventive apparatus is detached from the object of theft prevention and then this object is taken out past the site where the transmitter is installed. However, since detachment of the box of the theft preventive apparatus also is detected and signaled by the buzzer, theft can be effectively prevented.

According to still further construction of the theft preventive apparatus of the present invention, inside the box, there is provided alarm releasing means for rendering the alarm output means inoperative; an insertion hole for releasing operation is defined to extend from the outer face of the box to the inside of the box; and the alarm releasing means is operated into a sound generation released state by means of a releasing tool to be inserted into the insertion hole for releasing operation.

When the object of theft prevention is lawfully purchased for instance, it is necessary to prevent the buzzer from generating a sound when the box of the theft preventive apparatus is detached from the object of theft prevention. Then, with the above construction, by inserting the releasing too into the insertion hole defined in the box of the theft preventive apparatus, the alarm output means of the radio wave receiving signaling device is operated into the sound generation released state.

As a result, by the simple operation of merely inserting the releasing tool into the insertion hole defined in the box of the theft preventive apparatus, the alarm output means of the radio wave receiving signaling device may be operated into the sound generation released state. Also, the alarm output means of the radio wave receiving signaling device cannot be operated into the sound generation released state without the releasing tool. Hence, unlawful releasing operation may be prevented.

Still alternatively, the theft preventive apparatus according to the present invention may be constructed as follows.

Namely, the alarm output means disposed inside the box includes alarm information output means for outputting alarm information, and alarm controlling means for activating the alarm information output means into an alarm information outputting state; and the electric retaining circuit includes electric switching means which is set to the retaining state by being switched over to a conductive state in response to an activating signal associated with an ON-operation of the activating switch; and there is provided noise preventing means for preventing a noise signal acting as the activating signal from being provided to an activation instructing unit of the switching means to which the activating signal is provided.

With this construction, when the activating switch is not turned ON, for instance, when static electricity from an external object is provided as a noise signal through a reset switch or when a noise signal is generated by the piezoelectric effect due to mechanical impact in case a piezoelectric element is used as the alarm output means, such noise signal can be prevented from being provided to the activation instructing unit of the switching means by the noise preventing means. Thus, the switching means will not be switched over to the conductive state erroneously.

Accordingly, even if the noise signal as described above is generated, the alarm controlling means will not be set to the alarm activating state, and the alarm output means will not output the alarm information in spite of the user's intention.

As a result, it becomes possible to prevent such inconvenience as the alarm information being erroneously outputted due to e.g. a noise signal attributable to static electricity or piezoelectric effect in case the activating switch is not turned ON, e.g. when the apparatus is not attached to the object of theft prevention.

According to still further construction of the present invention, a detecting portion of the alarm controlling means for detecting a preliminary act and the activating switch are connected via a connecting line; and a preliminary stealing act is detected also when the activating switch is turned OFF.

With this construction, aside from the detection information by the preliminary act detecting means, in case the activating switch is turned OFF also, this is detected by the detecting portion for preliminary act detection of the alarm controlling means which portion is connected via the connecting line with the activation switch, so that alarm information is outputted.

Incidentally, once the activating switch has been turned ON, the switching means maintains the power retaining state. So, after the activating switch is turned OFF, this retaining state is maintained.

As a result, after the activating switch was turned ON, if the activating is turned OFF due to e.g. a preliminary stealing act, alarm information may be outputted effectively.

According to still further construction of the present invention, when opposed ends of a conductive wire for retaining the box to the object of theft prevention are connected with connecting terminals of the box, the activating switch is turned ON by using the wire as a conductive path.

With this construction, when the opposed ends of the wire are connected with the terminals of the box with the box being retained to the object of theft prevention, then, in association with this connection of the wire, the activating switch is turned ON to be set to the power retaining state.

In case the activating switch is connected via the connecting line with the detecting portions for preliminary act detection of the alarm controlling means, even if this wire is cut by a preliminary stealing act, alarm information is outputted.

As a result, the member used for retaining the box to the object of theft prevention may be used also as the activating switch, so that the co-utilization of the member can simplify the construction. Also, even if such there occurs such inconvenience as dropping the box by mistake when attaching it to the object or touching, by hand, the alarm releasing means, thus applying static electricity thereto, alarm information will not be outputted erroneously.

Moreover, the construction may effectively output the alarm information in the case of a preliminary stealing act such as cutting of the wire.

According to still further construction of the present invention, the retaining means includes power retaining switching means for connecting and disconnecting a power supply line to the alarm controlling means, the switching means being rendered conductive in association with switchover of the switching means to the conductive state; and the connecting line and the supply line are electrically connected with each other.

With this construction, the power retaining switching means connects and disconnects the power supply line to the alarm controlling means. When this power retaining switching means is OFF, the power supply line is disconnected. Then, under this condition, if the activating switch is turned ON, substantially simultaneously therewith, the detecting portions for preliminary act detection connected with the activating switch are supplied with a predetermined voltage. If there is delay from the turning-ON of the activating switch to the change of the power retaining switching means to the conductive state, there will develop a predetermined potential difference between the potential of the detecting portion relative to the power supply line, so that at the timing of the switch-over of the power retaining switching means to the conductive state, the alarm controlling means may be rendered operative for preliminary act detection due to the potential difference.

However, if the connecting line and the supply line are electrically connected, development of such inadvertent potential difference may be avoided, whereby alarm information will not be outputted erroneously.

As a result, while the construction can effectively output alarm information in the case of a preliminary stealing act such as cutting of the wire constituting the activating switch, at the preliminary act detecting portion connected with the activating switch, erroneous detection under the transition state at the time of activation may be effectively prevented.

According to still further construction of the present invention, the connecting line and the supply line may be connected with each other under zero electric resistance condition.

With this construction, since the connecting line and the supply line are connected with each other under zero electric resistance condition, the above-described potential difference may be maintained substantially zero, so that erroneous operation may be reliably prevented.

As a result, it becomes possible to reliably prevent the above-described erroneous operation at the time of turning-ON of the activating switch.

Still alternatively, the switching means, according to the present invention, comprises a switching transistor, and the noise preventing means comprises a capacitor interconnecting a base terminal and an emitter terminal of the switching transistor.

With this construction, as the base terminal and the emitter terminal of the switching transistor are connected with each other via the capacitor, even if there is applied static electricity or voltage due to the piezoelectric effect as described above, the capacitor can absorb such potential difference, so that it becomes possible to prevent the switching transistor from being rendered conductive due to a potential difference developed between the base terminal and the emitter terminal.

As a result, since the construction uses a transistor as the switching means and a capacitor as the noise preventing means, this construction, though simple, may effectively avoid erroneous operation due to a noise signal.

According to a radio wave receiving signaling device for use with the theft preventive apparatus according to the present invention, the device comprises a radio wave receiving antenna having a coil, an electrically capacitive buzzer, and alarm output means for activating the buzzer to generate sound when the receiving antenna receives a sound generation instructing signal. And, the buzzer and the entire or part of the coil of the receiving antenna are connected to form a resonance circuit.

With this construction, as the electrically capacitive buzzer and the entire or part of the coil of the receiving antenna are connected to form a resonance circuit, it is possible to raise the potential to be applied to the buzzer by means of the resonance function of the electrically capacitive buzzer and the electrically inductive coil. As a result, the volume of the sound generated by the buzzer is increased.

As the coil originally provided for receiving the sound generation instructing radio wave is used also in the circuit construction for increasing the sound volume of the buzzer, it is possible to prevent the construction of the circuit for increasing the sound volume of the buzzer from becoming complicated.

With the above-described construction of the radio wave receiving signaling device, it is possible to increase the sound volume of the buzzer while restricting complexity of the circuit construction.

DESCRIPTION OF THE PREFERRED EMBODIMENTS

Next, embodiments of a theft preventing apparatus of the present invention will be described with reference to the accompanying drawings.

Figure 1:
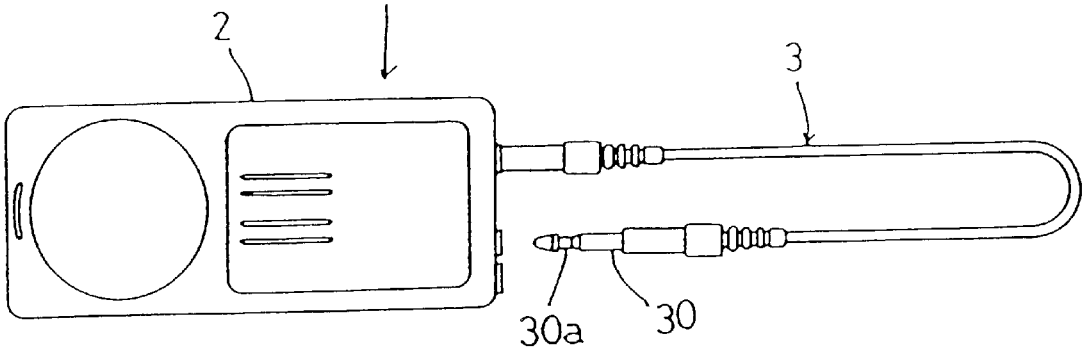
FIGS. 1(*a*), (*b*) are views showing outer appearances of a sensor tag relating to an embodiment of the present invention, in which (a) is a plan vie and (b) is a front view.
Figure 1:
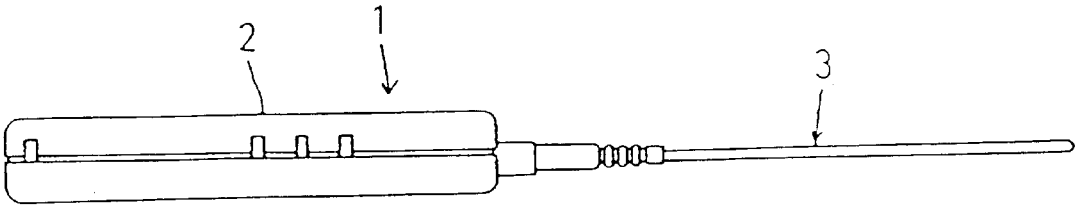

As shown in a plan view of FIG. 1(*a*) and a side view of FIG. 1(*b*), a sensor tag 1 as a theft preventive apparatus includes a rectangular box 2 and a wire unit 3 having a function as an attachment tool for attaching the box 2 to a commodity as an object of theft prevention.

Figure 6:
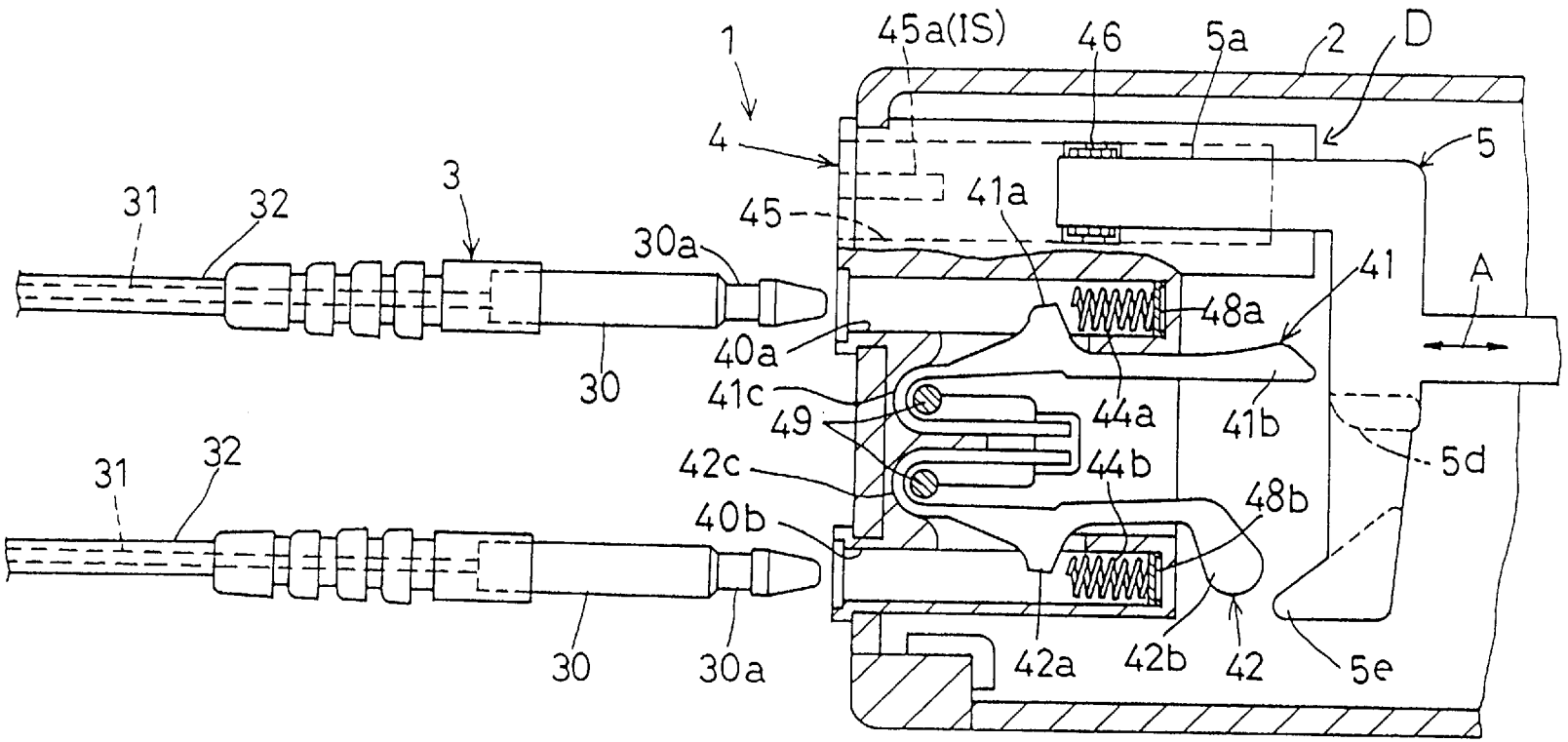
FIG. 6 is an enlarged partial cross sectional view of one end of the box of FIG. 1 with both lock pins of the wire unit removed from the lock pin insertion holes.

The wire unit 3, as shown in FIG. 6, includes lock pins 30 provided at opposed ends for inserting and withdrawing the box 2, wires 31 for respectively connecting the lock pins 30 and outer sheaths 32 for coating portions of the wires 31 and lock pins 30.

The lock pin 30 and wire 31 are made of metal thus having conductivity, and the lock pins 30 at the opposed ends are connected electrically also. Further, adjacent a leading end of each lock pin 30, there is formed an engaging concave portion 30*a* for preventing withdrawal of the lock pin 30 from the box 2.

Next, with reference to FIGS. 2 and 3, the construction of incorporating the above-described respective components within the box 2 and the electric connecting constructions among a piezoelectric buzzer 21, a battery V and a circuit board 6 will be described.

A bottom case 2*a* of the box 2 incorporates therein the circuit board 6, a jack unit 4, a connecting terminal 71*a* for positive connection with the battery V and the battery V. The connecting terminal 71*a* is fixedly attached to a boss 2*c* defined in the bottom case 2*a*.

A top case 2*b* incorporates therein a buzzer housing 72 accommodating the piezoelectric buzzer 21, the piezoelectric buzzer 21, a terminal portion 74 having two buzzer terminals 73*a*, 73*b* and a connecting terminal 71*b* for negative terminal connection with the battery V, and a slider 5. The connecting terminals 71*a*, 71*b* have returning urging forces.

Figure 4:
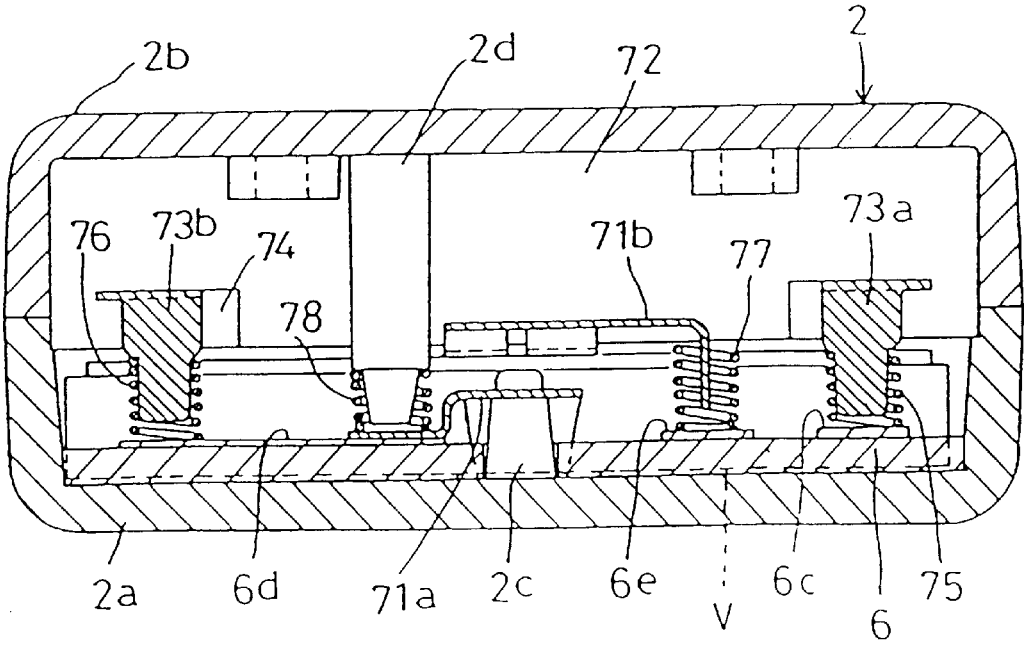
FIG. 4 is a vertical section view of the box relating to the embodiment of FIG. 1.

At circuit board connecting portions in the form of projections provided respectively at the buzzer terminals 73*a*, 73*b* and the connecting terminal 71*b*, coil springs 75, 76 and 77 having conductivity and returning urging force are outwardly fitted, and a coil spring 78 is outwardly fitted on a boss 2*d* formed in the top case 2*b*, so that the bottom case 7*a* and the top case 2*b* are combined with each other. Then, as shown in FIG. 4, the buzzer terminal 73*a* and a connecting electrode pad 6*c* correspondingly provided in the circuit board 6 are electrically connected with each other via the coil spring 75; the buzzer terminal 73*b* and an electrode pad 6*d* correspondingly provided in the circuit board 6 are electrically connected with each other via the coil spring 76; and also the connecting terminal 71*b* and an electrode pad 6*e* correspondingly provided in the circuit board 6 are electrically connected with each other via the coil spring 77. Further, a circuit board connecting portion of the connecting terminal 71*a* and the electrode pad 6*d* correspondingly provided in the circuit board 6 are contacted via the coil spring 78 to be electrically connected with each other. Also, the connecting terminal 71*a* and the connecting terminal 71*b* are brought into contact respectively with the positive terminal and negative terminal of the battery V to be electrically connected therewith. As a result, the piezoelectric buzzer 21, the battery V and the circuit board 6 are electrically connected respectively with each other.

As described above, the constructions for incorporating the respective components within the box 2 and the constructions connecting the piezoelectric buzzer 21, the battery V and the circuit board 6 are provided as electric connecting constructions, the incorporating and connecting operations can be simple without such troublesome operations as welding. Moreover, the returning urging forces provided by the respective coil springs can provide reliable electric connections.

Figure 7:
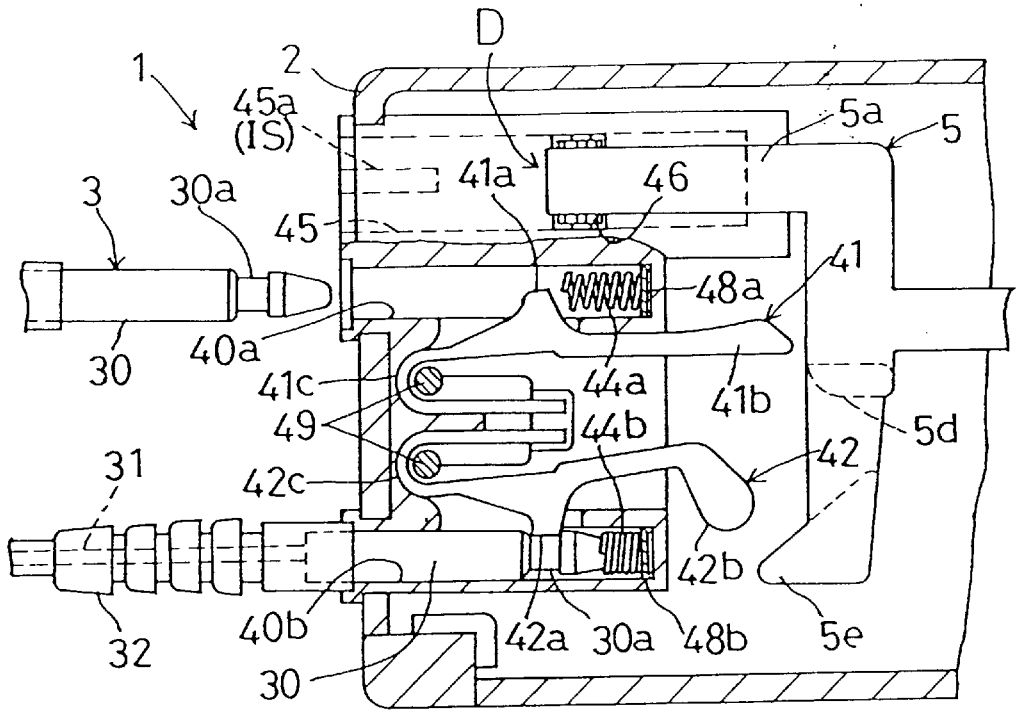
FIG. 7 is a view similar to that of FIG. 6, but showing one of the lock pins engaged within one of the lock pin insertion holes.

As shown in FIG. 7 and other figures, the terminal end of the outer sheath 32 covering the lock pin 30 is constructed, such that the lock pin 30 will be disposed within the box 2 so as not to be exposed to the outside when the lock pin 30 is inserted into the box 2. With this, it is possible to prevent the lock pin 30 from contacting an electrostatically charged object thus damaging the electric circuit inside the box 2.

Figure 5:
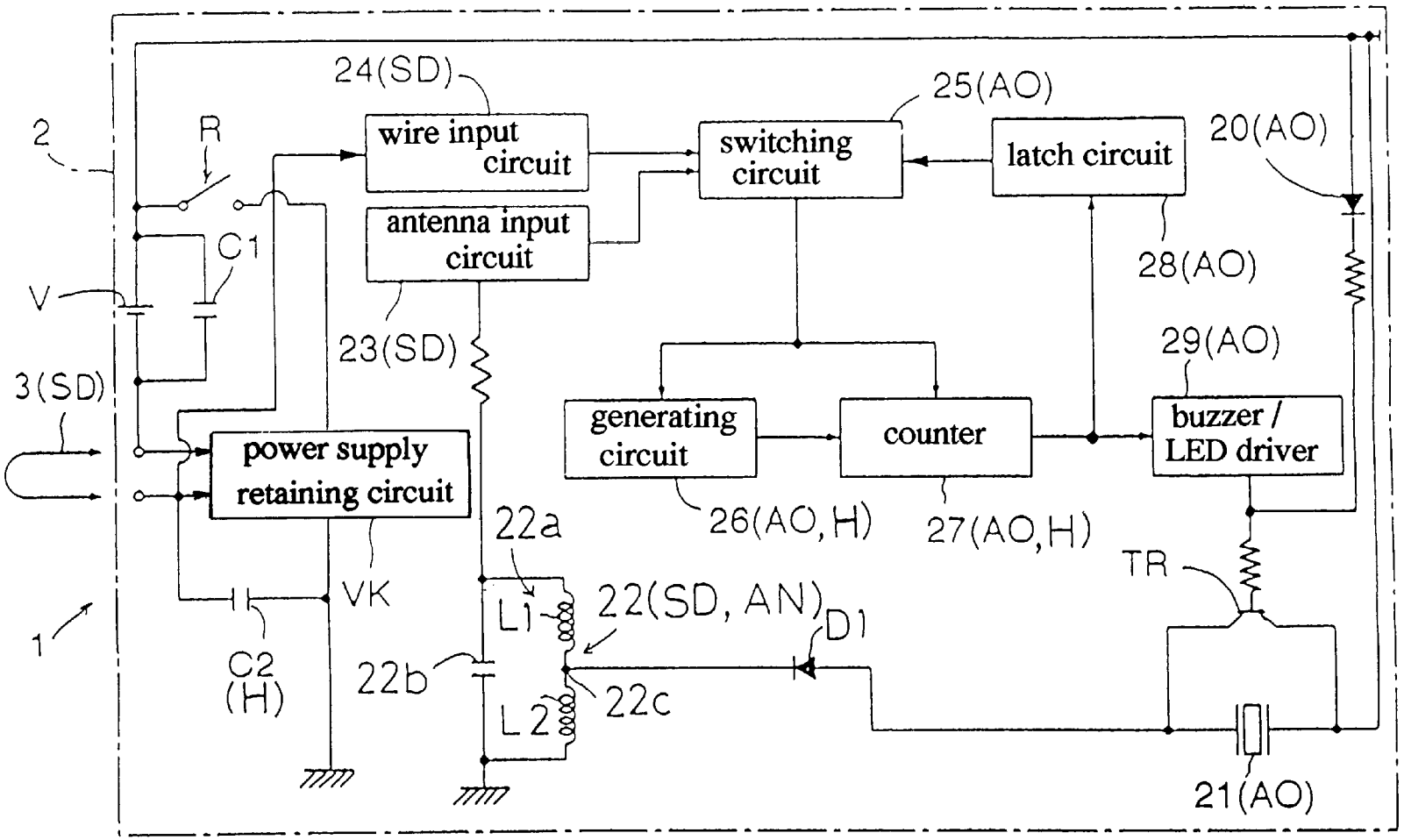
FIG. 5 is a circuit construction diagram of the sensor tag of FIG. 1.

Inside the box 2, as shown in FIG. 5, there are provided an LED lamp 20, the piezoelectric buzzer 21, a resonance antenna 22 including a coil 22*a* and a capacitor 22*b*, an antenna input circuit 23 for outputting a reception signal when the resonance antenna 22 becomes a receiving state, a wire input circuit 24 for outputting a wire cut signal when the wire unit 3 is not connected properly, a switching circuit 25 for outputting a control signal when receiving a reception signal from the antenna input circuit 23 or a wire cut signal from the wire input circuit 24, a generating circuit 26 starting pulse generation in response to input of a control signal from the switching circuit 25, a counter 27 for starting count of the number of pulses generated by the generating circuit 26 in response to input of the control signal from the switching circuit 25 and outputting a count completion signal when the counted number exceeds a predetermined count number, a latch circuit 28 for retaining the switching circuit 25 at the state at the time of input of the reception signal or wire cut signal in response to input of the count completion signal from the counter 27, a buzzer/LED driver 29 for illuminating the LED lamp 20 and sounding the piezoelectric buzzer 21 in response to input of the count completion signal from the counter 27, the battery V for supplying power to the respective circuits in the box 2, and a power supply retaining circuit VK as an electric retaining circuit constituting a retaining means operable to initiate power supply from the battery V to the respective circuits by connecting the negative terminal with the ground terminals of the respective circuits in association with insertion of the wire unit 3 into the box 1 and then retaining the power supply unless a reset switch R is closed once the power supply is initiated.

Figure 22:
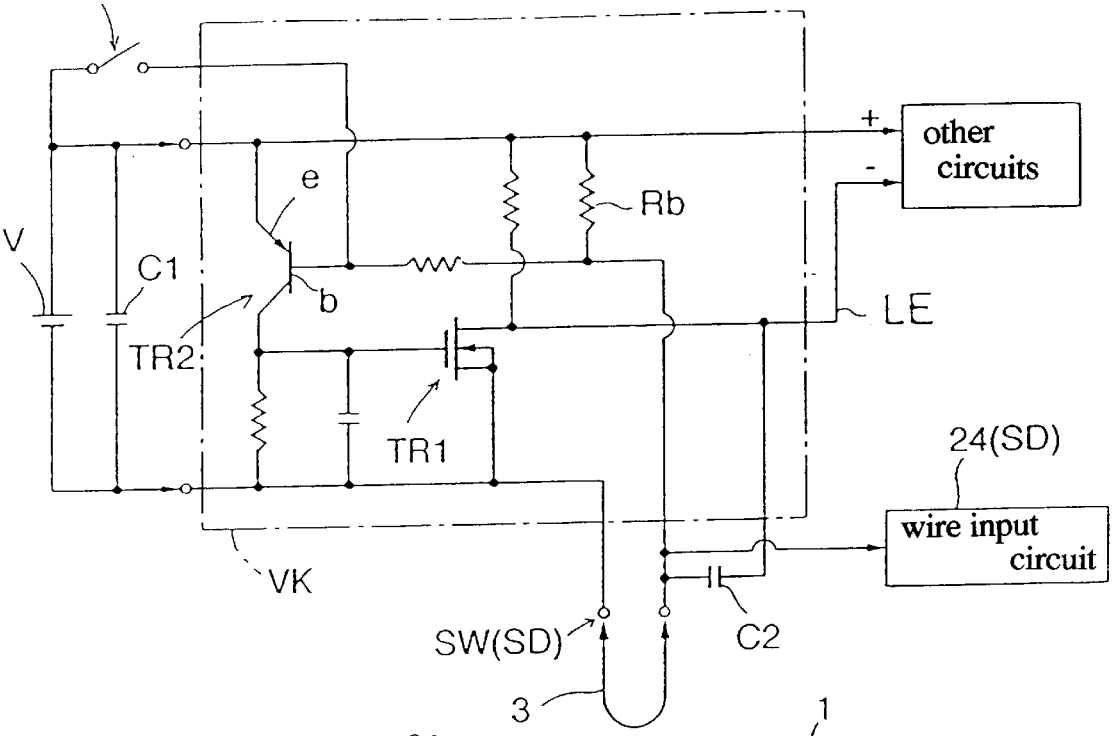
FIG. 22 is a circuit construction diagram relating to an embodiment of the present invention, FIGS. 23(*a*), (*b*) are views showing a sensor tag relating to a further embodiment of the present invention.

The power supply retaining circuit VK, as shown in FIG. 22, includes such components as a MOSFET type switching transistor TR1 switchable between a state for connecting the negative terminal of the battery V with the ground terminals of the respective circuits and a further state for disconnecting the same, and an activating transistor TR2 for rendering this switching transistor TR1 conductive in association with insertion of the wire unit 3.

The piezoelectric buzzer 21 is driven by periodic voltage pulses and generates a sound according to the frequency of the voltage pulses.

As the buzzer/LED driver 29 generates the periodic voltage pulse signals, the output signals from this buzzer/LED driver 29 may directly drive the piezoelectric buzzer 21. Yet, the greater the voltage value of the voltage pulses applied thereto, the greater sound the piezoelectric buzzer 21 generates. Then, there is provided the booster circuit so as to be able to apply boosted voltage pulses to be applied on the piezoelectric buzzer 21.

Next, the construction of this booster circuit will be described.

The booster circuit includes the transistor TR which effects the switching operation in response to the output signal from the buzzer/LED driver 29, a diode D1 for preventing input from a current from the resonance antenna 22 and a portion of the coil 22*a*.

The coil 22*a* of the resonance antenna 22 comprises a center tap type coil, such that it may be used as two coils L1, L2 with an electrode terminal 22*c* being withdrawn from a middle portion of the continuously wound coil.

This electrode terminal 22*c* is connected via the diode D1 with the piezoelectric buzzer 21, such that the piezoelectric buzzer 21 and the coil L2 are serially connected with each other. The piezoelectric buzzer 21 has a construction in which a dielectric is bound between electrodes and this is an electrically capacitive buzzer. Then, this may be considered to be equivalent to a capacitor. Accordingly, the piezoelectric buzzer 21 and the coil L2 together constitute a serial resonance circuit.

The buzzer/LED driver 29 outputs the voltage pulse, and this outputted voltage pulse is inputted to a base of the transistor IR in which the piezoelectric buzzer 21 is connected between the collector and emitter thereof.

Figure 20A:
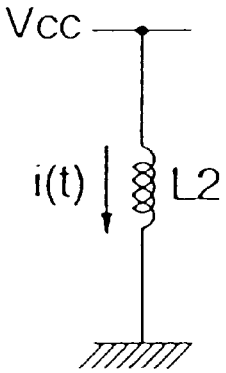
Figure 20B:
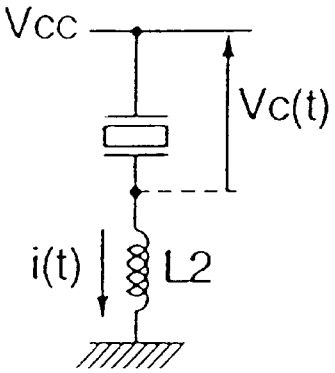

When the transistor TR which effects the switching operation by the voltage pulse from the buzzer/LED driver 29 is in the state of 'ON', as shown in FIG. 20(*a*), there is equivalently realized a condition where the coil L2 alone is present between a supply voltage Vcc of the battery V and the ground (GND). Whereas, when the transistor TR is in the state of 'OFF', as shown in FIG. 20(*b*), there is equivalently realized a condition where the piezoelectric buzzer 21 and the coil L2 are serially present between the supply voltage Vcc and the ground (GND).

Figure 21:
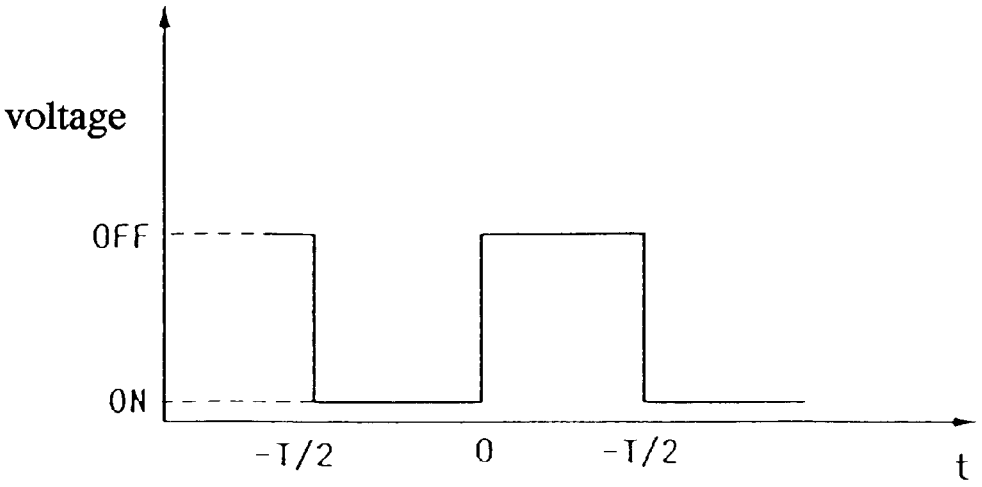
FIG. 21 is an operation descriptive view of the booster circuit relating to the embodiment of FIG. 20.

Supposing: the voltage at the opposed ends of the piezoelectric buzzer 21 is $v_c(t)$; the current running in the coil L2 is i(t); the capacitance of the piezoelectric buzzer 21 is C; the buzzer/LED driver 29 outputs a voltage pulse signal as shown in FIG. 21 having a cycle of T and a duty of 50%, and if the transistor TR is switched; then, under the 'ON' state shown in FIG. 20(*a*) of the transistor TR, i.e. the condition of $(-T/2<t<0)$ in FIG. 21, there is provided:

$$v_c(t) = 0$$

$$i(t) = \frac{Vcc}{R}\left\{1 - e^{\frac{-R}{L}(t+T/2)}\right\}$$

Whereas, in the condition: t=0, i.e. the current $i_0$ running in the coil L2 at the moment of the switchover of the transistor TR from 'ON' to 'OFF' is:

$$i_0 = i(0) = \frac{Vcc}{R}\left(1 - e^{\frac{-RT}{2L}}\right) \qquad \text{expression 1}$$

In the 'OFF' state shown in FIG. 20(*b*) of the transistor TR, i.e. in the condition shown in FIG. 21 of (0<t<T/2), with the above expression 1 as the initial conditions, the condition will be as expressed by the following expression 2.

In the expression 2, $v_c(t)$ is at maximum when sinωt=1, and if, e.g. the frequency of the sound generated from the piezoelectric buzzer 21 is 4 kHz, i.e. T=250 μs, R=100 Ω, L=50 mH, C=15 nF, this peak voltage $v_c^P$ will be:

$$v_c^P = 4.8\ Vcc$$

$$i(t) = \frac{Vcc}{R} e^{-\frac{R}{2L}(t+T)}\left\{\left(e^{\frac{RT}{2L}} - 1\right)\cos\omega t + \frac{R}{\omega L}\sin\omega t\right\} \qquad \text{expression 2}$$

$$v_c(t) = Vcc\left[1 - e^{-\frac{R}{2L}t}\cos\omega t + e^{-\frac{R}{2L}t}\left\{\frac{\omega L}{R}\left(1 - e^{\frac{-RT}{2L}}\right) - \frac{R}{4\omega L}\left(1 + e^{\frac{-RT}{2L}}\right)\right\}\sin\omega t\right]$$

$$\omega = 1/\sqrt{LC} \cdot \sqrt{1 - \frac{R^2 C}{4L}}$$

Accordingly, the voltage pulse boosted above the power voltage Vcc is applied to the piezoelectric buzzer 21, so that the sound generated from the piezoelectric buzzer 21 is increased in volume.

Incidentally, the coil 22*a* of the resonance antenna 22 is wound about an axis extending in the thickness direction in order to be able to detect most effectively change in the magnetic field in the direction of thickness of the box 2 having the flat rectangular shape.

Figure 11:
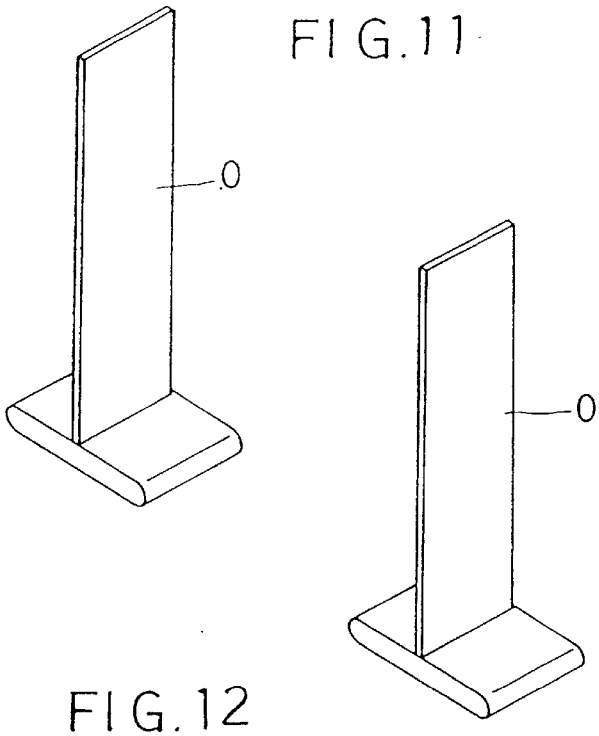
FIG. 11 is a view showing outer appearance of a transmitter relating to the embodiment of the present invention.

According to the circuitry construction described above, when the box 2 is attached to a commodity as the object of theft prevention via the wire unit 3, if the wire unit 3 is cut or if the sensor tag 1 is passed through an installed site of a pair of panel type transmitters O as shown in FIG. 11 which are to be installed at e.g. opposed ends of an entrance/exit of a shop, the piezoelectric buzzer 21 housed in the box 2 is activated to generate a sound for outputting alarm. Incidentally, as the transmitters O, one of the above-described pair of panel type may be disposed at one side of the entrance/exit or on a floor face of the entrance/exit.

Next, process until the piezoelectric buzzer 21 begins to generate the sound in the cases described above will be described briefly.

First, in the condition of this apparatus where the wire unit 3 is not attached to the box 2 (out-of-use condition), the power supply retaining circuit VK does not supply power to the other respective circuits. Namely, under this condition, in the activating transistor TR2, the base b and the emitter e are on the same potential, so that the transistor is OFF. Then, the switching transistor TR1 too is OFF, thus disconnecting between the negative terminal of the battery V and the ground terminals of the respective circuits.

Then, when the wire unit 3 is attached to the box 2, the base b of the activating transistor TR2 is connected with the negative terminal of the battery 2, the activating transistor TR2 is switched ON and the switching transistor TR1 too is switched ON, so as to initiate power supply to the respective circuits. Under this condition, the the input terminal of the wire input circuit 24 is connected via the wire unit 3 with the negative terminal of the battery V and maintained at the ground potential.

When the wire unit 3 and the box 2 are not serially connected, such as when the wire unit 3 is cut off, as the input terminal of the wire input circuit 24 is connected with the positive terminal of the battery V via a resistor Rb, the potential rises from the ground potential. When the input terminal of the wire input circuit 24 has risen above a predetermined voltage, the wire input circuit 24 detects this as e.g. cut-off of the wire unit 3. Incidentally, in this condition, current is provided from the resistor Rb through the input terminal of the wire unit circuit 24 and the ground line Le, so that a predetermined potential is developed across the opposed ends of the resistor Rb. So that, the activating transistor TR2 is maintained under the ON state. Accordingly, this power supply retaining circuit VK maintains the power supply retaining condition unless the reset switch R is switched ON, once activated with attachment of the wire unit 3 to the box 2.

When the reset switch R is switched ON, the base b of the activating transistor TR2 is connected with the positive terminal of the battery V, so that the activating terminal TR2 is forcibly switched OFF and the switching transistor TR1 is switched ON simultaneously therewith, thereby to break power supply to the respective circuits. Accordingly, the reset switch R functions as a retention releasing instructing switch for instructing release of retention to the power supply retaining circuit VK in the form of an electric signal.

Upon detection of e.g. cut-off of the wire unit 3, the wire input input circuit is 24 outputs a wire cut signal to the switching circuit 25.

Incidentally, the input side of the wire input circuit 24 is connected with the ground via a delay capacitor C2. Thus, even if there occurs disconnection at contacts of the circuits between the wire unit 3 and the box 2 due to e.g. application of vibration to the wire unit 3, rapid rise of the potential at the input side of the wire input circuit 24 may be restricted. As a result, the wire input circuit 24 is prevented from being erroneously activated when the wire unit 3 is not cut off.

The switching circuit 25 continuously provides a control signal to the generating circuit 26 and to the counter 27 while receiving the wire cut signal. And, while receiving this control signal, the generating circuit 26 keeps generating pulses and the counter 27 counts the number of these pulses generated from the generating circuit 26. Then, when the control signal is stopped, the generating circuit 26 stops pulse generation and the counter 27 stops pulse counting and rests the pulse count number.

After each completion of count of a predetermined number of pulses, the counter 27 transmits a single pulse signal as a count completion signal to the latch circuit 26 and to the buzzer/LED driver 29.

While receiving this count completion signal, the buzzer/LED driver 29 sounds the piezoelectric buzzer 21 and also illuminates the LED lamp 20.

On the other hand, upon reception of the count completion signal from the counter 27, the latch circuit 28 maintains the switching circuit 25 under the condition at the time of the reception of the cut signal, whereby the switching circuit 25 keeps transmitting the control signal to the generating circuit 26 and to the counter 27.

That is to say, after the switching circuit 25 receives the cut signal and then after the counter 27 has completed count of the predetermined pulse number, the buzzer/LED driver 29 sounds the piezoelectric buzzer 21 and illuminates the LED lamp 20. With this, the piezoelectric buzzer 21 and the LED lamp 20 are not activated unless continuously receiving the cut signal for a predetermined period of time, so that erroneous activations thereof due to e.g. noise are avoided.

Here, checking means H for allowing output of the alarm output means AO only when preliminary stealing act detection information outputted from the preliminary act detecting means SD continues to exist for a predetermined period of time is constituted by the delay capacitor C2, the generating circuit 26 and the counter 27.

Once the counter 27 has transmitted the count completion signal, regardless of presence/absence of the cut signal from the wire input circuit 24, the switching circuit 25 keeps transmitting the control signal. Thus, until the reset switch R is closed, the piezoelectric buzzer 21 keeps generating the sound intermittently in synchronism with the count completion signal from the counter 27 and the LED lamp 20 keeps illuminating intermittently in synchronism with the count completion signal from the counter 27.

Incidentally, while the LED lamp 20 and the piezoelectric buzzer 21 keeps issuing the alarm in the manner described above, if the positive or negative terminal of the battery V is instantaneously detached from the connecting terminal, the circuits in the box 2 should not be reset to stop the alarm. For this reason, a power supply capacitor C1 is provided parallel with the battery V in order to provide auxiliary power supply.

The power supply capacitor C1 connected parallel with the battery V is charged by this battery V. Then, while the LED lamp 20 and the piezoelectric buzzer 21 are issuing the alarm, if the positive terminal of the battery V is momentarily detached from the connecting terminal 71*a* or the negative terminal thereof is momentarily detached from the connecting terminal 71*b* thereby to interrupt the power supply from the battery V to the respective circuits, the power supply capacitor C1, instead of the battery V, keeps power supply to the respective circuits. Thus, it is possible to prevent the respective circuits inside the box 2 from being reset to stop the alarm. When the positive or negative terminal of the battery V is momentarily detached from the connecting terminal 71*a,* 71*b* and then contacted with the terminal again, the power supply capacitor C2 is charged by the battery V, so that electric power is stored in the power supply capacitor C1.

Incidentally, as the power supply capacitor C1 is electrically connected with the circuit board 6 by means of e.g. soldering, there occurs no electrical disconnection even if impact or vibration is applied thereto.

When the sensor tag 1 is passed through the installed site of the transmitters O, an electromotive force is generated in the resonance antenna 22 due to the radio wave from the transmitters O. So that, the antenna input circuit 23 detects this electromotive force and outputs a reception signal to the switching circuit 25.

The operations of the respective circuits after the switching circuit 25 has received the reception signal are the same as those in the afore-described case when the wire unit 3 is cut off and therefore will not be described here.

Accordingly, these components including the resonance antenna 22, the antenna input circuit 23, the circuit connecting the wire input circuit 24 and the wire unit 3 together constitute the preliminary act detecting means SD for detecting a preliminary stealing act such as unlawful detachment of the sensor tag 1 from the object of theft prevention by e.g. cutting off the wire unit 3 or an unlawful attempt to take out the object of theft prevention to which the sensor tag 1 is attached to the outside of the shop. And, the switching circuit 25, the generating circuit 26, the counter 27, the latch circuit 28, the buzzer/LED driver 29, the LED lamp 20 and the piezoelectric buzzer 21 together constitute alarm output means AO for outputting alarm information in the form of light and sound based on detection information of the preliminary act detecting means SD.

Accordingly, the wire input circuit 24 functions as attachment/detachment detecting switch SW for electrically detecting attachment/detachment of the wire unit 3 to and from the box 2. Further, the resonance antenna 22 and the antenna input circuit 23 function as an antenna AN disposed inside the box 2 for receiving radio wave from the transmitter O installed at a predetermined site.

The preliminary act detecting means SD for detecting a preliminary stealing act such as unlawful detachment of the sensor tag from the object of theft prevention by cutting off the wire unit 3 or attempt to unlawfully take out the object of theft prevention to which the sensor tag 1 is attached to the outside of the shop include the wire unit 3, the resonance antenna 22, the antenna input circuit 23 and the wire input circuit 24.

The switching circuit 25, the generating circuit 26, the counter 27, the latch circuit 28, the buzzer/LED driver 29, the LED lamp 20 and the piezoelectric buzzer 21 together function as the alarm output means for outputting the alarm information in the form of light and sound based on preliminary stealing act detection information of the preliminary act detecting means SD. This alarm output means AO is constructed so as to output the alarm information based on the wire cut-off signal (corresponding to a detachment detection signal) from the wire input circuit 24 and the reception signal from the resonance antenna 22 and the antenna input circuit 23 as the preliminary stealing act detection information.

With being charged by the battery V, the power supply capacitor C1 functions as an auxiliary power supply means Va for driving the preliminary act detecting means SD and the alarm output means AO when the power supply from the battery V is interrupted.

Next, attaching construction of the wire unit 3 to the box 2 will be described.

As shown in FIGS. 6 through 10, the wire unit 3 is attached to the box, with the lock pins 30 of the wire unit 3 being inserted into lock pin insertion holes 40*a,* 40*b* of a jack unit 4 provided in contact with the inner wall of the box 2. Accordingly, the lock pin insertion holes 40*a,* 40*b* act also as connecting terminals for connecting the wire unit 3.

The jack unit 4 includes a hook-shaped lock spring 41 for engaging the lock pin 30 inserted into the lock pin insertion hole 40*a* for preventing withdrawal of the pin and a hook-shaped lock spring 42 for engaging the lock pin 30 inserted into the lock pin insertion hole 40*b* for preventing withdrawal of the pin, with the springs 41, 42 being provided side by side.

The lock springs 41, 42, as lock means, are retained at curved portions 41*c,* 42*c* thereof to spring retaining projections 49 projecting from the body of the jack unit 4.

At intermediate positions between distal ends 41*b,* 42*b* away from the curved portions 41*c,* 42*c* of the lock springs 41, 42 and the curved portions 41*c,* 42*c,* there are provided convex portions 41*a,* 42*a* engageable with engaging concave portions 30*a* of the lock pins 30, with the convex portions being projectable into and withdrawable from the lock pin insertion holes 40*a,* 40*b,* as will be described later.

The lock springs 41, 42 respectively are made of metal and have the hook shape, so that each spring has elasticity in the direction that the opposed ends thereof move toward or away from each other. Thus, when no force is applied to the lock spring 41, 42, as shown in FIG. 6, the convex portion 41*a*, 42*a* projects to the substantially middle position at the lock pin insertion hole 40*a*, 40*b*.

Accordingly, when the engaging concave portion 30*a* of the lock pin 30 engages with the convex portion 41*a*, 42*a*, the convex portion 41*a*, 42*a* is pushed away from the lock pin insertion hole 40*a*, 40*b*, whereby the lock spring 41, 42 is urged toward the side for engagement with the lock pin 30.

The lock pin insertion hole 40*a*, 40*b* is closed at the bottom side thereof, where a metal coil spring 44*a*, 44*b* having one end fixed to the bottom end of the lock pin insertion hole 40*a*, 40*b* is provided.

The metal coil springs 44*a*, 44*b* function to urge the lock pins 30 respectively inserted into the lock pin insertion holes 40*a*, 40*b* toward the disengaging side and these springs are in contact, at the fixed ends thereof, with metal conductive terminals 48*a*, 48*b*.

Figure 12:
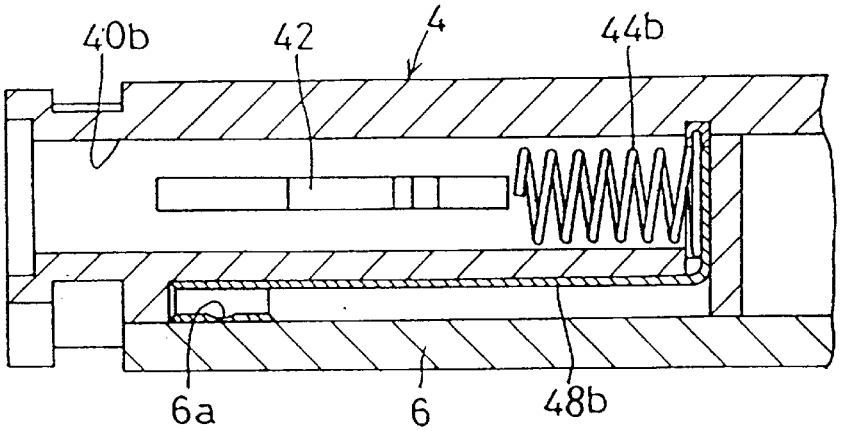
FIG. 12 is an enlarged cross sectional view of the jack unit of FIG. 6.

The conductive terminal 48*b*, as shown in FIG. 12, has its one end projecting to the bottom end of the lock pin insertion hole 40*b* to contact the coil spring 44*b* and has its other end contacting an electrode face 6*a* formed in the circuit board 6 constituting the circuitry shown in FIG. 5.

Incidentally, the other conductive terminal 48*a* too, though different in its connecting position to the circuit board 6, has substantially same construction as the conductive terminal 48*b*.

With this, the lock pins 30 inserted into the lock pin insertion holes 40*a*, 40*b* are electrically connected, via the coil springs 44*a*, 44*b* and the conductive terminals 48*a*, 48*b*, with the circuitry shown in FIG. 5.

That is to say, the respective lock pins 30 and the coil springs 44*a*, 44*b* constitute switch SW for connecting the base of the activating transistor TR2 and the negative terminal of the battery via the wire 31 and the conductive terminals 48*a*, 48*b* with the attachment of the wire unit 3 to the box, as described above; and this switch SW constitutes the attachment/detachment detecting switch for electrically detecting attachment and detachment of the wire unit 3 to and from the box and constitutes also a portion of the preliminary act detecting means.

At a portion of the lock pin insertion hole 40*a* opposite to the lock pin insertion hole 40*b*, a key insertion hole 45 as an insertion hole for releasing operation is formed to extend from the outer side to the inner side of the box 2. And, into this key insertion hole 45, a rack portion 63 of an engagement releasing key K as a releasing tool to be described after is to be inserted.

Further, at the position of the lock pin insertion hole 40*a* opposite to the lock pin insertion hole 40*b*, there is provided engagement releasing means D for operating the lock springs 41, 42 toward the engagement releasing side by means of the engagement releasing key K as the engagement releasing tool. This engagement releasing means D is formed by forming the key insertion hole 45, as the insertion hole for releasing operation, from the outer side to the inner side of the box 2.

Figure 13:
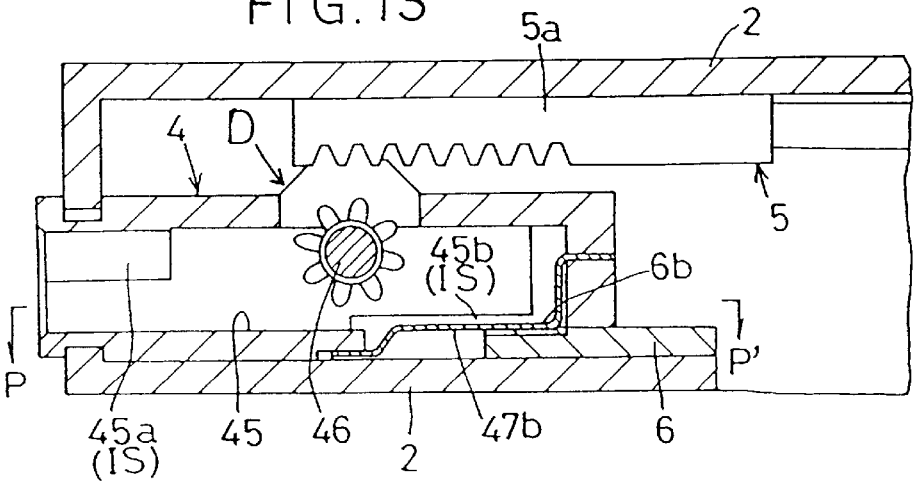
FIG. 13 is an enlarged cross sectional view through the box of FIG. 4 taken through the jack unit of FIG. 6.
Figure 14:
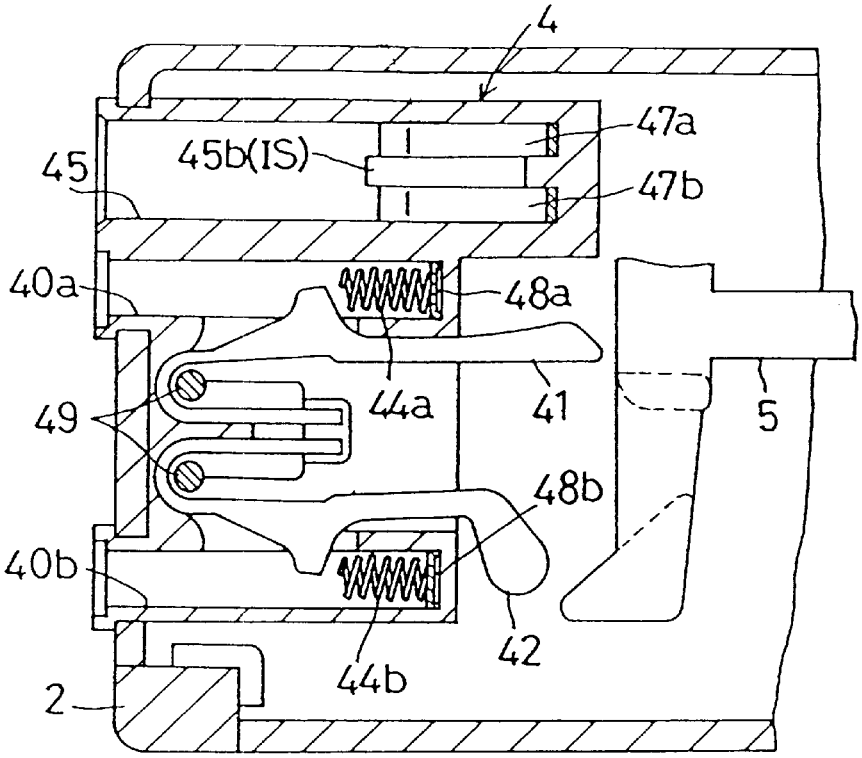
FIG. 14 is a cross sectional view taken through the insertion hole of FIG. 13.
Figure 15:
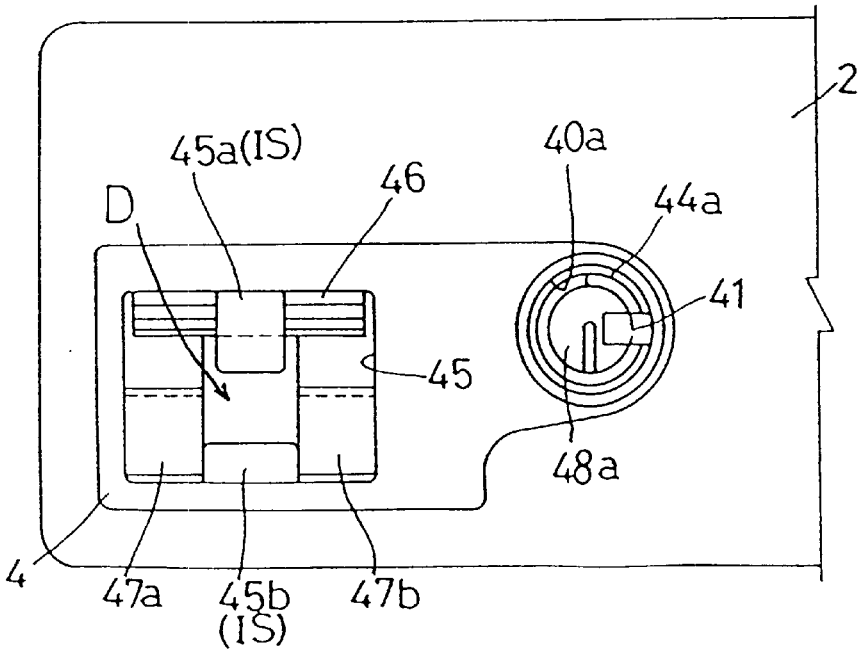
FIG. 15 is a partial end view illustrating the key insertion hole and one of the pin insertion holes of FIG. 14, embodiment of the present invention, FIGS. 16(*a*), (*b*), (*c*) are enlarged views of principal portions of an engagement releasing key relating to the embodiment of the present invention, FIGS. 17(*a*) and (*b*) are enlarged views of principal portions of an engagement releasing key relating to the embodiment of the present invention.

As shown in FIG. 13, FIG. 14 which is a section view taken along P—P' in FIG. 13, and also in FIG. 15 which shows the key insertion hole 45 as viewed from the outer side thereof, the key insertion hole 45 incorporates therein a pinion gear 46 rotatably operated in association with the insertion of the rack portion 63 of the engagement releasing key K into the key insertion hole 45 and a pair of reset terminals 47*a*, 47*b* (an example of electric contacts) forming a part of the reset switch R shown in FIG. 5, and also two blocking walls 45*a*, 45*b* as projections projecting from the side wall of the key insertion hole 45 to the inside of the key insertion hole 45 are formed at different longitudinal positions at the entrance side and the bottom side of the key insertion hole 45.

The pinion gear 46 is rotatably supported to the body of the jack unit 4 with the teeth thereof extending in the direction normal to the inserting direction of the rack portion 63 of the engagement releasing key K, and with the pinion gear being slightly movable in the direction normal to the plane of FIGS. 6 through 10. Further, when the rack portion 63 of the engagement releasing key K is not inserted into the key insertion hole 45, the pinion gear 46 is located on the inner side relative to the key insertion hole 45, not engaging with a rack portion 5*a* of the slider 5 to be described later. Whereas, when the rack portion 63 of the engagement releasing key K is inserted into the key insertion hole 45, the pinion gear is pushed up by the rack portion 63, so that a portion thereof projects outside the jack unit 4 to engage with the rack portion 5*a* of the slider 5.

The pair of reset terminals 47*a*, 47*b* are provided on the opposed sides of the bottom side blocking wall 45*b* of the two blocking walls 45*a*, 45*b* to be exposed inside the key insertion hole 45. Further, as shown in FIG. 13, the terminals are exposed also to the outside of the jack unit 4, so that these portions exposing to the outside respectively contact with the electrode face 6*b* formed in the circuit board 6 to be connected with the circuitry shown in FIG. 5.

The entrance side blocking wall 45*a* of the two blocking walls 45*a*, 45*b*, is formed as a projecting ridge extending from the entrance end of the key insertion hole 45 longitudinally toward the bottom side of the key insertion hole 45, and formed more particularly as an erect plate member.

The bottom side blocking wall 45*b*, as shown in FIG. 13, is formed as a substantially L-shaped plate member, and a portion thereof formed along the side face of the key insertion hole 45 as viewed from the longitudinal direction, is provided as a projecting ridge extending in the longitudinal direction of the key insertion hole 45, like the entrance side blocking wall 45*a*.

The entrance side blocking wall 45*a* and the bottom side blocking wall 45*b*, as shown in FIG. 15, are formed with 180 degree phase difference therebetween, if positions at the inner wall of the key insertion hole 45 as viewed in the longitudinal direction are expressed in terms of phase relative to a virtual circle centering about the longitudinal center of the key insertion hole 45.

The bottom side blocking wall 45*b*, through the entire region where the pair of reset terminals 47*a*, 47*b* are exposed inside the key insertion hole 45, is located between the pair of reset terminals 47*a*, 47*b*. Also, the height of the blocking wall 45*b* from the wall face of the key insertion hole 45 is designed to be higher than the height of the pair of reset terminals 47*a*, 47*b* from the wall face of the key insertion hole 45, thus constituting a non-conductive partitioning portion for preventing the pair of reset terminals 47*a*, 47*b* from being rendered conductive with unlawful insertion of a metal plate.

When the pair of reset terminals 47*a*, 47*b* are short-circuited, the reset switch R in the circuitry shown in FIG. 5 is closed to stop the power supply from the battery V to the respective circuits. Therefore, by forming the blocking wall 45*b* in the above-described manner, the pair of reset terminals 47*a*, 47*b* are prevented from being easily short-circuited with insertion of an external object having conductivity.

Figure 19:
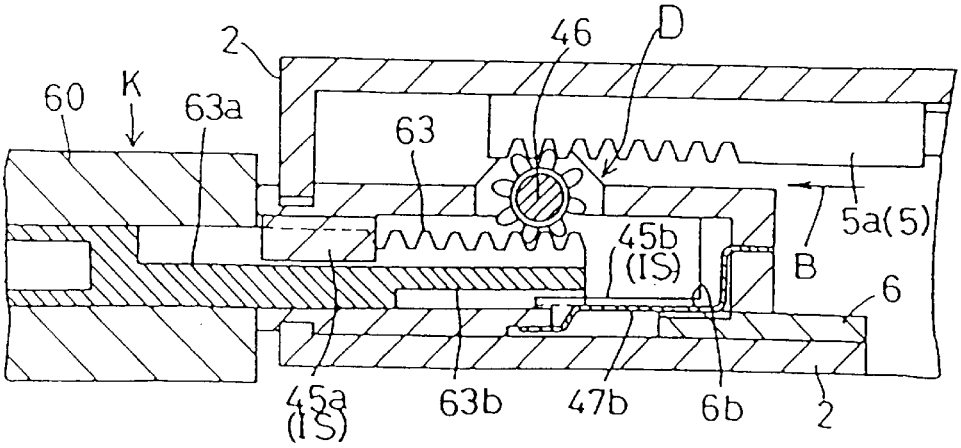
FIG. 19 is a view similar to that of FIG. 18, but showing a rack portion of the key engaging a pinion gear, FIGS. 20(*a*), (*b*) are operation descriptive views of a booster circuit relating to an embodiment of the present invention.

At the portion of the jack unit 4 on the inner side of the box 2, there is provided the slider 5 having the rack portion 5*a* engaging the pinion gear 46 of the jack unit 4 under the condition shown in FIG. 19.

The slider 5 is slidably engageable with an unillustrated guide portion provided in the inner wall of the box 2. The slider is slidable in the direction denoted with an arrow A in FIG. 6, i.e. the inserting/withdrawing direction of the rack portion 63 of the engagement releasing key K, with the slider being urged to return toward the inner side of the box.

The slider 5, as shown in FIGS. 6 through 10, includes a first pressing portion 5*d* for contacting the end 41*b* of the lock spring 41 and a second pressing portion 5*e* for contacting the end 42*b* of the lock spring 42, in association with the sliding movement of the slider 5. The distance between the end 42*b* of the lock spring 42 and the second pressing portion 5*e* is set to be longer than the distance between the end 41*b* of the lock spring 41 and the first pressing portion 5*d*.

In short, the slider 5 functions as the lock releasing means for operating the lock springs 41, 42 as the pair of locking means into lock releasing states. More particularly, with the difference in the distance described above, the slider is switchable between a first releasing state for releasing only one of the pair of lock spring 41, 42 and a second releasing state for releasing both the lock springs 41, 42.

And, the switchover between the first releasing state and the second releasing state is selected by varying the amount of insertion of the rack portion 63 of the engagement releasing key K. That is to say, as will become apparent from the following description, the slider is operated into the first releasing state in association with insertion of the rack portion 63 of the engagement releasing key K as the releasing tool by a first insertion amount and operated into the second releasing state in association with the insertion of the same by a second insertion amount, respectively.

Figures 16A, 16B, 16C:
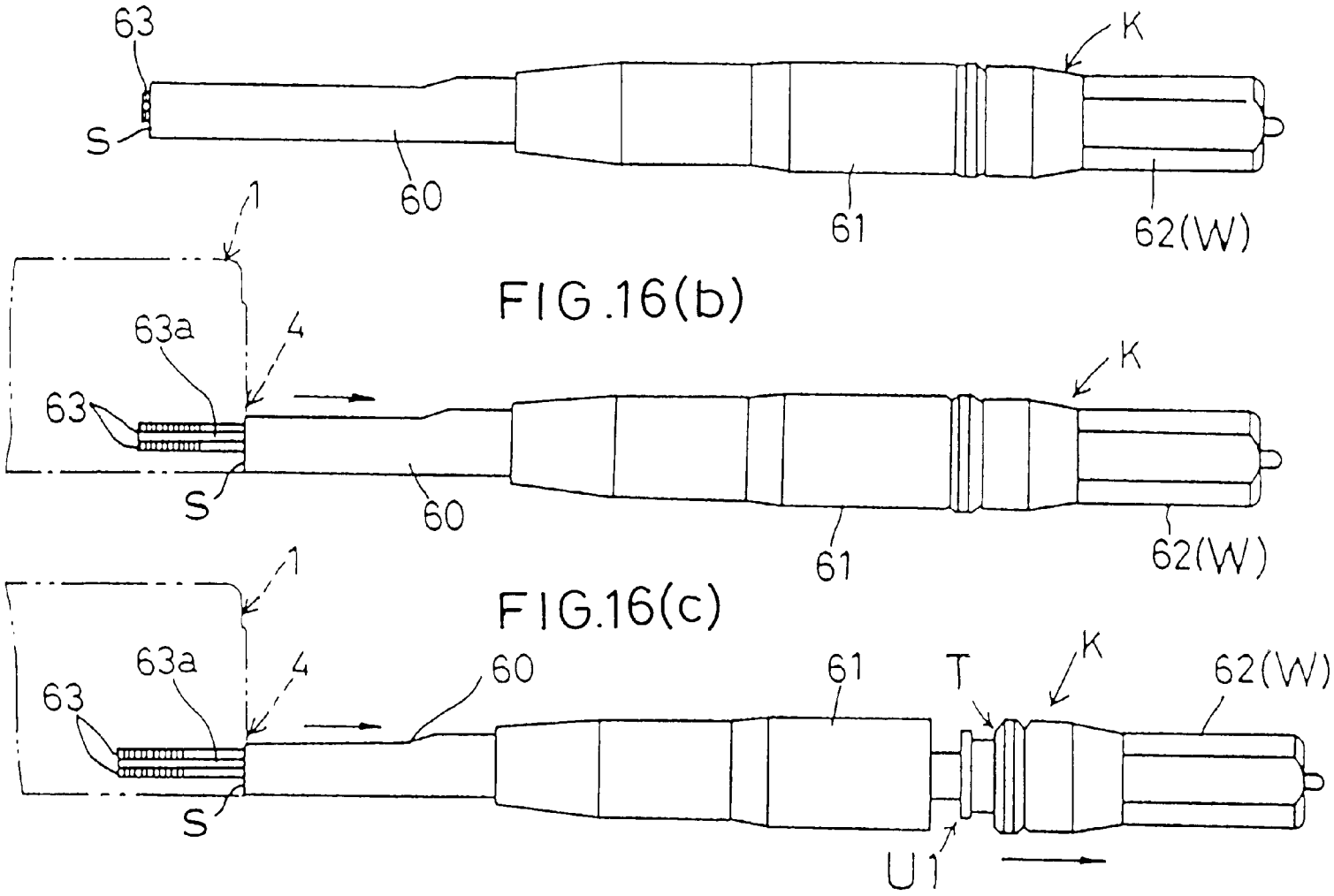
Figure 25A:
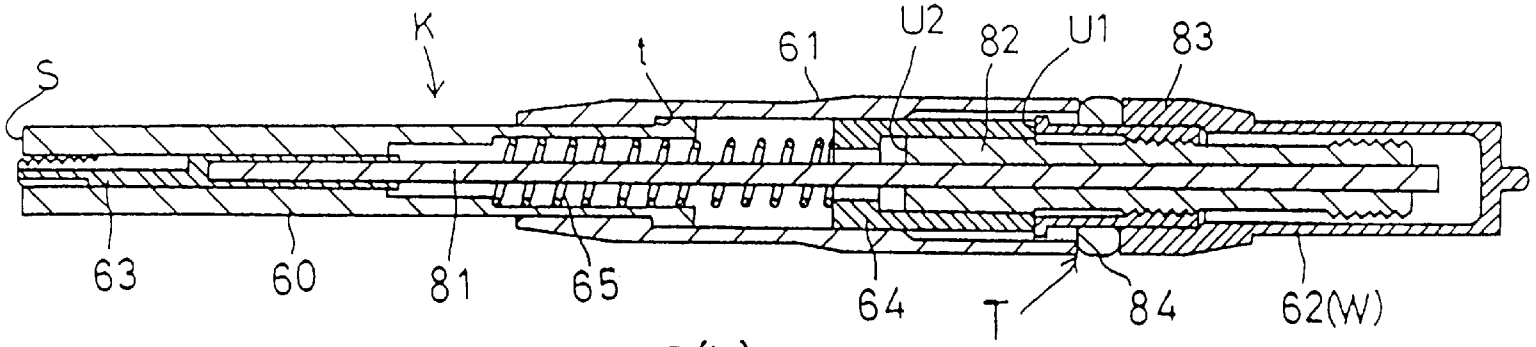
Figure 25B:
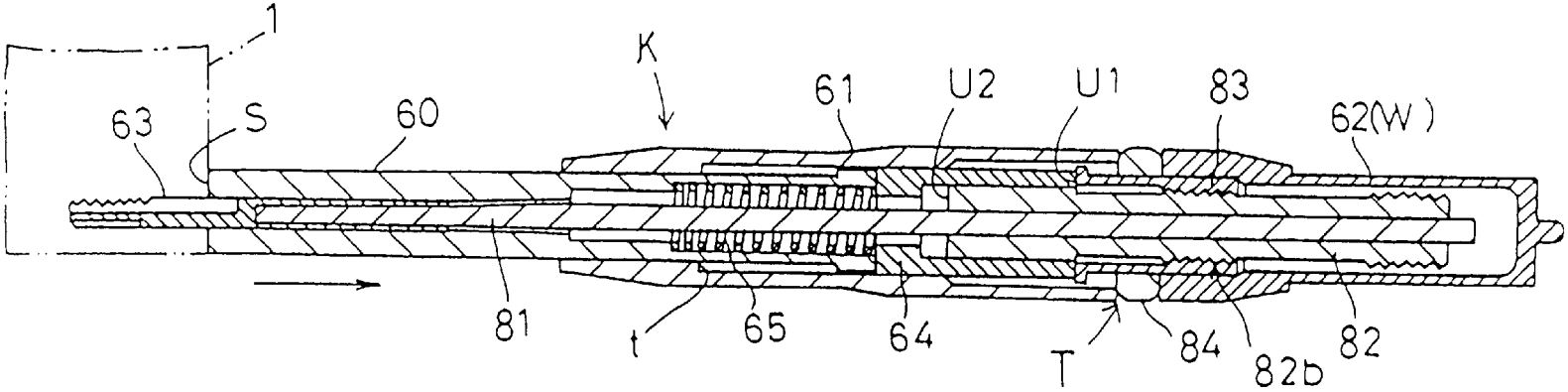
Figure 26A:
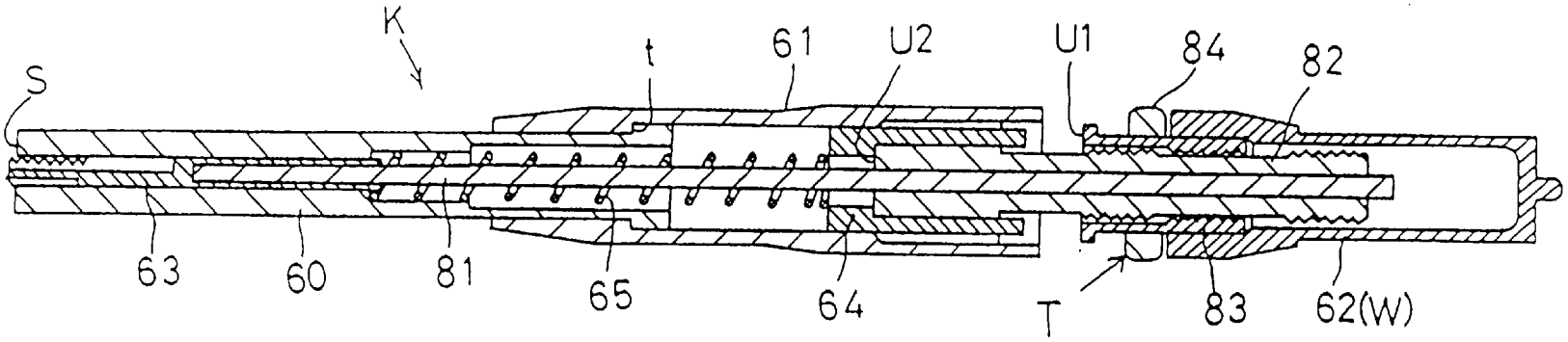
Figure 26B:
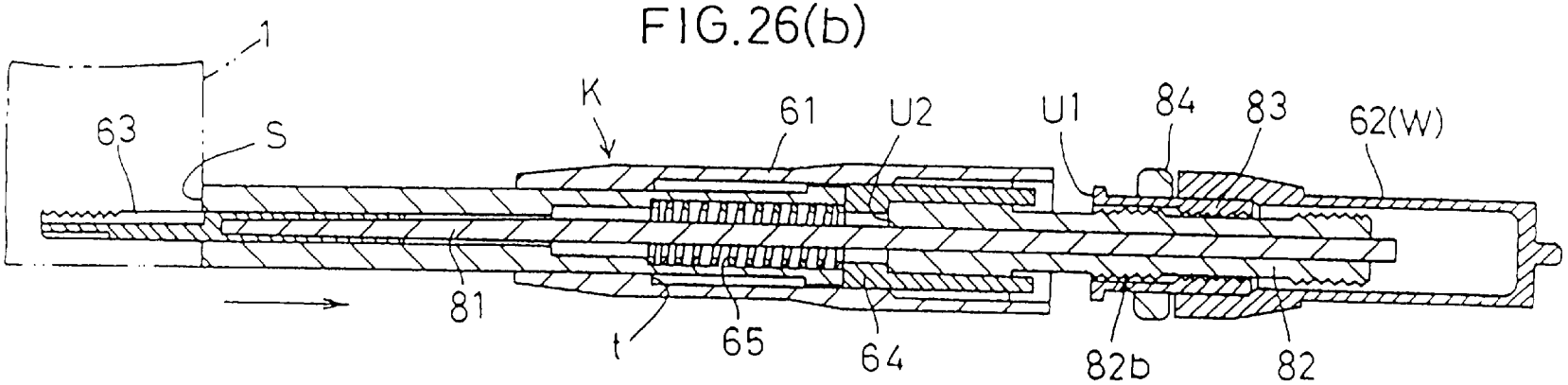
Figure 27:
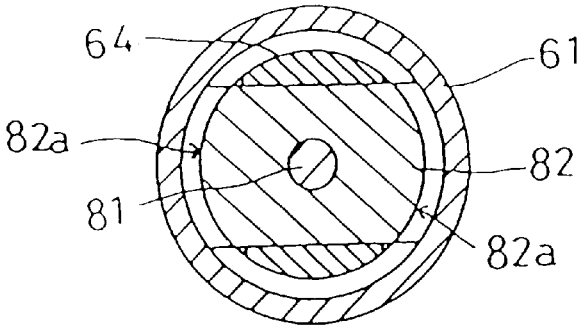
FIG. 27 is a front view in vertical section of the engagement releasing key of the embodiment of FIG. 25.

The engagement releasing key K has an outer shape as shown in FIG. 16(*a*) and, as shown in FIG. 16(*b*) and FIG. 16(*c*) includes a contact portion (s) for contacting the outer face of the box 2, the rack portion 63 projecting from this contact portion (s) and a projection amount adjusting portion W for variably adjusting the projection amount of the rack portion 63 from the contact portion (s). To add further description, as shown also in FIGS. 25 through 27, the key includes a hand-supported outer sleeve 61 co-extensively including and supporting the rack portion 63, an inner sleeve 60 supported to be longitudinally movable relative to the outer sleeve 61 to cover the rack portion 63 and having a leading end thereof constituting the contact portion (s), a coil spring 65 as an urging member for urging the inner sleeve 60 toward the leading end of the rack portion, and a restricting member 64 for restricting the limit of retraction of the inner sleeve 60 toward the side of the outer sleeve 61. And, the projection amount adjusting portion W variably adjusts the restricting position of the restricting member 64 in the moving direction of the inner sleeve.

The variable adjustment of the restricting position of the restricting member 64 by the projection amount adjusting portion W is effected by an operation of an adjusting cap 62 which is connected to be threadably movable in the longitudinal direction of the rack portion and rotatably operated. Then, with adjustment of the projection amount adjusting portion W, the insertion amount may be adjusted to the first projection amount (see FIG. 16(*b*)) and to the second projection amount (see FIG. 16(*c*)).

To describe further the engagement releasing key K with reference to its inner construction, a rod 81 made of synthetic resin is provided, and at the leading end of this rod 81, the rack portion 63 made of the conductive material is outwardly fixed. Incidentally, the rod 81 may be made of metal.

Preferably, the various members to be described next are formed of synthetic resin having non-conductivity.

At the base end of the rod 81, a cylindrical member 82 is outwardly fitted. And, at an end of the cylindrical member 82 on the side of the rack portion, the cylindrically-shaped outer sleeve 61 is fixedly threaded.

Incidentally, in the present specification, the cylindrical member 81 fixedly threaded with the outer sleeve 61 and the rod 81 too are described as outer sleeve constituting members. That is, the outer sleeve is comprised of the outer sleeve 61 as the major component and the cylindrical member 82 and the rod 81.

Figure 29:
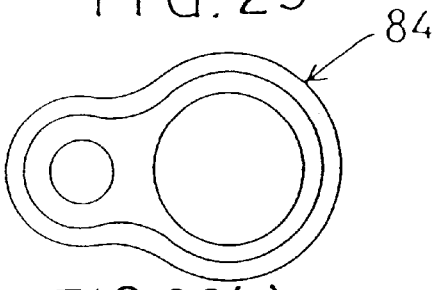
FIG. 29 is a front view of an annular member of the embodiment of FIG. 25, FIGS. 30(*a*), (*b*) are views showing an engagement releasing key of a further embodiment, FIGS. 31(*a*), (*b*), (*c*) and (*d*) are enlarged views showing principal portions of engagement releasing keys and key insertion holes relating to further embodiments of the present invention.

At the insertion-side end of the cylindrical member 82, as shown in FIG. 29, at two peripheral positions phase-wise apart from each other by 180 degree, screw portions 82*a* for threading with the outer sleeve 61 are provided and the remaining portion is cut away. And, at this cut-away portion, a pair of leg portions of the restricting member 64 are slidably engaged.

Figure 28:
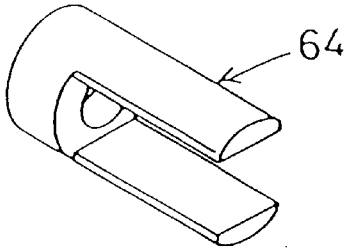
FIG. 28 is a perspective view of a restricting tool of the embodiment of FIG. 25.

That is to say, the restricting member 64, as shown in FIG. 28, has a configuration having a disc-like body portion and a pair of legs extending from the body portion. And, the disc-shaped body portion is slidably inwardly fitted with the outer sleeve 61 and this body portion defines an insertion hole for the rod 81. Further, the restricting member is urged away from the rack portion 63 by the coil spring 65 urging the inner sleeve 60.

The inner sleeve 60 is slidably inwardly fitted within the outer sleeve 61. And, the outer sleeve 61 includes a restricting portion (t) for limiting the end of movement of the inner sleeve toward the leading end of the rack portion, with the restricting portion restricting the leading end of the rack portion 63 at a position exposed from the inner sleeve. With this, when the rack portion 63 is inserted into the insertion hole 45 for releasing operation, the rack portion may be readily fixed in position.

There is provided an intermediate member 83 having a screw portion threadable with the screw portion 82*b* formed at the longitudinally intermediate position of the cylindrical member 82. And, on this intermediate member 83, the adjusting cap 62 having a bottom is integrally fitted outwardly. Further, on the outer periphery of the intermediate member 83, there is rotatably and slidably fitted an annular member 84 (see FIG. 29) having an attachment hole forming portion such as a string element. Also, at the base end of the cylindrical member 82, there is formed the screw portion to which the intermediate member 83 is threadable. So that, while the assembly of the intermediate member 83 with the cylindrical member 82 is allowed, the intermediate member 83 is prevented from being withdrawn when this intermediate member 83 is detached from the screw portion provided at the longitudinally intermediate position of the cylindrical member 82.

Incidentally, in the present specification, the intermediate member 83 integral with the adjusting cap 62 and the annular member 84 outwardly fitted on this intermediate member 83 too are described as adjusting cap constituting components. That is to say, the adjusting cap is comprised of the adjusting cap 62 as the major component, and the intermediate member 83 and the annular member 84.

Further, on the adjusting cap 62, by utilizing the annular member 84, there is provided a restricting portion T for restricting the limit of movement for the outer sleeve 61 toward the leading end of the rack portion through contact with the outer sleeve 61.

The adjusting cap 62 includes, by utilizing the intermediate member 83, a first receiving portion U1 for receiving the restricting member 64 at the restriction position for the first releasing state when the restricting portion T-is placed in contact with the outer sleeve 61. Further, the outer sleeve 61 includes, by utilizing the cylindrical member 82, a second receiving portion U2 for receiving the restricting member 64 at the further restricting position for the second releasing state when the adjusting cap 62 is moved relative to the outer sleeve 61 to move the restricting portion T sway from the outer sleeve 61 beyond a predetermined amount.

With the above construction, as described above, the projection amount adjusting portion W can variably adjust the restricting position of the restricting member 64 by forwardly and reversely rotating the adjusting cap 62 relative to the outer sleeve 61.

Figure 17A:
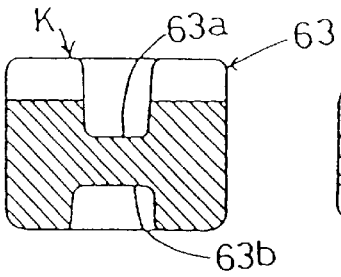
Figure 17B:
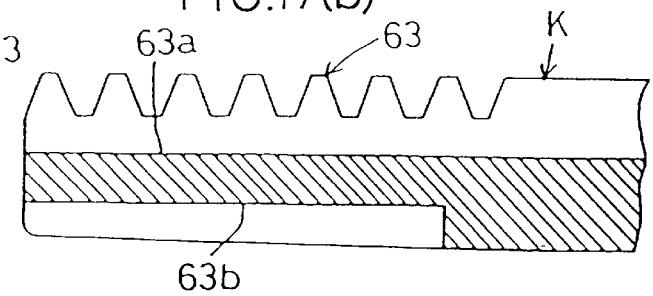

The rack portion 63, as shown in FIG. 17(*a*) showing it as viewed from the side of its leading end and also in FIG. 17(*b*) which is its partial section view, has a shape having two concave grooves of a long groove 63*a* on the side of forming the rack and a short groove 63*b* on the side away from the rack forming side.

The cross sectional shapes of the long groove 63*a* and the short groove 63*b* substantially correspond respectively to the cross sectional shapes of the blocking wall 45*a* formed at the entrance side of the key insertion hole 45 shown in FIG. 15 and the blocking wall 45*b* formed at the bottom side of the key insertion hole 45 as viewed from the key inserting direction. As the entrance-side blocking wall 45*a* engages with the long groove 63*a* and the bottom-side blocking wall 45*b* engages with the short groove 63*b* respectively, the rack portion 63 of the engagement releasing key K may be inserted into the key insertion hole 45 without being blocked by the blocking walls 45*a* and 45*b*.

Accordingly, the two blocking walls 45*a*, 45*b* function as insertion preventing means IS for preventing insertion into the key insertion hole 45 of a fake operating tool having a shape other than a predetermined shape while allowing insertion into the key insertion hole 45 of the rack portion 63 having the predetermined shape.

Incidentally, as the long groove 63*a* of the rack portion 63 corresponds with the entrance-side blocking wall 45*a* of the key insertion hole 45, this groove is formed longer than the short groove 63*b* corresponding to the bottom-side blocking wall 45*b*.

Next, engagement and release of the engagement between the wire unit 3 and the box 2 will be described.

First, for engaging the wire unit 3 with the box 2, from the condition of FIG. 6 in which both of the lock pins 30 of the wire unit 2 are disengaged, one lock pin 30 is inserted into the lock pin insertion hole 40*b* of the jack unit 4 as illustrated in FIG. 7. When the lock pin 30 is inserted against the urging force of the coil spring 44*b* disposed at the lock pin insertion hole 40*b*, the engaging concave portion 30*a* of the lock pin 30 comes into engagement with the convex portion 42*a* of the lock spring 42 projecting inside the lock pin insertion hole 40*b*, whereby the urging force of the coil spring 44*b* reliably prevents the movement of the lock pin 30 in the releasing direction thereby to maintain the engaged condition.

Figure 8:
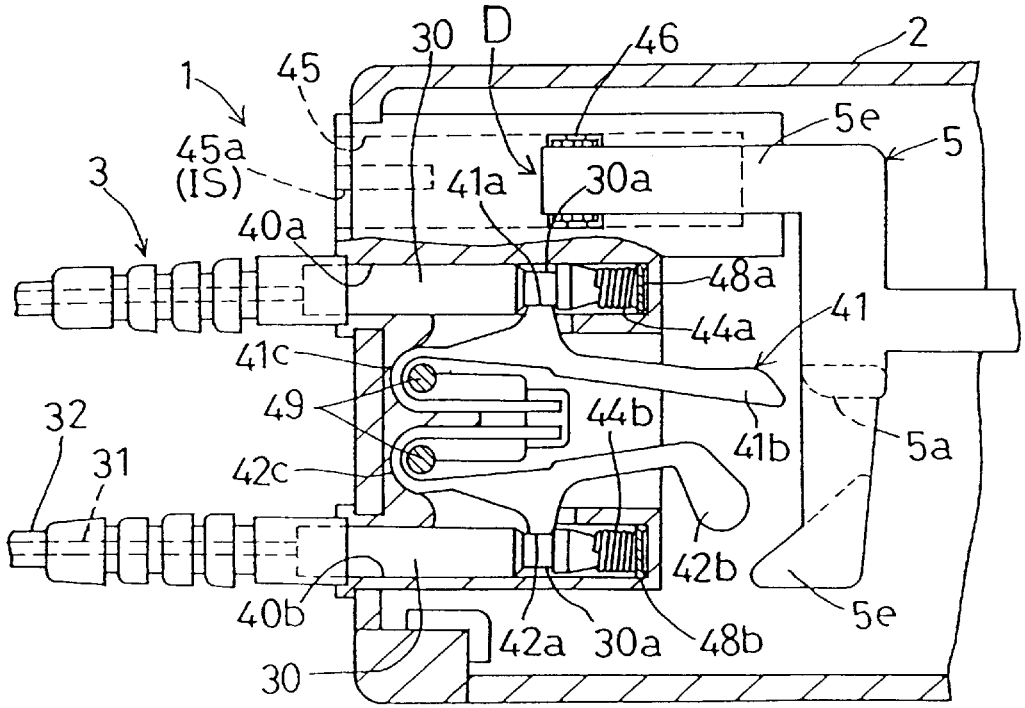
FIG. 8 is a view similar to that of FIG. 7, but showing both lock pins engaged within the lock pin insertion holes.

With the one lock pin 30 being inserted into the jack unit 4, after the other lock pin 30 is engaged with e.g. a commodity, then, as shown in FIG. 8, this lock pin is inserted into the lock pin insertion hole 40*a* of the jack unit 40. As the lock pin 30 is inserted against the urging force of the coil spring 44*a* provided in the lock pin insertion hole 40*a*, the engaging concave portion 30*a* of the lock pin 30 comes into engagement with the convex portion 41*a* of the lock spring 41 projecting into the lock pin insertion hole 40*a*, so that the urging force of the coil spring 44*a* reliably prevents the lock pin 30 from being moved in the releasing direction, thus maintaining the engaged state.

When the two lock pins 30 of the wire unit 3 are inserted into the lock pin insertion holes 40*a*, 40*b* in the manners described above, the battery V starts power supply to the respective circuits inside the box 2 shown in FIG. 5. And, under this condition, if the wire unit 3 is cut off for example, the sensor tag 1 outputs the alarm as described hereinbefore.

Next, from the condition shown in FIG. 8, for releasing the engagement between the wire unit 3 and the jack unit 4, the engagement releasing key K shown in FIG. 16 is used.

For detaching the sensor tag 1 from the object of theft prevention, the lock pin 30 is disengaged from only the lock pin insertion hole 40*a* adjacent the key insertion hole 45 so as to detach the tag from the object of theft prevention.

And, when it is necessary to replace the wire unit 3 for example, the other lock pin 30 inserted into the lock pin insertion hole 40*b* distant from the key insertion hole 45 too is disengaged.

For removing the lock pin 30 only from the lock pin insertion hole 40*a* adjacent the key insertion hole 45, the adjusting cap 62 is tightened until the restricting portion T comes into abutment against the outer sleeve 61 to set the insertion amount of the rack portion 63 into the insertion hole 45 to the first insertion amount. Under this condition, the engagement releasing key K is inserted into the insertion hole 45. Further, for removing the lock pin 30 also from the lock pin insertion hole 40*b* distant from the key insertion hole 45, the adjusting cap 62 is loosened until the restricting portion T is moved away from the outer sleeve 61 beyond the predetermined amount, i.e. until the intermediate member 83 becomes disengaged from the screw portion at the longitudinally intermediate position of the cylindrical member 82, the insertion amount of the rack portion 63 into the insertion hole 45 is set to the second insertion amount. Then, under this condition, the engagement releasing key K is inserted into the insertion hole 45.

Figure 18:
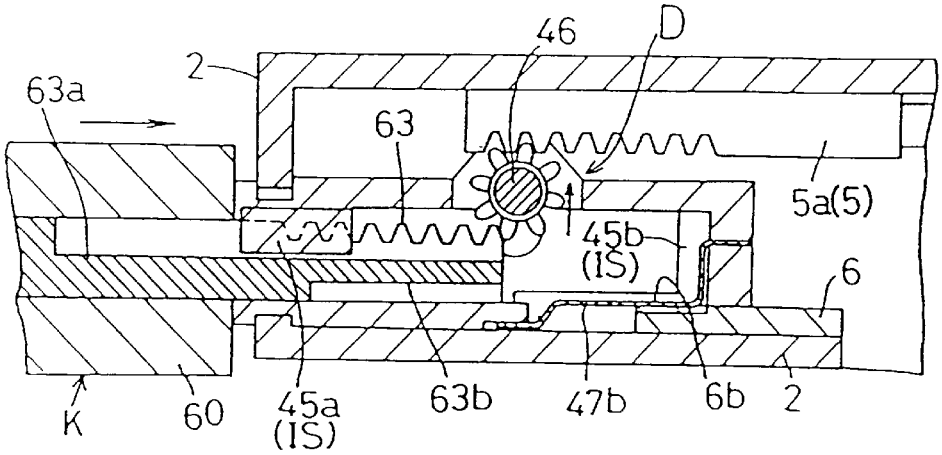
FIG. 18 is an enlarged view similar to that of FIG. 13, but with an engagement release key partially inserted into the key insertion hole.

When the rack portion 63 of the engagement releasing key K is inserted into the key insertion hole 45, as illustrated in FIG. 18, the leading end of the rack portion 63 pushes up the pinion gear 46 into engagement with the rack portion 5*a* of the slider 5. When the rack portion 63 is further inserted, as illustrated in FIG. 19, the rack portion 63 of the engagement releasing key K comes into engagement with the pinion gear 46, so that the pinion gear 46 is rotated in association with the insertion of the rack portion 63. With this rotation of the pinion gear 46, the slider 5 having the rack portion 5*a* meshing with the pinion gear 46 is moved in the direction of an arrow B in FIGS. 9 and 19.

Referring to the amount of this movement of the slider 5, the insertion amount of the rack portion 63 when the adjusting cap 62 of the engagement releasing key K is tightened is set so that the first pressing portion 5*d* of the slider 5 contacts the end 41*b* of the lock spring 41 but the second pressing portion 5*e* and the end 42*b* of the lock spring 42 do not yet contact with each other.

Figure 9:
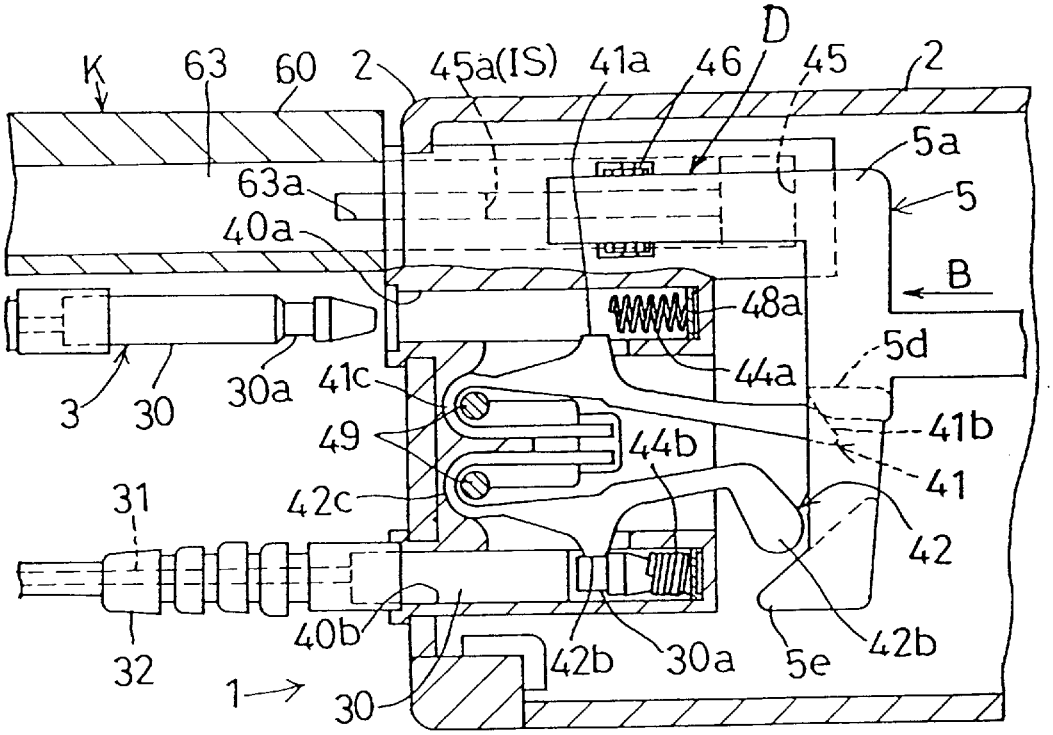
FIG. 9 is similar to FIG. 7 with a releasing key inserted into the insertion hole of the box.

When the first pressing portion 5*d* pushes the end 41*b* of the lock spring 41 in association with the sliding movement of the slider 5, as shown in FIG. 9, the convex portion 41*a* of the lock spring 41 is pivoted away from the lock pin insertion hole 40*a*. In this manner, the engagement between the engaging concave portion 30*a* of the lock pin 30 and the convex portion 41*a* of the lock spring 41 is released.

As a result, the lock pin 30 inserted into the lock pin insertion hole 40*a* is pushed out by the urging force of the coil spring 44*a,* thus the lock pin 30 is disengaged from the lock pin insertion hole 40*a*.

When the rack portion 63 of the engagement releasing key K is inserted into the key insertion hole 45, as illustrated in FIG. 19, the rack portion 63 comes into contact with the pair of reset terminals 47*a,* 47*b*. As the rack portion 63 is made of conductive material, as the rack portion 63 as a conductive portion comes into contact with the pair of reset terminals 47*a,* 47*b,* the reset switch R of FIG. 5 is closed. As a result, with activation of the power supply retaining circuit VK, the power supply from the battery V to the respective circuits of FIG. 5 is stopped, and the alarm output means AO is rendered inoperative. Accordingly, the reset switch R functions as alarm releasing means R for rendering the alarm output means AO inoperative.

From the condition in which the lock pin 30 has been withdrawn from the lock pin insertion hole 40*a,* for withdrawing also the lock pin 30 inserted into the lock pin insertion hole 40*b* for e.g. replacement of the wire unit 3, the rack portion 63 of the engagement releasing key K with the adjusting cap 62 being loosened in the afore-described manner is inserted into the key insertion hole 45.

As the adjusting cap 62 has been loosened, the rack portion 63 is inserted into the key insertion hole 45 by the long distance, so that the amount of sliding movement of the slider 5 in the direction of arrow B in FIG. 9 is greater than the case when the adjusting cap 62 is tightened. Consequently, the second pressing portion 5*e* of the slider 5 and the end 42*b* of the lock spring 42 now come into contact with each other, which do not contact with each other in the case of inserting the engagement releasing key K with the adjusting cap 62 being tightened.

Figure 10:
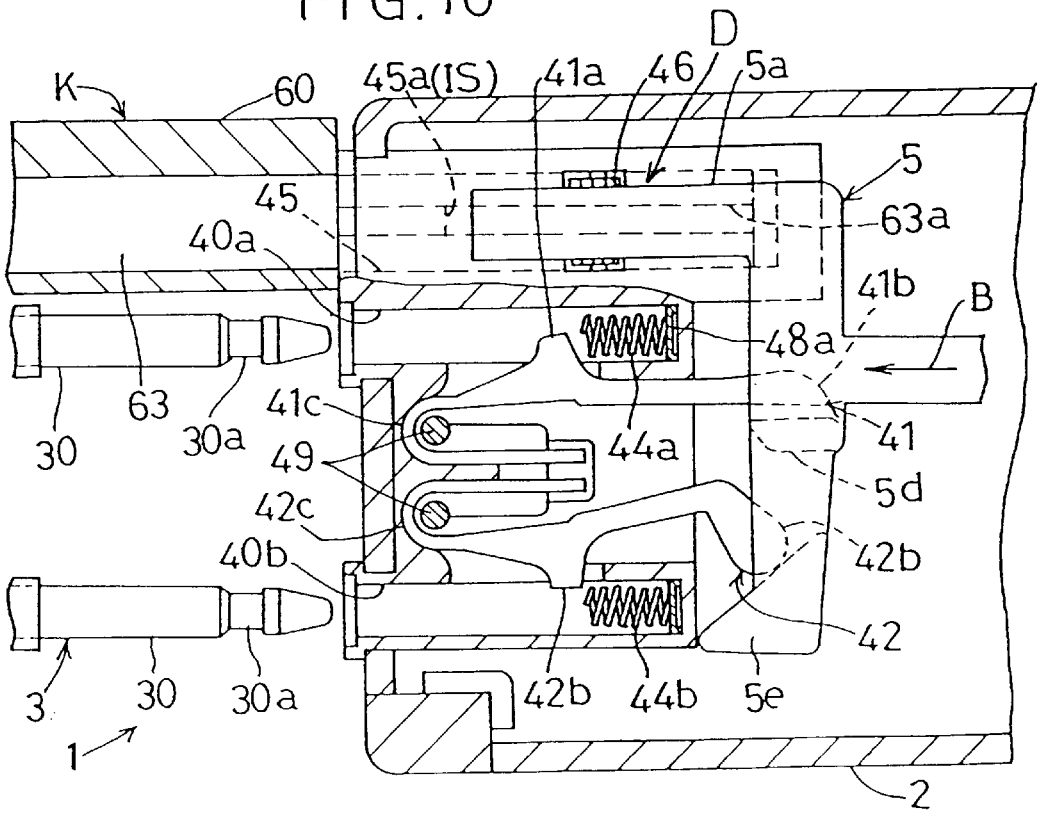
FIG. 10 is a view similar to that of FIG. 9, but with both lock pins removed from the box.

When the second pressing portion 5*e* pushes the end 42*b* of the lock spring 42, as shown in FIG. 10, the convex portion 42*a* of the lock spring 42 is pivoted away from the lock pin insertion hole 40*b*. In this manner, the engagement between the engaging concave portion 30*a* of the lock pin 30 and the convex portion 42*a* of the lock spring 42 is released. Incidentally, FIG. 10 illustrates the operations following the withdrawal of the lock pin 30 from the lock pin insertion hole 40*a*. The subsequent operation after the two lock pins 30 have been inserted is effected from the condition illustrated in FIG. 9.

As a result, the lock pin 30 inserted in the lock pin insertion hole 40*b* is pushed out by the urging force of the coil spring 44*b,* whereby the lock pin 30 is withdrawn from the lock pin insertion hole 40*b*.

Next, further embodiments will be described specifically.

Figure 23A:
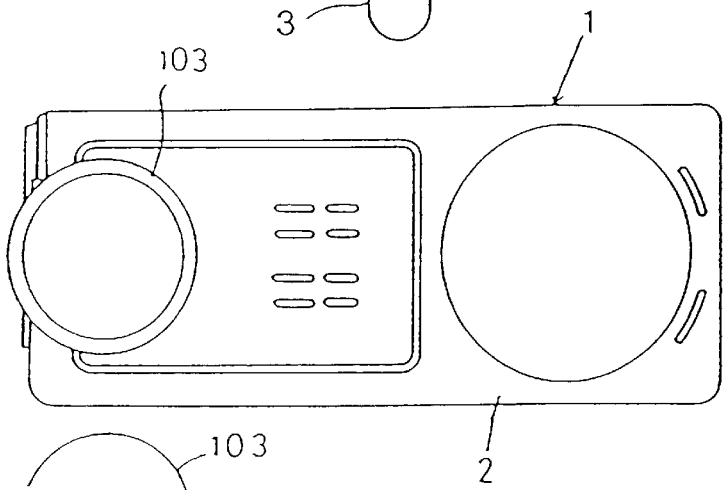
Figure 23B:
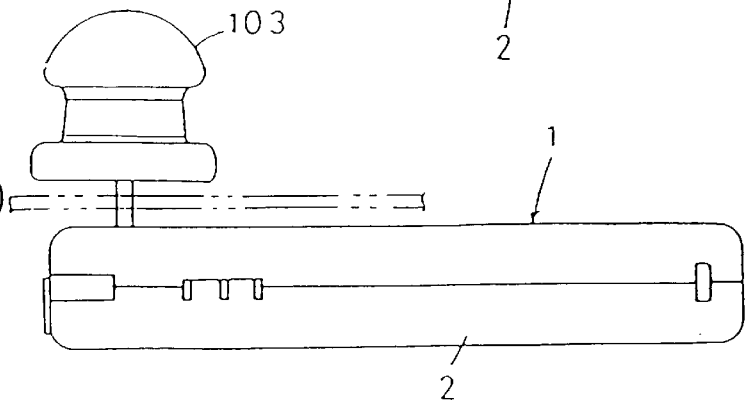

(1) In the foregoing embodiment, the present invention is applied to the construction in which the sensor tag 1 is attached to the object of theft prevention via the wire unit 3. Instead, as shown in FIG. 23(*a*) and FIG. 23(*b*), a further construction is possible in which a pin 103 is inserted into the box 2 via a cloth or the like as the object of theft prevention. In this case, in association with the insertion of the pin 103 into the box 2, the detecting switch SW is closed and with this closure of the detecting switch SW the power supply from the battery V to the respective circuits will be initiated.

Figure 24:
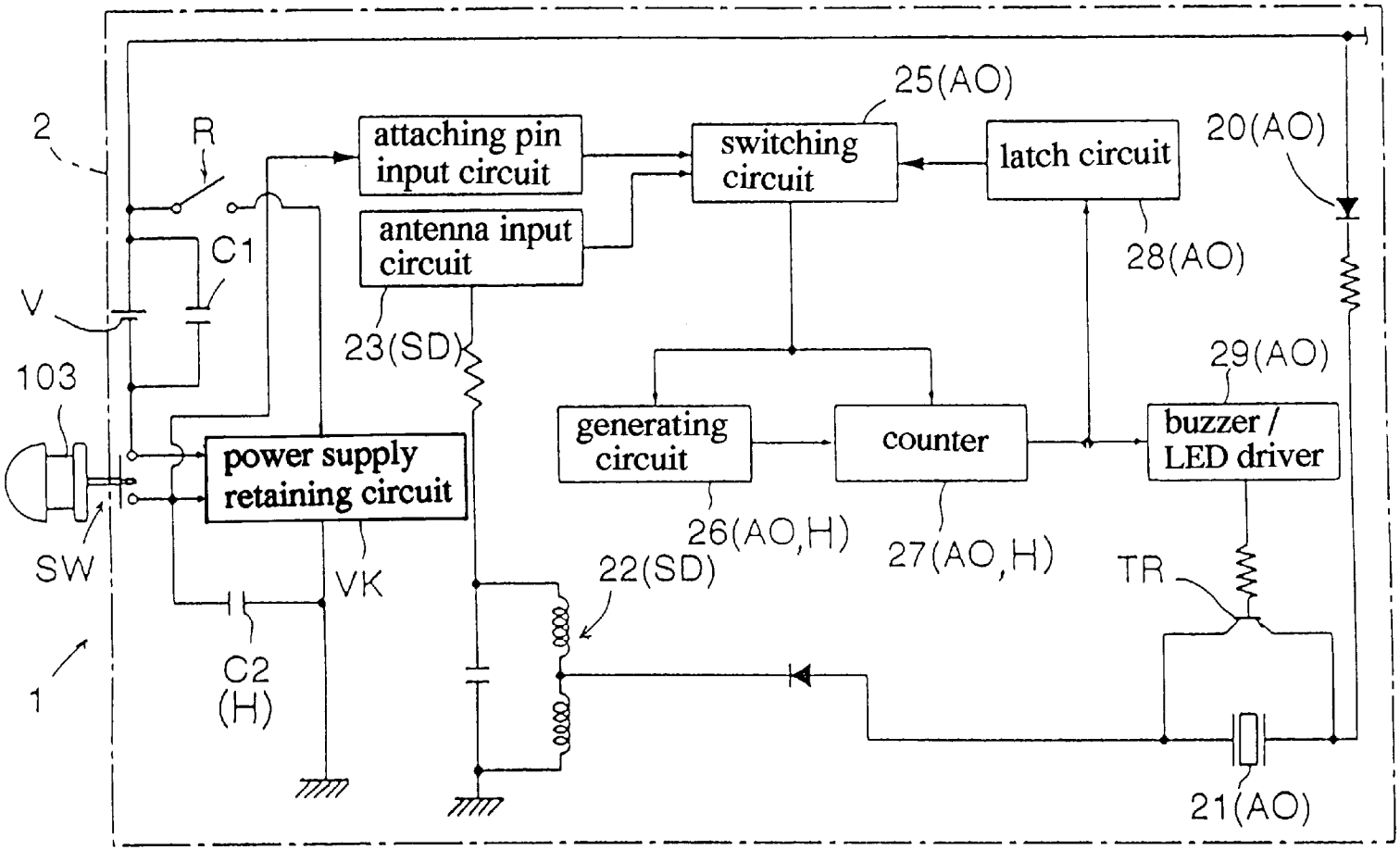
FIG. 24 is a circuit construction diagram relating to the embodiment of FIG. 23, FIGS. 25(*a*), (*b*) are side views in vertical sections of an engagement releasing key used in the embodiment of the present invention, FIGS. 26(*a*), (*b*) are side views in vertical sections of an engagement releasing key used in the embodiment of FIG. 24.

In such construction too, as shown in FIG. 24, the circuitry construction may be substantially same as that shown in FIG. 5. So that, in association with the insertion of the pin 103 into the box 2, the detecting switch SW is closed and with this closure of the detecting switch SW the power supply from the battery V to the respective circuits will be initiated.

A still further construction is possible as follows. In this case, without providing the wire unit 3, the pin 103 or the like, the detecting switch will be provided in such a manner as to project to the outside from the sensor tag 1. When the sensor tag 1 comes into contact with the object of theft prevention, a detecting piece of this detecting switch is depressed, thereby to detect the attached condition. In this case, the sensor tag 1 will be attached to the object of theft prevention and under this condition these will be fixed by being wrapped with e.g. a film sheet.

(2) In the foregoing embodiment, the alarm output means AO outputs the alarm information by means of illumination of the LED lamp 20 and generation of alarm sound from the piezoelectric buzzer 21. A further construction is possible in which an alarm radio wave is transmitted as alarm information. And, this radio wave is received by a receiver installed at a certain site inside a shop, whereby an alarm sound is issued. As a further conceivable construction, the generation of the alarm sound may be displayed by displaying means to be monitored in a central monitor room.

(3) In the foregoing embodiment, the alarm releasing means is rendered into the alarm releasing state when the pair of reset terminals 47*a,* 47*b* are short-circuited. Instead, the alarm releasing means may be constructed such that the reset switch R is turned ON/OFF in mechanical association with insertion of the engagement releasing key K into the key insertion hole 45.

Figure 30A:
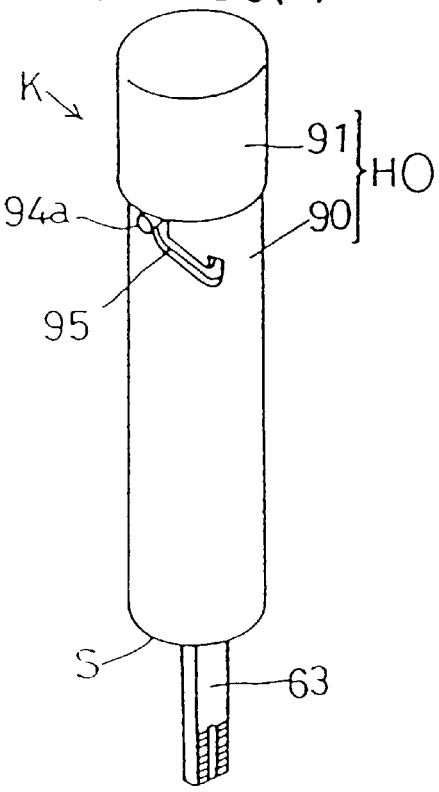
Figure 30B:
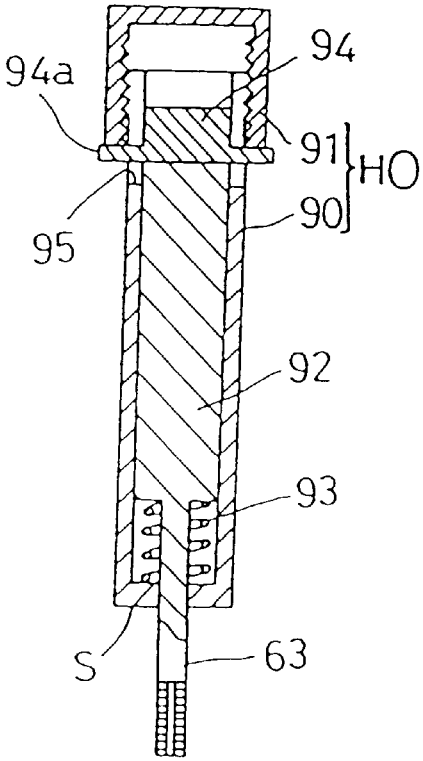
Figure 31A:
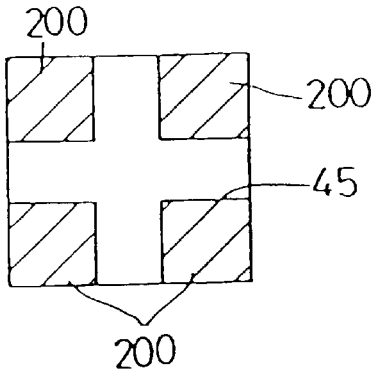
Figure 31B:
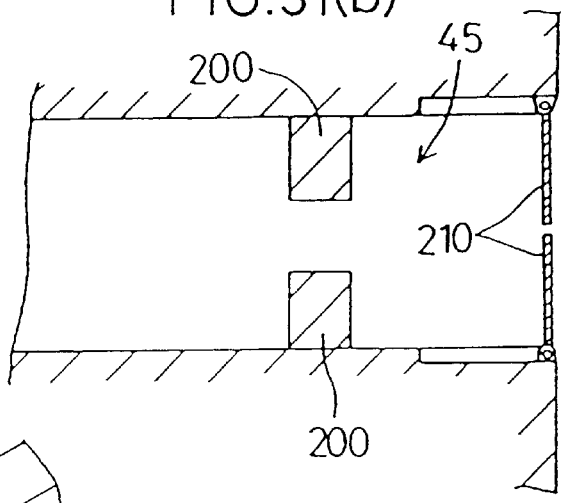
Figure 31C:
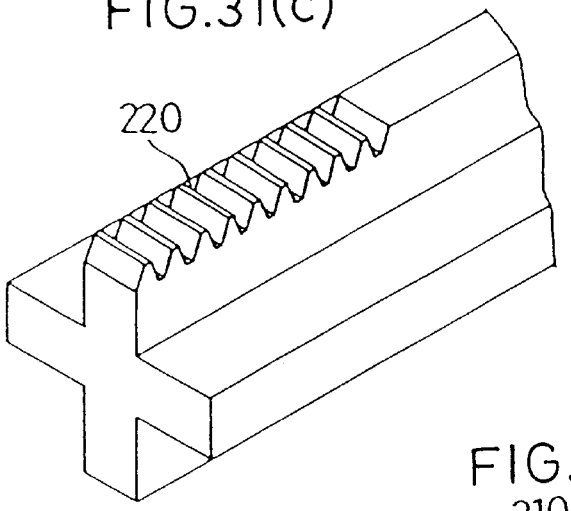
Figure 31D:
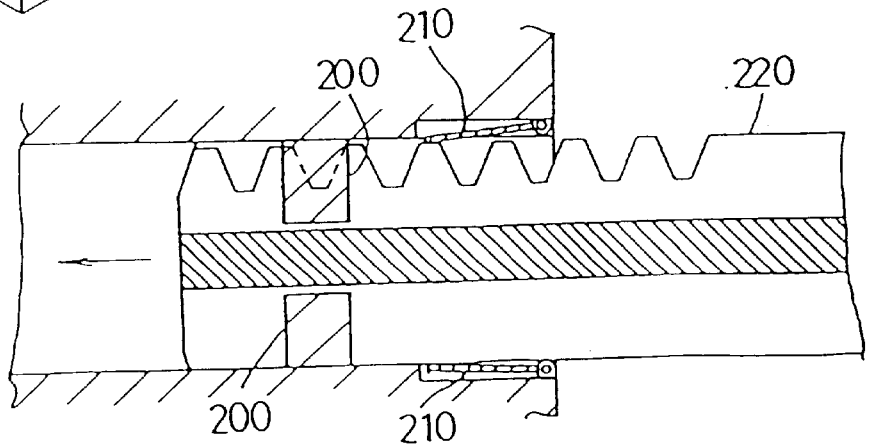

(4) In the foregoing embodiment, as the engagement releasing tool K, there has been described the construction in which the rack portion 63 is covered by the inner sleeve 60. Instead, the tool may be embodied in any other manner. One such example will be described next with reference to FIG. 30. FIG. 30(*a*) is a perspective view of an engagement releasing tool and (*b*) is a front view in vertical section. There is provided a body portion HO consisting of a cylindrical member 90 and a lid member 91 threaded with a base end of the cylindrical member. Further, at a lower face portion of this body portion HO, there is formed a contact portion (s) for contacting the box 2. Inside the body portion HO, there is provided a shaft member 92 having a rack portion 63 at a leading end thereof, with the shaft member being slidable and also urged inwardly by means of a coil spring 93. Further, there is provided a restricting member 94 for limiting the retracting movement of the shaft member 92, with the restricting member being slidable and also pressed by the shaft member 92. The restricting member 94 includes, with 180 degree phase difference therebetween, shaft-like projecting portions 94*a* projecting radially. The cylindrical member 90 defines guide groove 95 in which the projections 94*a* are inserted and guided. The guide groove 95 has a U-shaped configuration having opposed holding portions. Then, depending on which of these holding portions the projection 94*a* is to be located, the projection amount of the rack portion 63 from the contact portion (s) is adjusted. That is to say, the projection amount adjusting portion W is constituted from the projections 94*a* and the guide grooves 95.

Incidentally, one end of the guide groove 95 is opened at the upper end of the cylindrical member, thereby to allow fitting of the projection 94*a* into the guide groove 95. And, at the opened one end of the guide groove 95, the bottom face of the lid member 91 receives and supports the projecting portion 94*a*.

(5) In the foregoing embodiment, the insertion preventing means IS is comprised of the two blocking walls 45*a,* 45*b*. Instead, this may be comprised of an insertion preventing wall 200 having a cross sectional shape shown in FIG. 31(*a*) as viewed along the longitudinal direction of the key insertion hole 45.

Though not shown in FIG. 31, the insertion preventing wall 200 is disposed between the entrance opening of the key insertion hole 45 and the pinion gear 46. And, as shown in FIG. 31(*b*), at the entrance opening of the key insertion hole 45, there are provided door members 210 which are pivotally opened and closed at the center thereof and also are urged to the closed side, so as to make it difficult to observe the shape of the insertion preventing wall 200 from the outside.

As the engagement releasing key K, as shown in FIG. 31(*c*), there is provided a bar-like engagement releasing tool having a cross-shaped cross section matched with the shape of the insertion preventing wall 200. Then, when the rack portion 220 is inserted into the key insertion hole 45, as shown in FIG. 31(*d*), the inserted rack portion presses and opens up the door members 210 and passes through the position of the insertion preventing wall 200 and then rotatably drives an unillustrated pinion gear 46.

(6) In the foregoing embodiment, the insertion preventing means IS is comprised of the two blocking walls 45*a,* 45*b* fixedly provided to the inner wall of the key insertion hole 45. Instead, the blocking walls may be provided to be retractable into the inner wall of the key insertion hole 45. Then, when the blocking walls are retracted with a fake operating tool comes into the blocking walls, this retraction is detected and binding elements binding the fake operating tool are caused to project into the key insertion hole 45, thereby to prevent insertion of the fake operating tool into the key insertion hole 45.

(7) In the foregoing embodiment, as the insertion preventing means IS, two blocking walls 45*a,* 45*b* are provided. Instead, only one or more than three of them may be provided.

(8) In the foregoing embodiment, as the specific construction of the auxiliary power supplying means Va, a power supplying capacitor C1 was employed. But, the specific construction of the auxiliary power supply means may vary in many ways. For instance, a rechargeable battery may be employed.

(9) In the foregoing embodiment, as the battery V, a button battery was employed. But, the specific kind and shape of the battery V may vary in many ways. Also, the fitting construction for fitting the battery V in the box 2 and also the electrical connecting construction between the battery V and the circuit board 6 too may vary in many ways, depending on the kind and shape of the battery V.

(10) In the foregoing embodiment, the preliminary act detecting means SD includes an attachment tool (the wire unit 3 or the like) and the attachment/detachment detecting switch SW and outputs, as the preliminary stealing act detection information, the detachment detection signal indicating detachment of the attachment tool from the box 2; and also the preliminary act detecting means SD includes the antenna 22 to output an antenna reception signal as the preliminary stealing act detection information. But, the preliminary act detecting means SD is not limited to these constructions.

(11) In the foregoing embodiment, the checking means H is comprised of the delaying capacitor C2, the generating circuit 26 and the counter 27. But, the checking means is not limited thereto. Instead of this, the checking means may be comprised of any other hard-ware circuit or may be comprised of e.g. a calculating unit such as a microcomputer for providing the function through a soft ware.

(12) In the foregoing embodiment, the radio wave receiving antenna incorporated in the preliminary act detecting means SD is comprised of the resonance antenna 22. The invention is not limited thereto, and various kinds of antenna may be employed.

(13) In the foregoing embodiment, there was described an application in which the theft preventive apparatus (sensor tag) is used in combination with a transmitter. Instead, without providing any transmitter, the object of theft prevention may be connected with a predetermined fixed position via the theft preventive apparatus, such that alarm information will be outputted if the connection to the fixed position by the theft preventive apparatus is released by e.g. withdrawal of the attachment tool or cutting off in an attempt to unlawfully take out the object of theft prevention.

(14) The construction of the conductive spring, constituting the present invention, which is contacted and pressed by an end of the connecting portion inserted into an insertion hole for attachment tool connection thereby to be retracted toward the longitudinally depth side in the insertion hole is not particularly limited. For instance, this may be a plate spring.

Figure 2:
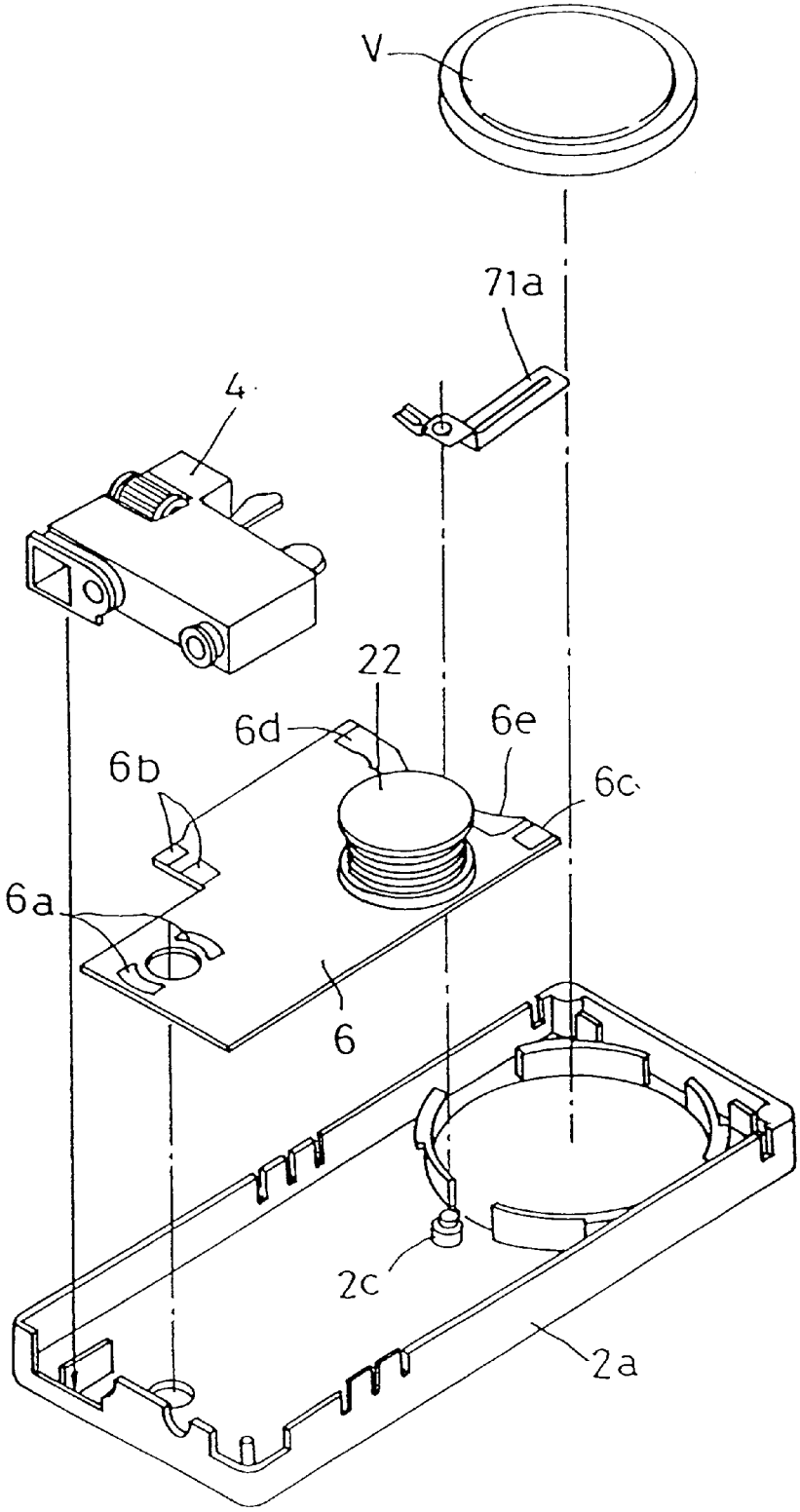
FIG. 2 is an exploded perspective view of a bottom case portion of a box relating to the embodiment of FIG. 1.
Figure 3:
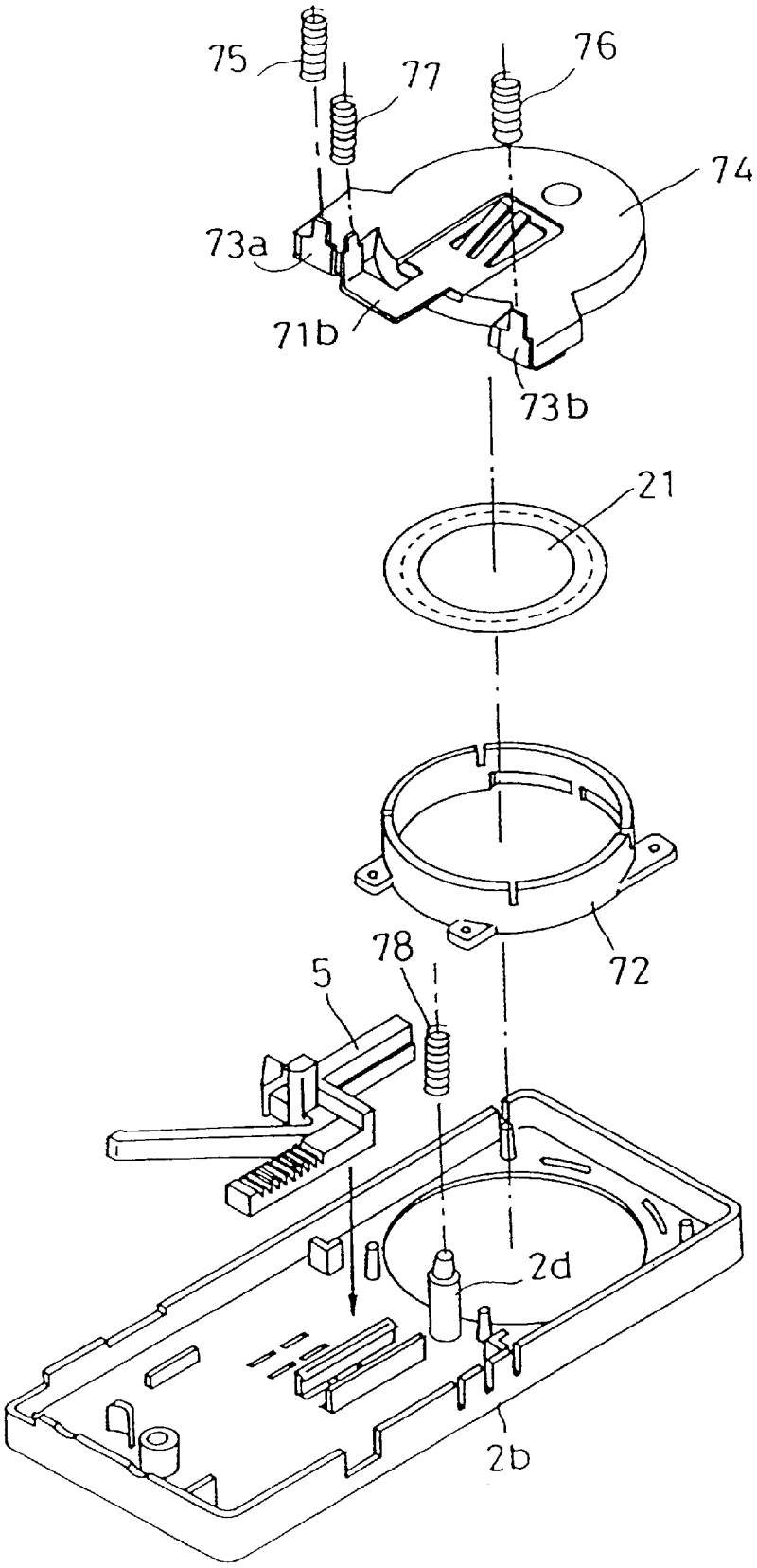
FIG. 3 is an exploded perspective view of a top case portion of the box relating to the embodiment of FIG. 1.

(15) In the foregoing embodiment, the booster circuit for boosting the voltage pulse to be applied to the piezoelectric buzzer 21 was constructed as shown in FIG. 2. Instead, this may be constructed also as shown in FIG. 32 or FIG. 33.

Figure 32:
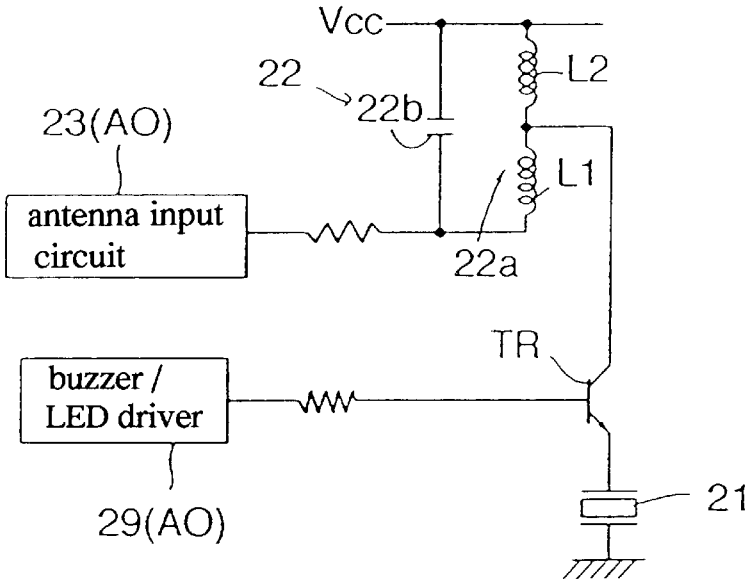
FIG. 32 is a construction diagram of a booster circuit relating to a still further embodiment of the present invention.
Figure 33:
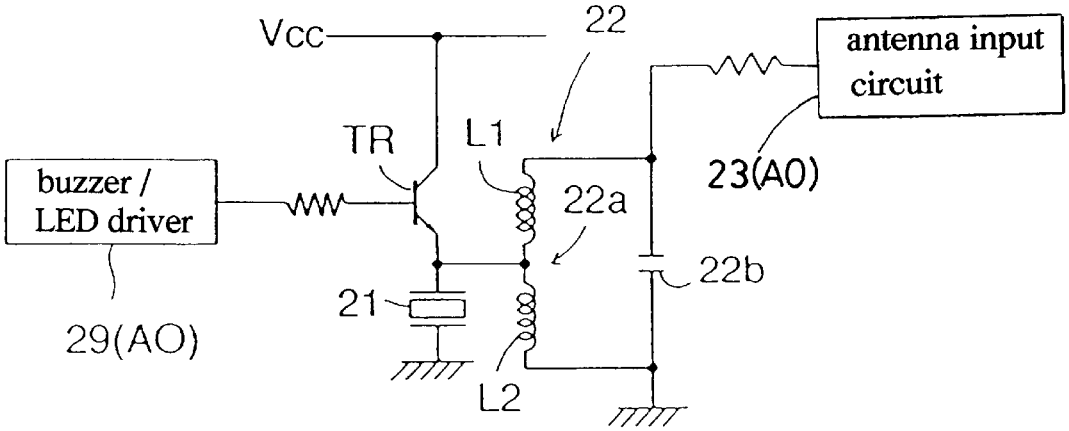
FIG. 33 is a construction diagram of an alternative to the booster circuit of FIG. 32.

In FIG. 32 or FIG. 33, only those portions relating to the booster circuit are shown.

In the case of a booster circuit shown in FIG. 32, a coil L2 constituting a part of the coil 22*a* of the resonance coil 22 and the piezoelectric buzzer 21 together form a serial resonance circuit, thereby to boost the voltage pulse to be applied to the piezoelectric buzzer 21.

In the case of the circuit shown in FIG. 32, the resonance antenna 22 is connected to the Vcc side, i.e. the positive terminal of the battery V, the antenna input circuit 23 detects the sound generation instruction radio wave from the transmitters O when the signal from the resonance antenna 22 becomes lower than the predetermined voltage.

In the case of the circuit shown in FIG. 33, the coil L2 constituting a part of the coil 22*a* of the resonance antenna 22 and the piezoelectric buzzer 21 together constitute a parallel resonance circuit, thereby to boost the voltage pulse to be applied to the piezoelectric buzzer 21.

(16) In the foregoing embodiment, the booster circuit is constructed with utilizing a portion of the coil 22*a* of the resonance antenna 22. Instead, the booster circuit may be constructed with utilizing the entire coil 22*a*.

(17) In the foregoing embodiment, as an example of an electrically capacitive buzzer, the piezoelectric buzzer 21 was described. Instead, various kinds of electrostatic type speaker may be employed as a buzzer.

(18) In the foregoing embodiment, the coil 22*a* of the resonance antenna 22 is wound about the thickness-wise axis of the box 2 having a flat rectangular shape. In addition to this resonance antenna 22, a further resonance antenna having a coil wound about an axis extending normal to the thickness direction may be provided also, so as to be effectively detect a sound generation instructing radio wave from various directions.

Figure 34:
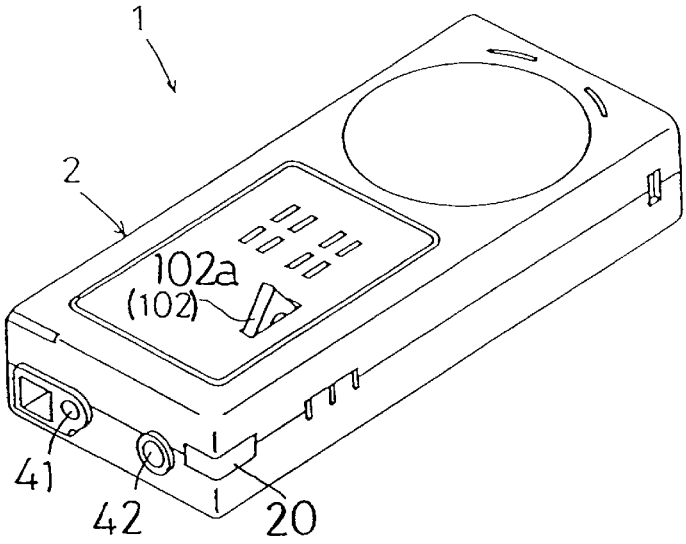
FIG. 34 is a perspective view of a sensor tag relating to a still further embodiment of the present invention.

(19) As shown in FIG. 34, the sensor tag 1 may includes an operating portion 102 for the attachment/detachment detecting switch (not shown) provided inside the box 2, with the portion 102 being urged to return to project from the surface of the box 2 and this sensor tag 1 will be placed in pressed contact with the surface of the object of theft prevention such as a book, with the tag and the object of theft prevention being wrapped together. In this case, if the sensor tag 1 is detached from the object of theft prevention, the operating portion 102 is caused to project to activate the attachment/detachment switch, whereby a detachment detection signal is outputted.

Namely, this sensor tag 1 has a rectangular shape, and is attached to the object of theft prevention. Then, under this condition, the sensor tag and the object are wrapped together with e.g. a film sheet to be fixed to each other. Under the attached condition, the detecting piece 102*a* of the detecting switch 102 as the outwardly projectable operating portion is depressed, whereby the attached state is detected. Then, when this sensor tag 1 is detached from the object of theft prevention by a preliminary stealing act, the condition of the detecting piece 102*a* of the detecting switch 102 is changed from the depressed condition to the outwardly projecting condition, so that this preliminary stealing act may be detected. And, in association with detection of such preliminary stealing act, the LED lamp 20 is illuminated and the buzzer generates an alarming sound.

Figure 35:
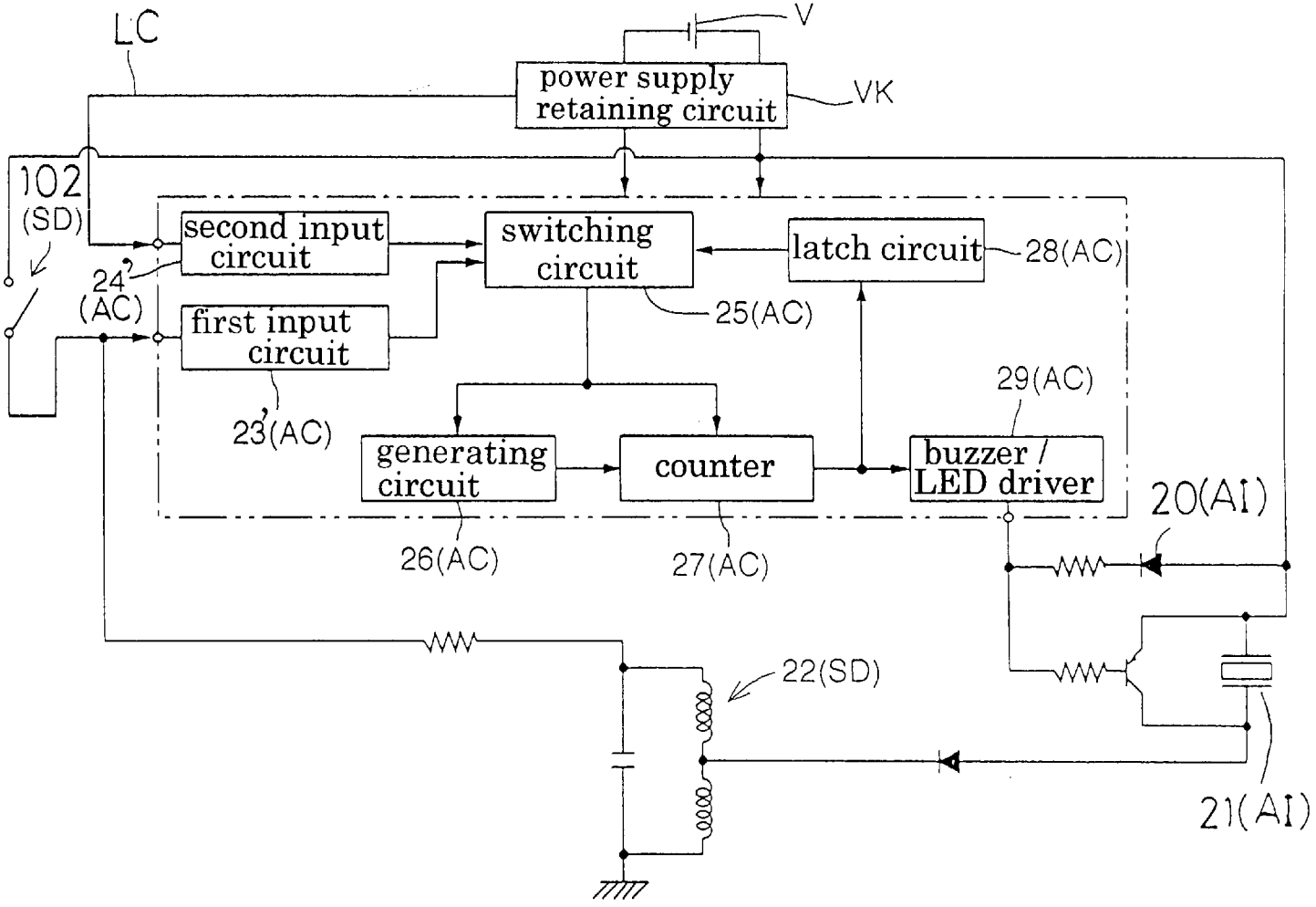
FIG. 35 is a circuit block diagram of a theft preventive apparatus relating to the embodiment of FIG. 34.

To describe in greater details, as shown in FIG. 35, inside the box 2, there are provided, the LED lamp 20, the piezoelectric buzzer 21, a resonance antenna 22 comprised of a coil and a capacitor, a detecting switch 102 which is turned ON with detection of detachment of the box from the object of theft prevention, a first input circuit 23' for outputting a reception signal when the resonance antenna 22 is rendered into the receiving state or when the detecting switch 102 is turned ON, a second input circuit 24' for outputting a stop signal due to cut-off of a wire in the construction to be described later in which the attachment to the object of theft prevention is effected by means of a wire as an attachment tool, a switching circuit 25 for outputting a control signal when receiving the reception signal from the first input circuit 23' or the stop signal from the second input circuit 24', a generating circuit 26 which starts generating pulses when receiving the control signal from the switching circuit 25, a counter 27 which starts counting the number of pulses generated by the generating circuit 25 when receiving the control signal from the switching circuit 25 and which outputs a count completion signal when the count number of pulses exceeds a predetermined count number, a latch circuit 28 for maintaining the switching circuit 25 at the condition at the time of input of the reception signal or the stop signal in response to input of the count completion signal from the counter 27, a driver 29 for illuminating the LED lamp 20 and sounding the piezoelectric buzzer 21 when receiving the count completion signal from the counter 27, a battery V for supplying power to the respective circuits inside the box 2, and a power supply retaining circuit VK as an electrical retaining circuit constituting a retaining means for starting power supply from the battery V to the respective circuits by connecting the negative terminal of the battery V to the ground terminals of the respective circuits in association with turning-ON of the power switch SW and retaining the power supply, once the power supply has been started, unless the reset switch R as alarm releasing means is closed.

Incidentally, the circuits other than the power supply retaining circuit VK, i.e. the first and second input circuits 23', 24', the switching circuit 25, the generating circuit 26, the counter 27, the latch circuit 28 and the driver 29 are comprised respectively of an integrated circuit (IC).

Figure 36:
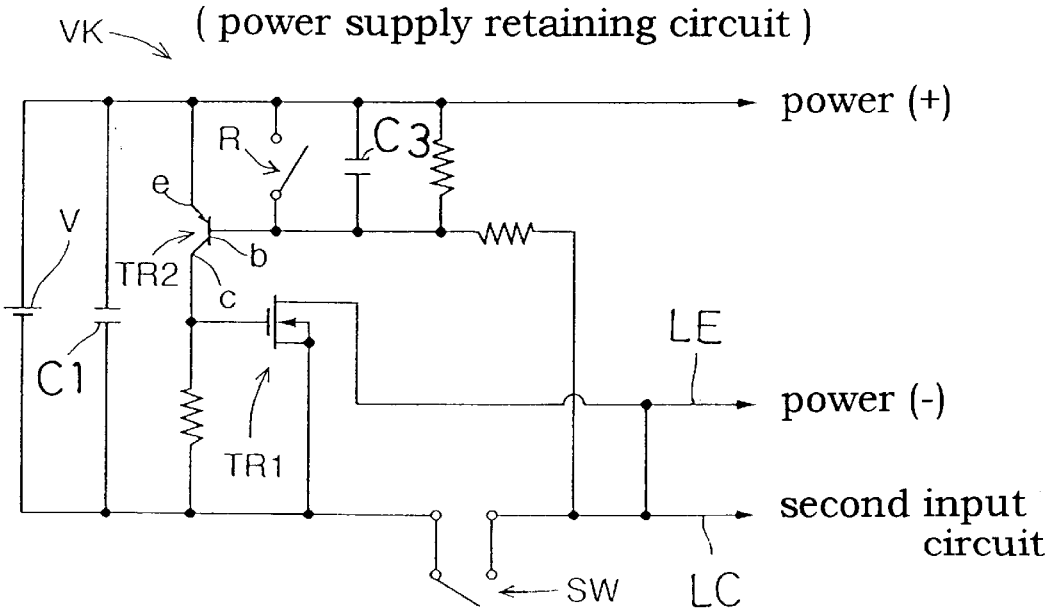
FIG. 36 is an electric circuit diagram of a power retaining circuit in the circuit diagram of FIG. 35, FIGS. 37(*a*) and 37(*b*) are partial top and side cross sectional views of the embodiment of FIG. 34 with the contact spring separated from the terminals on the circuit board, FIGS. 38(*a*) and 38(*b*) are similar to FIGS. 37A and 37B, but with the setting button pin moved to the right causing the contact spring to contact the contacts on the circuit board, FIG. 39(*a*) is a top view of the setting button pin of FIG. 37(*a*), FIG. 39(*b*) is a cross sectional view of the setting button pin of FIG. 39(*a*)

The power supply retaining circuit VK, as shown in FIG. 36, includes such components as a MOSFET type switching transistor (an example of power supply retaining switching means) switchable between a state for connecting the negative terminal of the battery V with the ground terminals (−) of the respective circuits and a further state for disconnecting the same from each other, and an activating transistor TR2 for activating this switching transistor TR1 into the conductive state in response to switch-ON of the power switch SW. The activating transistor TR2 has its emitter terminal (e) thereof connected with the positive terminal of the battery V and its collector terminal connected with the negative terminal of the battery V. And, the reset switch R is interposed between the base terminal (b) and the emitter terminal (e), and the power switch SW is interposed between the base terminal (b) and the negative terminal of the battery V.

Incidentally, the connecting portion between the power switch SW and the base terminal (*b*) and the input terminal of the second input terminal 24' are connected via a connection line LC. However, this construction is employed in the case of wire type preliminary act detecting construction to be described later. Whereas, in the case of the construction detecting a preliminary stealing act by means of the detecting switch 102 described above, the above construction has following problems. Therefore, the connection line LC and a ground line LE (as an example of power supply line) are connected under zero resistance condition.

That is to say, the second input circuit 24' is constructed such that the circuit is rendered into the detecting state when a predetermined potential difference is developed relative to the ground potential. And, in synchronism with switching-ON of the power switch SW, the second input circuit 24' is put under the ground potential. At this time, there occurs a slight delay until the switching transistor TR1 is turned ON after the switching transistor TR2 is turned ON. Then, until this delay period lapses, the power (−) is placed under a floating condition, whereby a potential difference may be developed and alarm information may be erroneously outputted at the same time as the switching-ON of the switching transistor TR1. For this reason, by placing the input terminal of the second input circuit 24' under the same potential as the power (−), such inconvenience is avoided.

In the power supply retaining circuit VK, between the base terminal (b) (an example of activation instruction portion) and the emitter terminal (e) of the activating switching transistor TR2, there is connected a capacitor C3 for absorbing surge voltage (an example of noise preventing means). Namely, for example, when the power switch SW is not ON, if static electricity may be applied via the reset switch R from a human body or any other external object, thereby to erroneously turn ON the switching transistor TR2, or due to a strong shock such as drop onto a floor, an electromotive force may be developed in the piezoelectric buzzer 21 due to its piezoelectric effect, and this voltage may be applied as a noise to the switching transistor TR2 for turning it ON. Then, by providing the capacitor C3, such inconveniences as above may be avoided, as the capacitor C3 can absorb such surge voltage (noise signal).

According to the above-described circuit construction, when the box 2 is attached to a commodity or the like, the piezoelectric buzzer 21 inside the box 2 generates a sound, in case the box 2 is detached from the commodity or in case the sensor tag 1 is carried past the installation site of the transmitters O as shown in FIG. 11 installed on opposed sides at an entrance/exit of a shop or the like.

The power switch SW and the reset switch R can be turned ON/OFF by inserting an operating key K having a special construction as shown in FIG. 16 from insertion holes 141, 142 so as not to be readily operated from the outside of the box 2.

Next, the construction of the power switch SW will be described.

Figure 37A:
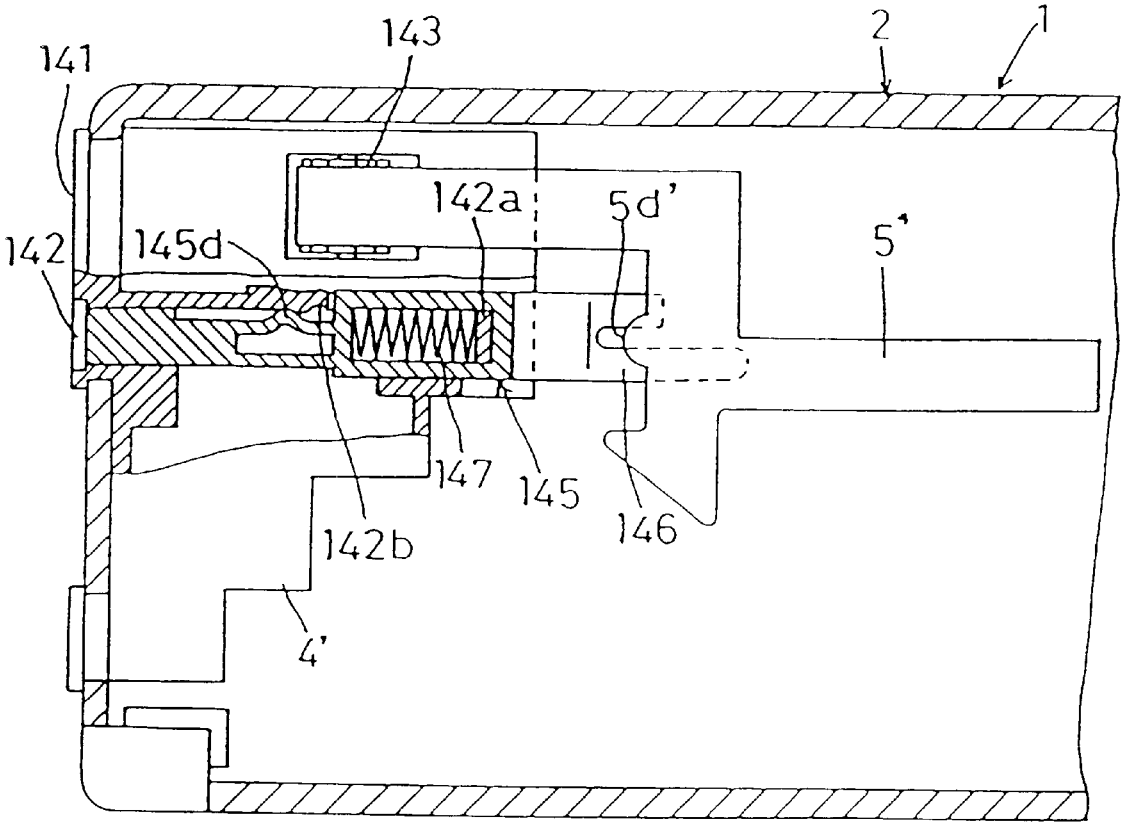
Figure 37B:
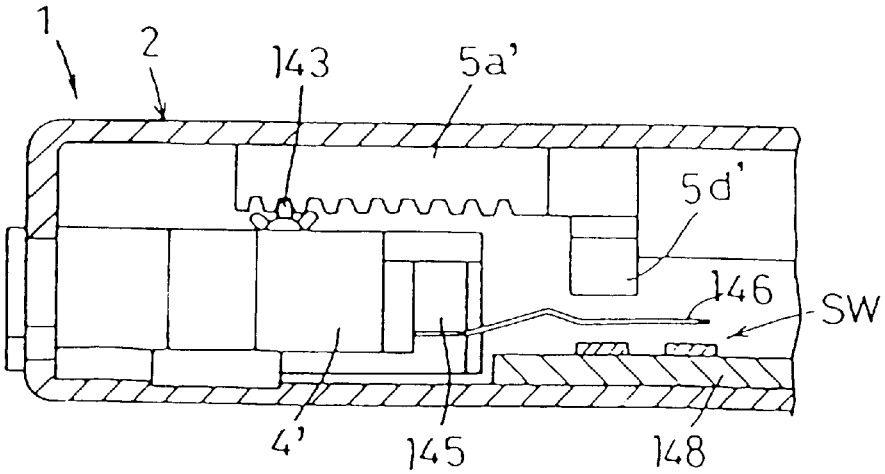

As shown in FIGS. 37(*a*), (*b*), there are provided the key insertion hole 141 into which the rack portion 63 of the operating key K is to be inserted and the setting button pin insertion hole 142 into which a projecting pin K2 of the operating key K is to be inserted. The setting button pin insertion hole 142 includes a setting button pin 145 slidable within the setting button pin insertion hole 142. And, at the terminal end of the setting button pin insertion hole 142, there is provided a metal contact spring 146 which is vertically pivoted by being pushed by the setting button pin 145.

Figure 39A:
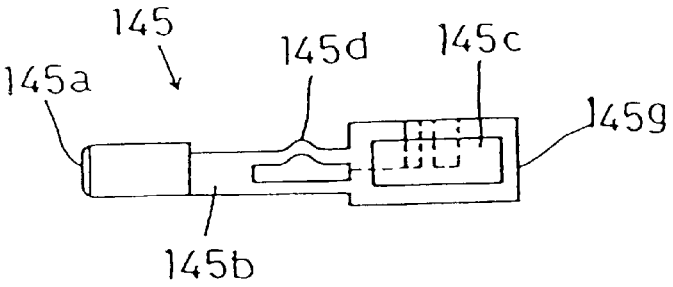
Figure 39B:
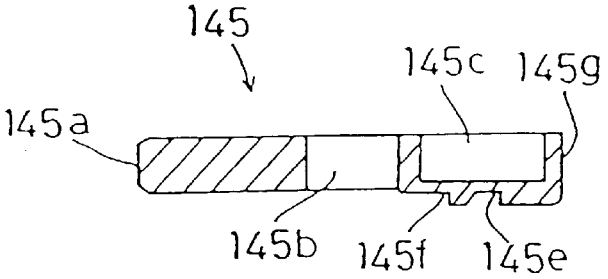
Figure 40:
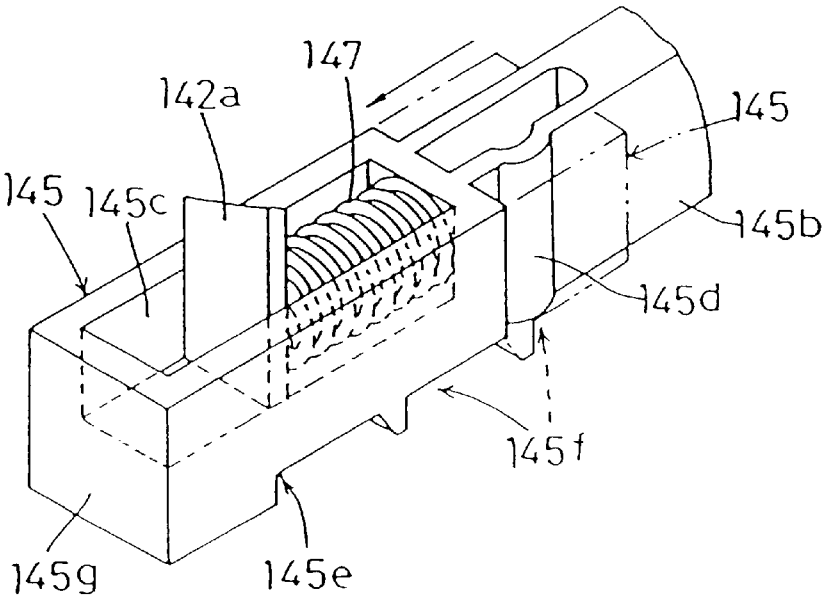
FIG. 40 is an isometric view of the setting button pin of FIG. 37(*a*)

The setting button pin 145, as shown in FIG. 39 and FIG. 40, includes an operated portion 145*a* to be pushed from the outside of the box 2, a positioning portion 145*b* for fixing the setting button pin 145 in position at a predetermined position inside the setting button pin insertion hole 142, a spring housing portion 145*c* for housing a coil spring 147 for urging the setting button pin 145 to return in the direction opposite to the inserting direction of the setting button pin 145, and an end portion 145*g* for pushing the contact spring 146 so as to vertically pivot the contact spring 146. And, at the bottom of the spring housing portion 145*c,* there are formed two engaging portions 145*e,* 145*f* disposed side by side along the sliding direction of the setting button pin 145, to which portions a movement checking spring (not shown) for the setting button pin 145 can be engaged.

Incidentally, FIG. 39(*a*) is a plan view of the setting button pin 145, and FIG. 39(*b*) is a section view of the setting button pin 145.

Within a space formed by the spring housing portion 145*c* and the inner wall of the setting button pin insertion hole 142, as shown in FIG. 40, there is formed a projecting portion 142*a* which projects from the inner wall of the setting button pin insertion hole 142 so as to check movement of the setting button pin 145 in the sliding direction.

Incidentally, as being interposed between the inner wall of the spring housing portion 145*c* and the projecting portion 142*a,* the coil spring 147 urges the setting button pin 145 to return in the direction opposite to the inserting direction of the setting button pin 145.

At the positioning portion 145*b* of the setting button pin 145, there is formed a positioning convex portion 145*d* having elasticity to be projectable and retractable in the projecting direction; and in the inner wall of the setting button insertion hole 142, there is formed an engaging concave portion 142*b* engageable with the positioning convex portion 145*d* when the setting button pin 145 is pushed.

When the setting button pin 145 is pushed, the end portion 145*g* of the setting button pin 145 comes into contact with the contact spring 146 thereby to vertically pivot the contact spring 146. With this pivotal movement, the free end of the contact spring 146 comes into contact with the circuit board 148, thereby to short-circuit the two terminals on the circuit board 148.

With this short-circuiting of the two terminals, power supply from the battery V to the respective circuits in the box 2 is effected. Hence, this contact spring 146 corresponds to the power switch SW in FIG. 36.

Figure 38A:
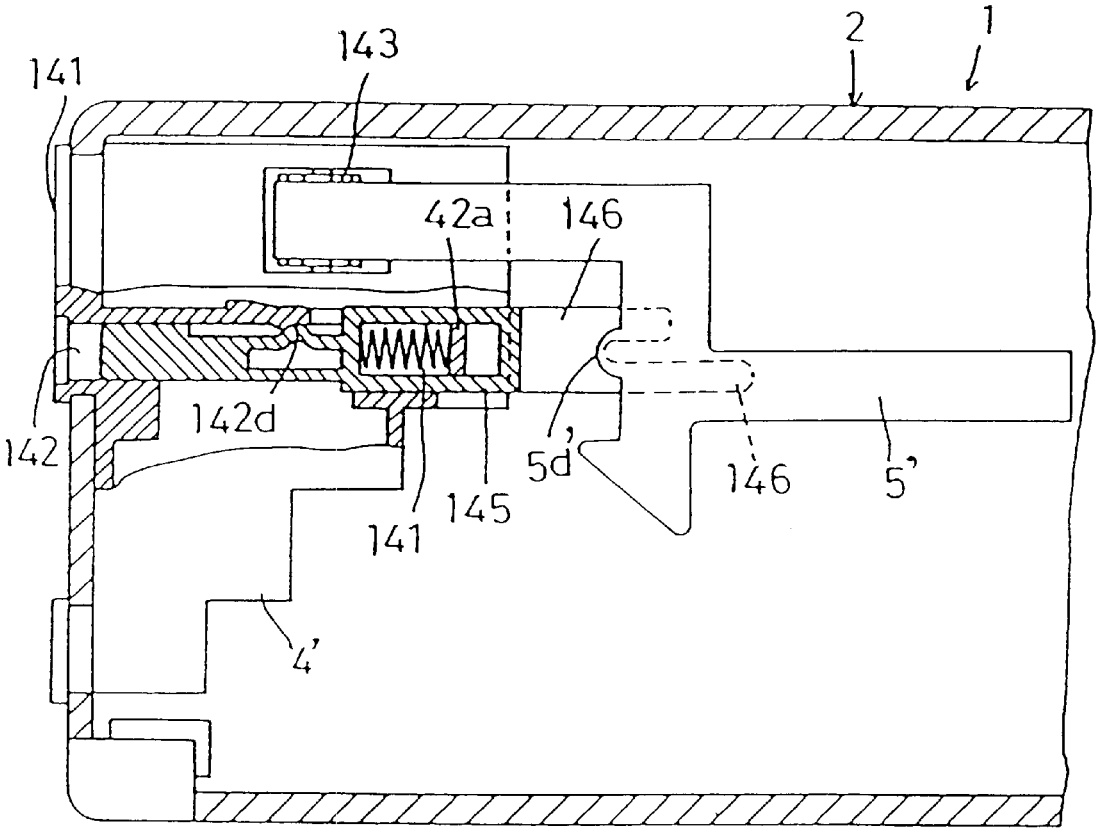
Figure 38B:
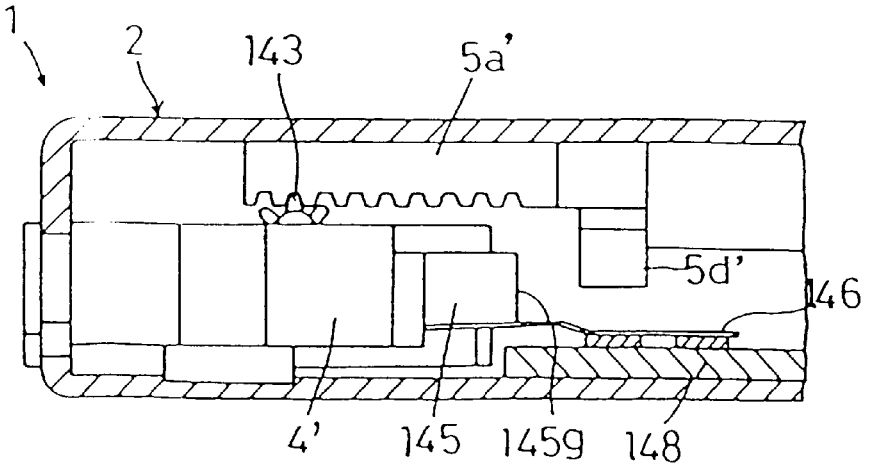

When the operated portion 145*a* of the setting button pin 145 inside the jack unit 4' is pushed in by means of the projecting pin K2 of the key K, as shown in FIGS. 38(*a*), (*b*), the end portion 145*g* of the setting button pin 145 comes into contact with the contact spring 146, thereby to pivot the contact pin 146 downwards. With this pivotal movement, the free end of the contact spring 146 comes into contact with the circuit board, thereby to short-circuit the two terminals on the circuit board.

With this, the power switch SW is turned ON to initiate power supply to the respective circuits. In this, as the setting button pin 145 is pushed in, the coil spring 147 is compressed to urge the setting button pin 145 to the outside of the box (the opposite direction to the inserting direction of the setting button pin 145). However, as the engaging convex portion 145*d* of the setting button pin 145 comes into engagement with the engaging concave portion 142*d* of the setting button insertion hole 142, the setting button pin is retained at the position against the urging force of the coil spring 147.

Incidentally, when the power switch SW is turned OFF, by inserting the rack portion 63 of the operating key K is inserted into the key insertion hole 141, the pinion gear 143 disposed inside the key insertion hole 141 meshes with the teeth of the rack 63 to be rotated thereby. In association therewith, the slider 5' having a rack portion 5*a'* meshed, at an upper portion thereof, with the pinion gear is slided in the opposite direction to the key inserting direction, thereby to push out the setting button pin 145 to the outside switch-OFF position. Incidentally, a mark 5*d'* denotes a pressing portion against which the end portion 145*g* of the setting button pin 145 comes into abutment in association with the sliding movement of the slider 5'.

The reset switch is constructed in the same manner as that of the afore-described wire type construction and therefore will not be described herein.

Next, the process until the piezoelectric buzzer 21 begins to generate a sound will be described briefly.

First, when this apparatus is not attached to the object of theft prevention (out-of-use condition), the power supply retaining circuit VK does not supply power to the other circuits. That is, with turning ON of the reset switch R, in the activating transistor TR2, the base (b) and the emitter (e) are placed under the same potential, thus the transistor is turned OFF. Hence, the switching transistor TR1 too is turned OFF, thereby to disconnect the negative terminal of the battery V from the ground terminals of the respective circuits.

Then, when the box 2 is attached to the object of theft prevention and the power switch SW is turned ON, the base (b) of the activating transistor TR2 is connected with the negative terminal of the battery V, whereby the activating transistor TR2 is turned ON and at the same time switching transistor TR1 too is turned ON, thereby to initiate power supply to the respective circuits.

When the reset switch R is turned ON, the base (b) of the activating transistor TR2 is connected with the positive terminal of the battery V, so that the activating transistor TR2 is forcibly turned OFF, and at the same time the switching transistor TR1 is turned OFF, thereby to stop the power supply to the respective circuits.

The first input circuit 23' outputs the reception signal to the switching circuit 25 in case detecting e.g. turning-ON of the detection switch 102 or when the resonance antenna 22 is resonated to be rendered into the receiving state.

While receiving the reception signal, the switching circuit 25 transmits the control signal to the generating circuit 26 and also to the counter 27. And, while receiving this control signal, the generating circuit 26 generates pulses and the counter 27 counts the number of pulses generated by the generating circuit 26. When the control signal is stopped, the generating circuit 26 stops the pulse generation and the counter 27 stops the counting and resets the pulse count number.

With each completion of counting of a pre-set number of pulses, the counter 27 transmits a single pulse signal as a counter completion signal to the latch circuit 26 and to the driver 29.

While receiving this count completion signals, the driver 29 sounds the piezoelectric buzzer 21 and also illuminates the LED lamp 20.

On the other hand, with reception of the count completion signal from the counter 27, the latch circuit 28 maintains the switching circuit 25 under the condition at the time of the reception of the reception signal, whereby the switching circuit 25 continuously transmits the control signal to the generating circuit 26 and to the counter 27.

That is, the driver circuit 29 sounds the piezoelectric buzzer 21 and illuminates the LED lamp 20, upon completion of the counting of the predetermined number of pulses by the counter 27 after the switching circuit 25 receives the reception signal. With this, the piezoelectric buzzer 21 and the LED lamp 20 are not activated unless the reception signal is continuously received for a predetermined time period, whereby erroneous activations due to noise or the like is prevented.

Also, once the counter 27 has transmitted the count completion signal, the switching circuit 25 keeps transmitting the control signal, regardless of presence/absence of the reception signal from the first input circuit 24'. Thus, until the reset switch R is closed, the piezoelectric buzzer 21 keeps generating the intermittent sound in synchronism with the count completion signal from the counter 27 and the LED lamp 20 keeps illuminating in synchronism with the count completion signal from the counter 27.

Incidentally, while the alarm is being issued by means of the LED lamp 20 and the piezoelectric buzzer 21, the positive or negative terminal of the battery V may be instantaneously detached from the connecting terminal due to application of shock to the box 2. In such case too, it is necessary to prevent the circuits in the box 2 from being reset to stop the alarm. For this prevention, a power supply capacitor C1 for auxiliary power supply is disposed parallel with the battery V. And, when the reset switch R is turned ON, the power supply is interrupted to stop the output of the alarm.

Accordingly, the resonance antenna 22 and the detecting switch 102 function as preliminary act detecting means SD for detecting a preliminary stealing act such as unlawful detachment of the sensor tag 1 from the object of theft prevention or attempt to unlawfully take out the object of theft prevention attached with the sensor tag 1 to the outside of the shop. And, the LED lamp 20 and the piezoelectric buzzer 21 function as alarm information output means AI for outputting alarm information in the form of light and sound, based on detection information of the preliminary act detecting means SD. The first input circuit 23', the switching circuit 25, the generating circuit 26, the counter 27, the latch circuit 28, the driver circuit 29 and so on function as alarm controlling means AC for operating the alarm information output means AI into the alarm information outputting state. Further, the reset switch functions as alarm releasing means for releasing the alarm activation state by the alarm controlling means AC.

Figure 41:
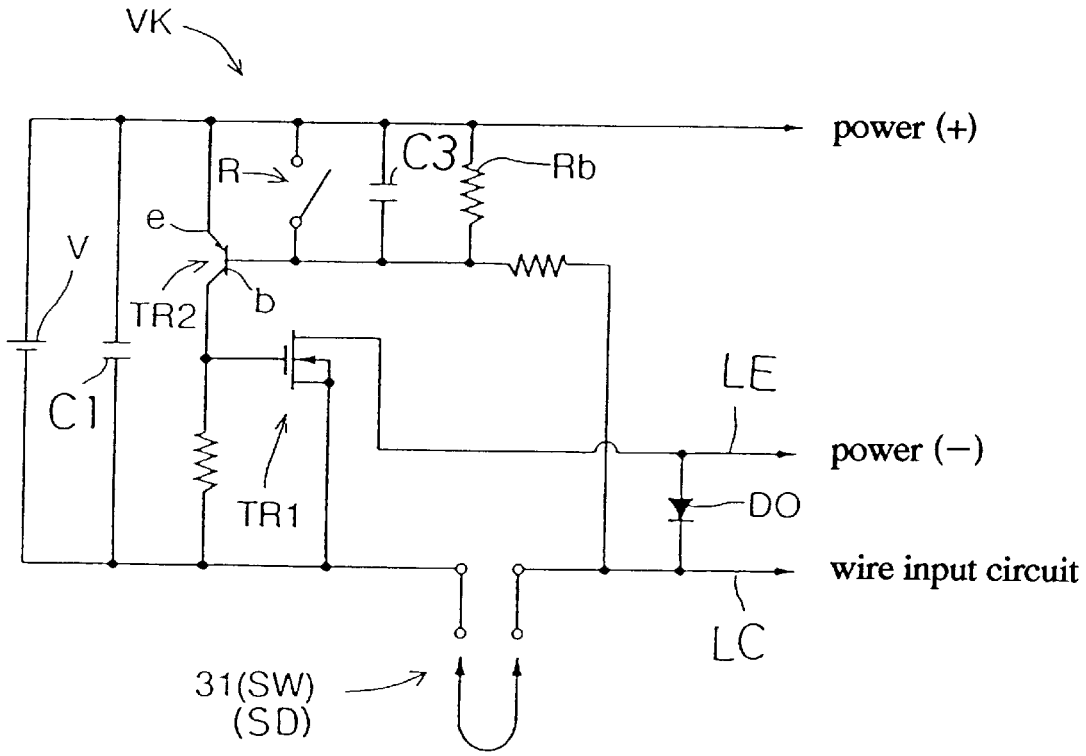
FIG. 41 is an electric circuit diagram of a power retaining circuit of a wire type theft preventive apparatus relating to a still further embodiment.

(20) In case using the wire type attachment tool shown in FIG. 1, in place of the power supply retaining circuit shown in FIG. 22, a power supply retaining circuit as shown in FIG. 41 may be employed.

This wire 31, as shown in FIG. 41, the activating switch SW is co-utilized in place of the power switch SW in the switch type detecting construction. Then, when the wire 31 as being retained to a commodity is connected with the box 2, power is supplied. And, in this construction, the connecting line LC to be connected with a wire input circuit 24 and a ground line LE are electrically connected with each other via a reverse voltage preventing diode DO for preventing the wire input circuit 24 from being applied with a potential higher than the ground terminal by a predetermined value, due to the transitional phenomenon at the time of power input as described above.

Except for the above respect, the other electric circuits are same as those of the switch type detecting construction.

In the case of this type, when the wire 31 is cut off as a preliminary stealing act, the base current of the activating transistor TR2 which was running at the negative terminal of the battery V now runs to the wire input circuit 24. With this current, the wire input circuit 24 detects this as cut-off of the wire 31 and outputs to the switching circuit 25 the reception signal in the case of the switch type detecting construction described hereinbefore. Further, as the wire input circuit 24 keeps providing the base current of the activating transistor TR2, this current maintains the activating transistor TR2 under the ON state. Hence, this power supply retaining circuit VK maintains the power supply retaining state unless the reset switch R is turned ON, once having been activated with attachment of the wire 31 to the box 2.

Accordingly, in the case of this type, the wire 31 functions not only as the power switch SW but also as the preliminary act detecting means SD. Further, in this type, the wire input circuit 24 constitutes a part of the alarm controlling means AC.

(21) In the foregoing embodiment, the switching means is constructed from the switching transistor TR2. Instead, the switching means may employ a self retaining circuit capable of retaining the power supply based on an activation signal to the activation instructing input terminal.

In the foregoing, the noise preventing means was constructed from the capacitor C3 connecting the base terminal (b) and the emitter terminal (e) of the switching transistor TR2. Instead, this means may be constructed from a plurality of serially connected diodes or by using zener diodes or resistors.

What is claimed is:

1. A theft preventive apparatus in which preliminary act detecting means (SD) for detecting a preliminary theft act is provided inside a box (2) to be attached to an object of theft prevention;

the box (2) accommodates therein alarm output means (AO) for outputting an alarm responsive to detection of a preliminary theft act by the preliminary act detecting means (SD), retaining means (VK) for retaining the alarm output means (AO) in an operative state thereof, and alarm releasing means (R) for stopping the operation of the alarm output means (AO);

an insertion hole (45) for a releasing operation is defined in the box (2) extending from an outer periphery thereof to the inside of the box; and the alarm releasing means (R) is adapted to be placed into an alarm releasing state by means of a bar-like releasing tool (K) to be inserted into the insertion hole (45); wherein the apparatus is characterized in that:

the retaining means (VK) is comprised of an electric retaining circuit to be set to the retaining state;

the alarm releasing means (R) is comprised of a retention releasing instruction switch for instructing a retention release to the electric retaining circuit (VK) in the form of an electric signal;

the preliminary act detecting means (SD) includes an antenna (22) disposed inside the box (2) for receiving a radio wave transmitted from a transmitter (O) installed at a predetermined site; and the alarm output means (AO) outputs the alarm information based on a reception signal from the antenna (22).

2. A theft preventive apparatus according to claim 1, wherein the releasing tool (K) includes a conductive rack portion (63) and the retention releasing instructing switch (R) is comprised of a pair of electric contact portions (47*a*), (47*b*) to be electrically connected responsive to contact with the rack portion (63) of the releasing tool (K).

3. A theft preventive apparatus according to claim 2, wherein a non-conductive partitioning portion (45*b*) is provided between the electric contact portions (47*a*), (47*b*) with the partitioning portion projecting from a contact face of the electric contact portions (47*a*), (47*b*); and the releasing tool (K) defines a concave portion (63*b*) which comes into engagement with the partitioning portion (45*b*) while allowing contact of the rack portion (63) with the electric contact portion (47*a*), (47*b*).

4. A theft preventive apparatus according to claim 1, wherein the preliminary act detecting means (SD) includes an attachment tool (3) to be connected with the box (2) for attaching the box (2) to the object of theft prevention and an attachment/detachment detecting switch (SW) for electrically detecting attachment and detachment of this attachment tool (3) to and from the box (2);

the retaining means (VK) is set to the retaining state based on a detachment detection singal of the attachment/detachment detecting switch (SW); and the alarm output means (AO) outputs the alarm information based on the detachment detection signal from the attachment/detachment detecting switch (SW).

5. A theft preventive apparatus according to claim 4, wherein there is provided lock means (41), (42) for locking the attachment tool (3) under its attached state to the box (2); and the lock means (41), (42) is operated into a lock-releasing state by the releasing tool (K) inserted into the insertion hole (45).

6. A theft preventive apparatus according to claim 1, wherein;

there is provided an attachment tool (3) for attaching the box (2) to the object of theft prevention;

this attachment tool (3) includes a pair of connecting portions (30, 30) to be connected by being inserted into insertion holes (40*a*, 40*b*) of the box (2) for connection of attachment tool and an intermediate connecting portion (31) for interconnecting these connecting portions (30, 30);

there are provided a pair of lock means (41, 42) for locking the connecting portions (30, 30) under inserted state inserted into the insertion holes (40*a*, 40*b*) for attachment tool connection;

lock releasing means (5) is provided to be switchable between a first releasing state for releasing one of the pair of lock means (41, 42) and a second releasing state for releasing both of the lock means (41, 42);

a bar-like releasing tool (K) which can be inserted into the insertion hole (45) for the releasing operation for operating the lock means (41, 42) in association with the insertion thereof to the inside of the box (2) operates to provide the first releasing state in association with insertion by a first insertion amount and to provide the second releasing state in association with insertion by a second insertion amount.

7. A theft preventive apparatus according to claim 6, wherein the releasing tool (K) includes a contact portion (s) for contacting the outer face of the box (2), a rack portion (63) projecting from the contact portion (s) to be inserted into the insertion hole (45) for the releasing operation, and a projection amount adjusting portion (W) for variably adjusting the amount of projection of the rack portion (63) from the contact portion (s).

8. A theft preventive apparatus according to claim 7, wherein the releasing tool (K) includes a hand-held outer sleeve (61, 81, 82) co-extensively forming the rack portion (63), an inner sleeve (60) supported to be movable in the longitudinal direction of the rack portion (63) relative to the outer sleeve (61, 81, 82) while covering the rack portion (63) and having a leading end which constitutes the contact portion (s), an urging tool (65) for urging the inner sleeve (60) towards the leading end of the rack portion, and a restricting tool (64) for restricting a limit of retraction of the inner sleeve (60) towards the outer sleeve; the projection amount adjusting portion (W) variably adjusts a restricting position of the restricting tool (64) in the moving direction of the inner sleeve.

9. A theft preventive apparatus according to claim 8, wherein an adjusting cap (62, 83, 84) is threadably movable relative to the outer sleeve (61, 81, 82) in the longitudinal direction of the rack portion;

the restricting tool (64) is provided to be movable relative to the outer sleeve (61, 81, 82) in the longitudinal direction of the rack portion and also to be urged in a direction away from the rack portion (63);

the adjusting cap (62, 83, 84) includes a restricting portion (V) for restricting limit of movement relative to the outer sleeve (61, 81, 82) in the direction toward the leading end of the rack portion in association with contact with the outer sleeve (61, 81, 82);

the adjusting cap (62, 83, 84) includes a first receiving portion (U1) for receiving the restricting tool (64) at the restriction position for the first releasing state when the restricting portion (V) is in contact with the outer sleeve (61, 81, 82);

the adjusting cap (62, 83, 84) includes a second receiving portion (U2) for receiving the restricting tool (64) at the restricting position for the second releasing state when the restricting portion (V) is moved away from the outer sleeve (61, 81, 82) by an amount greater than a predetermined amount; and the projection amount adjusting portion (W) effects the variable adjustment of the restricting position of the restricting tool (64) in association with a forward or reverse rotary operation of the adjucting cap (62, 83, 84) rotary operating portion relative to the outer sleeve (61, 81, 82).

10. A theft preventive apparatus according to claim 8, wherein the releasing tool (K) comprises a rack portion (63), and wherein a restricting portion (t) provided to the outer sleeve (61, 81, 82) for restricting the limit of movement of the inner sleeve (60) toward the leading end of the rack portion (63) restricts the leading end of the rack portion (63) to a position exposed from the inner sleeve (60).

11. A theft preventive apparatus according to claim 6 wherein the releasing tool (K) inserted into the insertion hole (45) for releasing operation operates the alarm releasing means (R) into the alarm releasing state.

12. A theft preventive apparatus according to claim 6, wherein the pair of connecting portions (30, 30) and the intermediate connecting portion (31) have electric conductivity; and the preliminary act detecting means (SD) detects the preliminary stealing act based on change of a conductive path formed when the connecting portions (30, 30) are electrically disconnected from the box (2).

13. A theft preventive apparatus according to claim 6, wherein the preliminary act detecting means (SD) includes an antenna (22) disposed inside the box (2) for receiving radio wave from a transmitter (O) installed at a predetermined site, and the detecting means detects a preliminary stealing act as the antenna (22) receives the radio wave from the transmitter (O).

14. A theft preventive apparatus according to claim 1, wherein the releasing tool (K) is formed in a predetermined shape; and inside the insertion hole (45), there is provided insertion preventing means (IS) for preventing insertion into the insertion hole (45) of a fake operating tool having a shape other than the predetermined shape while allowing insertion into the insertion hole (45) of the releasing tool (K) having this predetermined shape.

15. A theft preventive apparatus according to claim 14, wherein the insertion preventing means (IS) is comprised of a projection (45*a*), (45*b*) which projects from an inner wall portion of the insertion hole (45) into the inner space thereof as viewed in a longitudinal direction of the insertion hole (45); and the releasing tool (K) defines, in an outer face portion thereof, a concave groove (63*a*) into which the projection (45*a*), (45*b*) fits when the tool (K) is inserted into the insertion hole (45).

16. A theft preventive apparatus according to claim 15, wherein the projection (45*b*) is formed at a further inside portion than the entrance opening of the insertion hole (45).

17. A theft preventive apparatus according to claim 15, wherein a plurality of the projections (45*a*), (45*b*) are formed at different phases as viewed in the longitudinal direction of the insertion hole (45).

18. A theft preventive apparatus according to claim 17, wherein the plurality of projections (45*a*), (45*b*) are formed at different longitudinal positions of the insertion hole (45).

19. A theft preventive apparatus according to claim 15, wherein the projection (45*a*), (45*b*) is provided in the form of a projecting ridge extending along the longitudinal direction of the insertion hole (45).

20. A theft preventive apparatus according to claim 1, wherein, inside the box (2), there are provided a battery (V) for driving the preliminary act detecting means (SD) and the alarm output means (AO); and auxiliary power supplying means (Va) charged by the battery (V) and driving the preliminary act detecting means (SD) and the alarm output means (AO) when power supply from the battery (V) is at least momentarily cut off.

21. A theft preventive apparatus according to claim 20, wherein the alarm output means (AO) continuously outputs the alarm information even if the preliminary act detecting means (SD) makes no detection of preliminary stealing act, after the alarm output means (AO) has outputted the alarm information based on preliminary stealing act detection information of the preliminary act detecting means (SD).

22. A theft preventive apparatus according to claim 20, wherein the preliminary act detecting means (SD) includes an attachment tool (3) to be connected with the box (2) for attaching the box (2) to the object of theft prevention, and an attachment/detachment detecting switch (24) for electrically detecting attachment and detachment of the attachment tool (3) to and from the box (2); and the alarm output means (AO) outputs the alarm information based on a detachment detection signal from the attachment/detachment detecting switch (24) as the preliminary act detection information.

23. A theft preventive apparatus according to claim 20, wherein the preliminary act detecting means (SD) includes an antenna (AN) disposed inside the box (2) for receiving radio wave from a transmitter (O) installed at a predetermined site; and the alarm output means (AO) outputs the alarm information based on a reception signal of the antenna (AN)as the preliminary stealing act detection information.

24. A theft preventive apparatus according to claim 1, further comprising checking means (H) for allowing the alarm output means (AO) to output the alarm information only when the preliminary stealing act detection information outputted from the preliminary act detecting means (SD) continues to exist for at least a predetermined time period.

25. A theft preventive apparatus according to claim 24, wherein the preliminary act detecting means (SD) includes an attachment tool (3, 103) to be connected to the box (2) for attaching the box (2) to the object of theft prevention and an attachment/detachment detecting switch (SW) for electrically detecting attachment and detachment of the attachment tool (3, 103) to and from the box (2); and the alarm output means (AO) outputs the alarm information based on a detachment detection signal from the attachment/detachment detecting switch (SW) as the preliminary stealing act detection information.

26. A theft preventive apparatus according to claim 1, wherein the apparatus further comprises an attachment tool (3) having, at opposed ends thereof, connecting portions (30) to be connected by being inserted into the insertion hole (40*a*, 40*b*) of the box (2) and having also a conductive intermediate connecting portion (31) for electrically interconnecting the connecting portions (30) at the opposed ends;

engaged portions (30*a*) are provided at the opposed connecting portions (30);

inside the box (2), there are provided engaging members (41, 42) which can engage with the engaged portions (30*a*) at the connecting portions (30) inserted into the insertion hole (40*a*), 40*b*) and which are urged toward the engaging side;

the alarm output means (AO) disposed inside the box (2) electrically connected with the opposed connecting portions (30) are connected with the box (2) and outputting the alarm information based on a conductive path formed by the electrical connection becoming non-conductive; and withdrawal of the connecting portions (30) inserted into the insertion hole (40*a*, 40*b*) is prevented by means of engagement between the engaged portions (30*a*) and the engaging members (41, 42).

27. A theft preventive apparatus according to claim 26, wherein inside the box (2), there is provided a conductive spring (44*a*, 44*b*) which is contacted with and pressed against an end of the connecting portions (30) inserted into the insertion hole (40*a*, 40*b*) for connection of the attachment tool, with the spring being connected by means of a receiving member (48*a*, 48*b*) electrically connected with the alarm output means (AO).

28. A theft preventive apparatus according to claim 27, wherein the spring (44*a*, 44*b*) comprises a coil spring.

29. A theft preventive apparatus according to claim 27, wherein, inside the box (2), there is provided engagement releasing means (D) for operating the engaging member (41, 42) into an engagement-released state;

the alarm releasing means (R) is operated into the alarm releasing state and the engagement releasing means (D) is operated into an engagement releasing state by means of said releasing tool (K) when it is inserted into the insertion hole (45) for releasing operation.

30. A theft preventive apparatus according to claim 27, wherein the spring (44*a*, 44*b*) is provided with an urging force which moves the connecting portion (30) to the outside of the box in association with an operation of the engaging member (41, 42) toward the engagement releasing side.

31. A theft preventive apparatus according to claim 1, wherein inside the box (2), there is provided a radio-wave receiving antenna (22) having a coil (22*a*), and a buzzer (21) having electric capacity;

the alarm output means (AO) causes the buzzer (21) to generate a sound when the receiving antenna (22) receives a sound generation instructing radio wave;

a resonance circuit being formed by connecting the buzzer (21) with the coil (22*a*) of the receiving antenna (22); and a transmitter (O) for transmitting the sound generation instructing radio wave to the receiving antenna (22) is installed at a predetermined site.

32. A theft preventive apparatus according to claim 31, wherein the alarm output means (AO) is constructed so as to cause the buzzer (21) to generate a sound responsive to detection of preliminary act by a preliminary theft act detecting means (SD).

33. A theft preventive apparatus according to claim 31, wherein the alarm releasing means (R) disposed inside the box (2) comprises sound alarm releasing means (R); and said sound alarm releasing means (R) is operated into a sound alarm releasing state by means of the releasing tool (K) inserted into the insertion hole (45) defined to extend from the out face of the box to the inside of the box (2).

34. A theft preventive apparatus according to claim 1, the alarm output means (AO) disposed inside the box (2) includes alarm information output means (AI) for outputting alarm information, and alarm controlling means (AC) for activating the alarm information output means (AI) into an alarm information outputting state;

the electric retaining circuit (VK) includes electric switching means (TR2) which is set to the retaining state by being switched over to a conductive state in response to an activating signal associated with an ON-operation of an activating switch (SW); and there is provided noise preventing means (C3) for preventing a noise signal acting as the activating signal from being provided to an activation instructing unit (b) of the switching means (TR2) to which the activating signal is provided.

35. A theft preventive apparatus according to claim 34, wherein a detecting portion (24') of the alarm controlling means (AC) for detecting a preliminary act and the activating switch (SW) are connected via a connecting line (LC); and a preliminary theft act is detected also when the activating switch (SW) is turned OFF.

36. A theft preventive apparatus according to claim 34, wherein, when opposed ends of a conductive wire (31) for retaining the box (2) to the object of theft prevention are connected with the insertion hole (40*a*), (40*b*) of the box (2), the activating switch (SW) is turned ON by using the wire (31) as a conductive path.

37. A theft preventive apparatus according to claim 35, wherein the retaining means (VK) includes power retaining switching means (TR1) for connecting and disconnecting a power supply line (LE) to the alarm controlling means (AC), the switching means (TR1) being rendered conductive in association with switchover of the switching means (TR2) to the conductive state; and the connecting line (LC) and the supply line (LE) are electrically connected with each other.

38. A theft preventive apparatus according to claim 37, wherein the connecting line (LC) and the supply line (LE) are be connected with each other under zero electric resistance condition.

39. A theft preventive apparatus according to claim 34, wherein the switching means (TR2) comprises a switching transistor; and the noise preventing means (C3) comprises a capacitor interconnecting a base terminal (b) and an emitter terminal (e) of the switching transistor (TR2).

40. A radio wave receiving signaling device comprising:

a radio wave receiving antenna (22) having a coil (22*a*), an electrically capacitive buzzer (21); and alarm output means (AO) for activating the buzzer (21) to generate sound when the receiving antenna (22) receives a sound generation instructing signal;

wherein the buzzer (21) and the entire or part of the coil (22*a*) of the receiving antenna (22) are connected to form a resonance circuit.

* * * * *